US010688551B2

(12) United States Patent
Aso et al.

(10) Patent No.: US 10,688,551 B2
(45) Date of Patent: Jun. 23, 2020

(54) HAT-SHAPED CROSS-SECTION COMPONENT MANUFACTURING METHOD

(71) Applicant: NIPPON STEEL & SUMITOMO METAL CORPORATION, Tokyo (JP)

(72) Inventors: Toshimitsu Aso, Tokyo (JP); Yasuharu Tanaka, Tokyo (JP); Takashi Miyagi, Tokyo (JP); Misao Ogawa, Tokyo (JP); Shinobu Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 541 days.

(21) Appl. No.: 15/537,595

(22) PCT Filed: Dec. 18, 2015

(86) PCT No.: PCT/JP2015/085553

§ 371 (c)(1),
(2) Date: Jun. 19, 2017

(87) PCT Pub. No.: WO2016/104376

PCT Pub. Date: Jun. 30, 2016

(65) Prior Publication Data

US 2018/0264534 A1 Sep. 20, 2018

(30) Foreign Application Priority Data

Dec. 22, 2014 (JP) ..... 2014-259102

(51) Int. Cl.
*B21D 22/26* (2006.01)
*B21D 22/20* (2006.01)
(Continued)

(52) U.S. Cl.
CPC ..... *B21D 22/26* (2013.01); *B21D 22/20* (2013.01); *B21D 22/30* (2013.01); *B21D 47/01* (2013.01)

(58) Field of Classification Search
CPC ..... B21D 22/26; B21D 22/20; B21D 22/30
See application file for complete search history.

(56) References Cited

U.S. PATENT DOCUMENTS 1,606,141 A * 11/1926 Brown ..... B21D 24/10 72/351
2005/0262917 A1 12/2005 Osumi et al.
(Continued)

FOREIGN PATENT DOCUMENTS

JP 2003-103306 A 4/2003
JP 2004-154859 A 6/2004
(Continued)

OTHER PUBLICATIONS

Korean Office Action, dated Nov. 13, 2018, for corresponding Korean Application No. 10-2017-7016764, with a partial English translation.
(Continued)

*Primary Examiner* — Teresa M Ekiert
(74) *Attorney, Agent, or Firm* — Birch, Stewart, Kolasch & Birch, LLP

(57) ABSTRACT

A method for manufacturing a hat-shaped cross-section component includes a gripping process, a bending and stretching process, and a bend back process. In the gripping process, a pair of vertical walls of an elongated preliminarily formed component are disposed outside of a punch, and a top plate is gripped using the punch and a pad. In the bending and stretching process, die moves toward the punch side relative to the preliminarily formed component, and the die bends and stretches the vertical walls toward the opposite side to the top plate at one side in the length direction of the preliminarily formed component. In the bend back process, a holder moves toward the pad side relative to the preliminarily formed component, and the holder bends back
(Continued)

the vertical walls toward the top plate side at another side in the length direction of the preliminarily formed component.

15 Claims, 70 Drawing Sheets

(51) Int. Cl.
*B21D 22/30* (2006.01)
*B21D 47/01* (2006.01)

(56) References Cited

U.S. PATENT DOCUMENTS

| | | | | |
|---|---|---|---|---|
| 2013/0064998 | A1* | 3/2013 | Wnek | B21D 22/26 428/34.1 |
| 2014/0356643 | A1* | 12/2014 | Nakata | B21D 22/26 428/603 |
| 2015/0336158 | A1 | 11/2015 | Miyagi et al. | |
| 2016/0375477 | A1 | 12/2016 | Tanaka et al. | |

FOREIGN PATENT DOCUMENTS

| | | | |
|---|---|---|---|
| JP | 2006-15404 | A | 1/2006 |
| JP | 2008-307557 | A | 12/2008 |
| JP | 2012-51005 | A | 3/2012 |
| KR | 10-1869177 | B1 | 6/2018 |
| RU | 2057606 | C1 | 4/1996 |
| WO | WO 2014/106931 | A1 | 7/2014 |
| WO | WO 2015/098871 | A1 | 7/2015 |

OTHER PUBLICATIONS

Indian Examination Report for corresponding Indian Application No. 201717024224, dated Nov. 21, 2019, with English translation.
Chinese Office Action and Search Report, dated Apr. 26, 2018 for corresponding Chinese Application No. 201580069629.4 , with an English translation of the Chinese Office Action.
International Search Report for PCT/JP2015/085553 dated Feb. 23, 2016.
Written Opinion of the International Searching Authority for PCT/JP2015/085553 (PCT/ISA/237) dated Feb. 23, 2016.

* cited by examiner

FIG.35

| | Case | Tensile Strength of Material (MPa) | Sheet Thickness *t* (mm) | θ (°) | Clearance *b* (mm) | b/t | Pad Pressure (MPa) | Blank Holder Pressure (MPa) | Creasing |
|---|---|---|---|---|---|---|---|---|---|
| Example | 1 | 980 | 1.8 | 90 | 1.8 | 1.00 | 5.83 | 2.50 | ◎Absent |
| | 2 | 980 | 1.8 | 91 | 1.8 | 1.00 | 5.83 | 2.50 | ◎Absent |
| | 3 | 980 | 1.8 | 92 | 1.8 | 1.00 | 5.83 | 2.50 | ◎Absent |
| | 4 | 980 | 1.8 | 95 | 1.8 | 1.00 | 5.83 | 2.50 | ○Present |
| | 5 | 980 | 1.8 | 100 | 1.8 | 1.00 | 5.83 | 2.50 | ○Present |
| | 6 | 980 | 1.6 | 90 | 1.8 | 1.13 | 5.83 | 2.50 | ◎Absent |
| | 7 | 980 | 1.4 | 90 | 1.8 | 1.29 | 5.83 | 2.50 | ○Present |
| | 8 | 980 | 1.2 | 90 | 1.8 | 1.50 | 5.83 | 2.50 | ○Present |
| | 9 | 980 | 1.0 | 90 | 1.8 | 1.80 | 5.83 | 2.50 | ○Present |
| | 10 | 440 | 1.6 | 90 | 1.8 | 1.13 | 2.33 | 1.50 | ◎Absent |
| | 11 | 440 | 1.6 | 90 | 1.8 | 1.13 | 1.17 | 1.50 | ◎Absent |
| | 12 | 440 | 1.6 | 90 | 1.8 | 1.13 | 0.58 | 1.50 | ◎Absent |
| | 13 | 400 | 1.6 | 90 | 1.8 | 1.13 | 0.09 | 1.50 | ○Present |
| | 14 | 440 | 1.6 | 90 | 1.8 | 1.13 | 3.50 | 1.00 | ◎Absent |
| | 15 | 440 | 1.6 | 90 | 1.8 | 1.13 | 3.50 | 0.75 | ◎Absent |
| | 16 | 440 | 1.6 | 90 | 1.8 | 1.13 | 3.50 | 0.09 | ○Present |
| | 17 | 1310 | 1.8 | 90 | 1.8 | 1.00 | 5.83 | 2.50 | ◎Absent |
| | 18 | 590 | 1.6 | 90 | 1.8 | 1.13 | 3.50 | 1.50 | ◎Absent |
| | 19 | 440 | 1.6 | 90 | 1.8 | 1.13 | 2.33 | 1.50 | ◎Absent |

D-D CROSS-SECTION

HAT-SHAPED CROSS-SECTION COMPONENT MANUFACTURING METHOD

TECHNICAL FIELD

The present invention relates to a manufacturing method for a hat-shaped cross-section component that has a hat-shaped cross-section.

BACKGROUND ART

Pressed components with a hat-shaped cross-section profile (also referred to as "hat-shaped cross-section components" in the present specification), such as front side members, are known as structural members configuring automotive vehicle body framework. Such hat-shaped cross-section components are formed by performing press working (drawing) or the like on metal sheet materials (for example, steel sheets) (see, for example, Japanese Patent Application Laid-Open (JP-A) Nos. 2003-103306, 2004-154859, and 2006-015404).

SUMMARY OF INVENTION

Technical Problem

In the manufacture of hat-shaped cross-section components, sometimes a preliminarily formed component with a hat-shaped cross-section profile is formed, and secondary processing is performed on the preliminarily formed component to change the height of the preliminarily formed component and manufacture the hat-shaped cross-section component. For example, in the secondary processing, vertical walls at one side in a length direction of the preliminarily formed component are bent and stretched to increase the height of the preliminarily formed component, and vertical walls at another side in the length direction of the preliminarily formed component are bent back to lower the height of the preliminarily formed component, thereby manufacturing the hat-shaped cross-section component.

However, in the secondary processing, for example, there is a possibility of cracking or the like occurring at a boundary portion between the vertical wall portions that are bent and stretched and the vertical wall portions that are bent back if the bending and stretching and the bending back are performed at the same time as each other.

In consideration of the above circumstances, the present disclosure relates to obtaining a hat-shaped cross-section component manufacturing method in which the height of a preliminarily formed component can be changed while suppressing the occurrence of cracking or the like.

Solution to Problem

A method for manufacturing a hat-shaped cross-section component addressing the above issue includes: a gripping process of disposing a pair of vertical walls of an elongated preliminarily formed component that has been formed into a hat shaped cross section profile at a width direction outer side of a punch, and gripping a top plate of the preliminarily formed component using the punch and a pad; a bending and stretching process of, after the gripping process, moving a die provided on both width direction sides of the pad toward a punch side relative to the preliminarily formed component, and using the die to bend and stretch the vertical walls toward an opposite side to the top plate at one side in a length direction of the preliminarily formed component; and a bend back process of, after the gripping process, moving a holder provided on both width direction sides of the punch toward a pad side relative to the preliminarily formed component, and using the holder to bend back the vertical walls toward a top plate side at another side in the length direction of the preliminarily formed component.

According to the hat-shaped cross-section component manufacturing method addressing the above issue, in the gripping process, the top plate of the elongated preliminarily formed component that has been formed into a hat shaped cross section profile is gripped using the punch and the pad. When this is performed, the pair of vertical walls of the preliminarily formed component are disposed at the width direction outside of the punch. Then, in the bending and stretching process, after the gripping process, the die provided on both width direction sides of the pad is moved toward the punch side relative to the preliminarily formed component, and the die is used to bend and stretch the vertical walls toward the opposite side to the top plate at one side in the length direction of the preliminarily formed component. In this manner, the height of the vertical walls at one side in the length direction of the preliminarily formed component is changed so as to become higher.

On the other hand, in the bend back process, after the gripping process, the holder provided on both width direction sides of the punch is moved toward the pad side relative to the preliminarily formed component. The holder is used to bend back the vertical walls toward the top plate side at another side in the length direction of the preliminarily formed component. In this manner, the height of the vertical walls at another side in the length direction of the preliminarily formed component is changed so as to become lower.

Moreover, in cases in which the vertical wall portion that is bent and stretched and the vertical wall portion that is bent back are adjacent to each other in the length direction of the preliminarily formed component, the bend back process is performed after the bending and stretching process, or the bending and stretching process is performed after the bend back process. This thereby enables the occurrence of cracking or the like to be suppressed at a boundary portion between the vertical wall portion that is bent and stretched and the vertical wall portion that is bent back. Moreover, by separating the vertical wall portion that is bent and stretched and the vertical wall portion that is bent back in the length direction of the preliminarily formed component, any effect from the bend back process on the vertical wall portion that is bent and stretched can be suppressed, and any effect from the bending and stretching process on the vertical wall portion that is bent back can be suppressed, even when bending and stretching and bending back are performed at the same time. Due to the above, the height of the preliminarily formed component can be changed while suppressing the occurrence of cracking or the like.

Advantageous Effects of Invention

The hat-shaped cross-section component manufacturing method of the present disclosure exhibits the excellent advantageous effect of enabling the height of a preliminarily formed component to be changed while suppressing the occurrence of cracking or the like.

BRIEF DESCRIPTION OF DRAWINGS

FIG. 35 is a table to explain circumstances under which creasing occurs in a preliminary curving component when various parameters are changed in a first process.

DESCRIPTION OF EMBODIMENTS

Figure 1A:
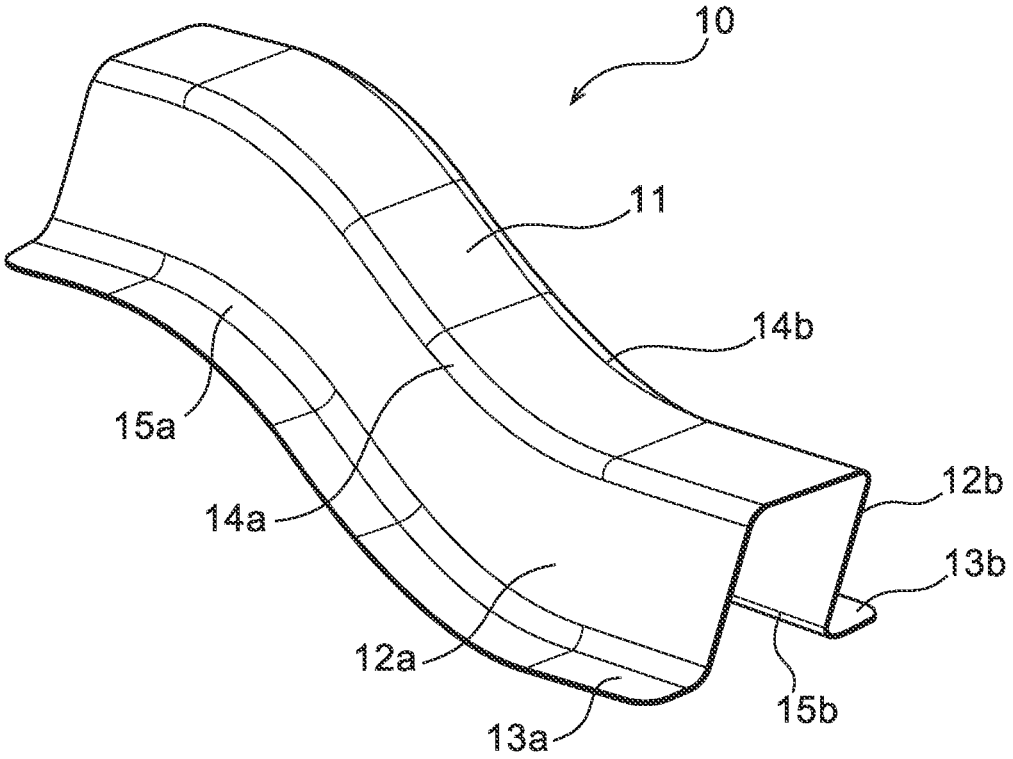
FIG. 1A is a perspective view illustrating an example of a preliminary curving component formed by a first process of a hat-shaped cross-section component manufacturing method according to an exemplary embodiment.
Figure 1B:
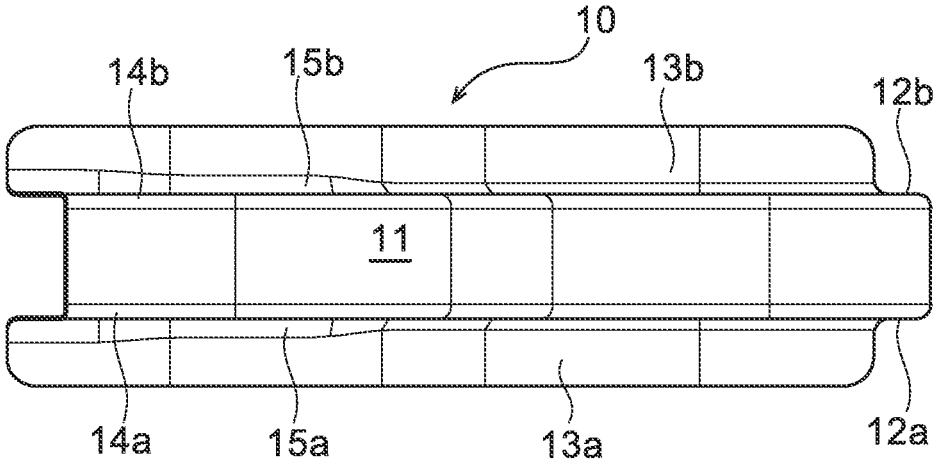
FIG. 1B is a plan view illustrating the preliminary curving component illustrated in FIG. 1A from above.
Figure 1C:
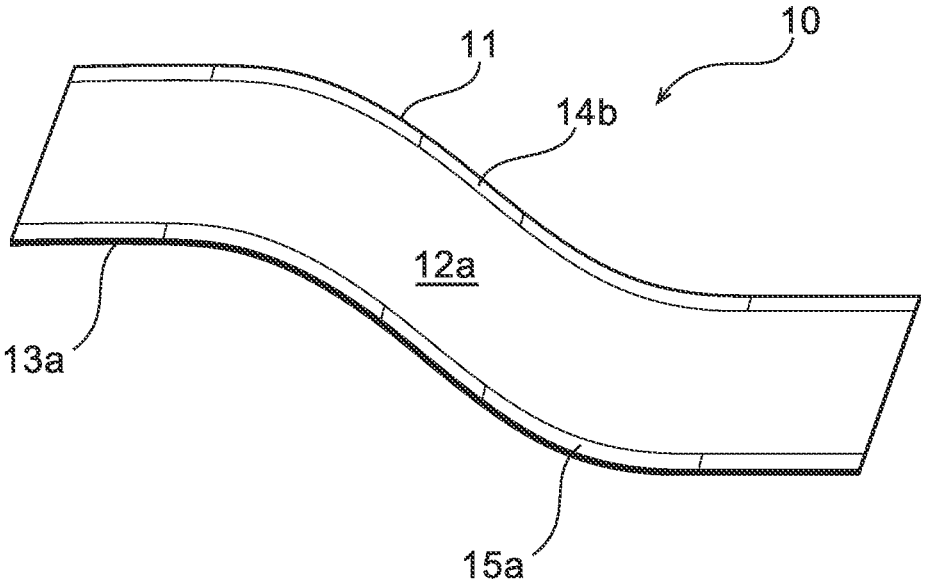
FIG. 1C is a side view illustrating the preliminary curving component illustrated in FIG. 1A from one width direction side.
Figure 1D:
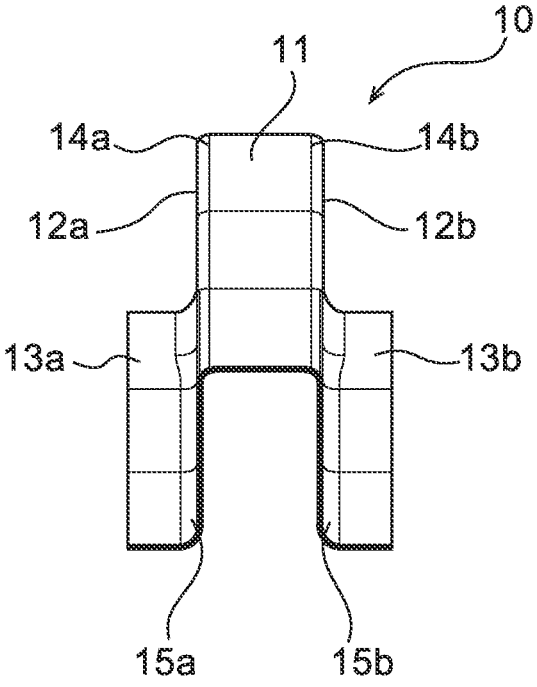
FIG. 1D is a front view illustrating the preliminary curving component illustrated in FIG. 1A from one length direction side.

Explanation follows regarding a manufacturing method for a hat-shaped cross-section component according to an exemplary embodiment, with reference to the drawings. The hat-shaped cross-section component manufacturing method includes a first process (shear forming process) of a "preliminary forming process" for forming a preliminarily formed component, a second process (intermediate process) for processing (forming) the preliminarily formed component to change the height of the preliminarily formed component, and a third process, serving as a "restriking process", for restriking the preliminarily formed component that has undergone the second process. Explanation follows regarding each of these processes. Note that in the drawings, equivalent members and the like are allocated the same reference numerals, and in the following explanation, duplicate explanation of equivalent members is omitted as appropriate after being described for the first time.

First Process

Figure 5:
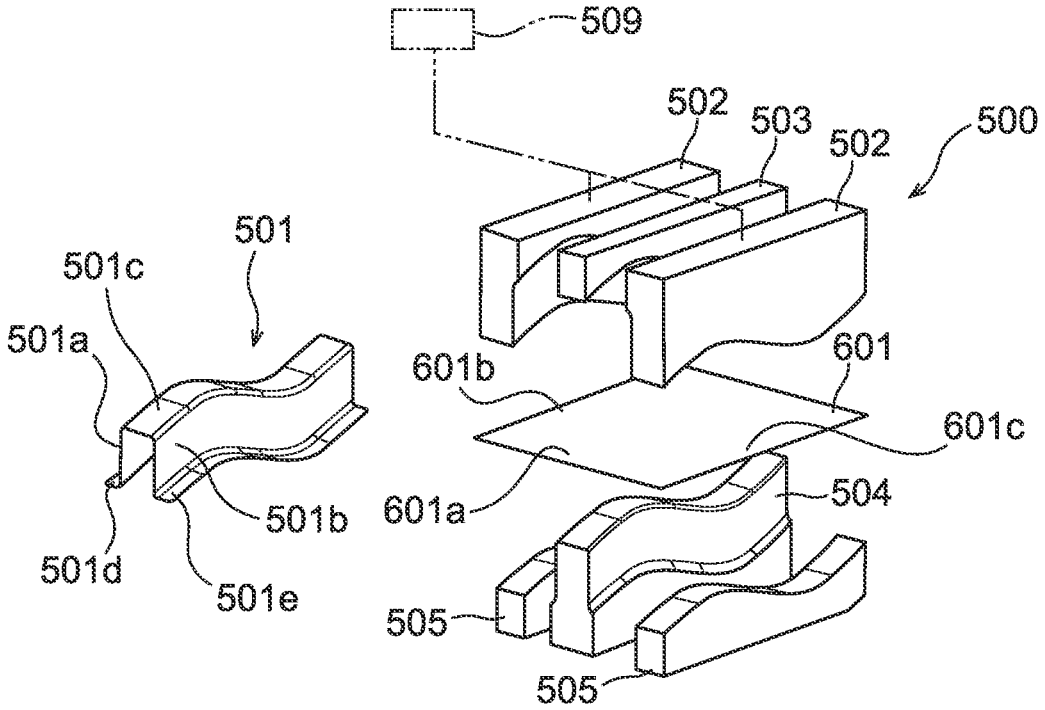
FIG. 5 is an exploded perspective view illustrating relevant portions of a manufacturing apparatus employed in the first process.

As illustrated in FIG. 5, in the first process, a preliminary curving component 10 (see FIG. 2) is formed as a "preliminarily formed component" and a "curved member" by drawing a metal stock sheet 601 using a manufacturing apparatus 500. Explanation first follows regarding configuration of the preliminary curving component 10, followed by explanation regarding the manufacturing apparatus 500, and then explanation regarding the first process.

Preliminary Curving Component 10 Configuration

As illustrated in FIG. 1A to FIG. 1D and FIG. 2, the preliminary curving component 10 is configured from high strength sheet steel having tensile strength of from 200 MPa to 1960 MPa. The preliminary curving component 10 is formed in an elongated shape, and is formed with a hat shape as viewed in cross-section along its length direction. Specifically, the preliminary curving component 10 includes a top plate 11 extending along the length direction, and respective vertical walls 12*a*, 12*b* that are bent so as to extend toward the lower side (one sheet thickness direction side of the top plate 11) from both width direction sides of the top plate 11. The preliminary curving component 10 further includes respective flanges 13*a*, 13*b* that are bent so as to extend toward the width direction outside of the top plate 11 from lower ends (ends on the opposite side to the top plate 11) of the vertical walls 12*a*, 12*b*.

Ridge lines 14*a*, 14*b* are formed, extending along the length direction of the preliminary curving component 10, between the top plate 11 and the respective vertical walls 12*a*, 12*b*. Ridge lines 15*a*, 15*b* are formed extending along the length direction of the preliminary curving component 10 between the respective vertical walls 12*a*, 12*b* and the flanges 13*a*, 13*b*.

The ridge lines 14*a*, 14*b* and the ridge lines 15*a*, 15*b* are provided extending substantially parallel to each other. Namely, the height of the respective vertical walls 12*a*, 12*b* that extend from the respective flanges 13*a*, 13*b* toward the upper side (the other sheet thickness direction side of the top plate 11) is substantially uniform along the length direction of the preliminary curving component 10.

Figure 2:
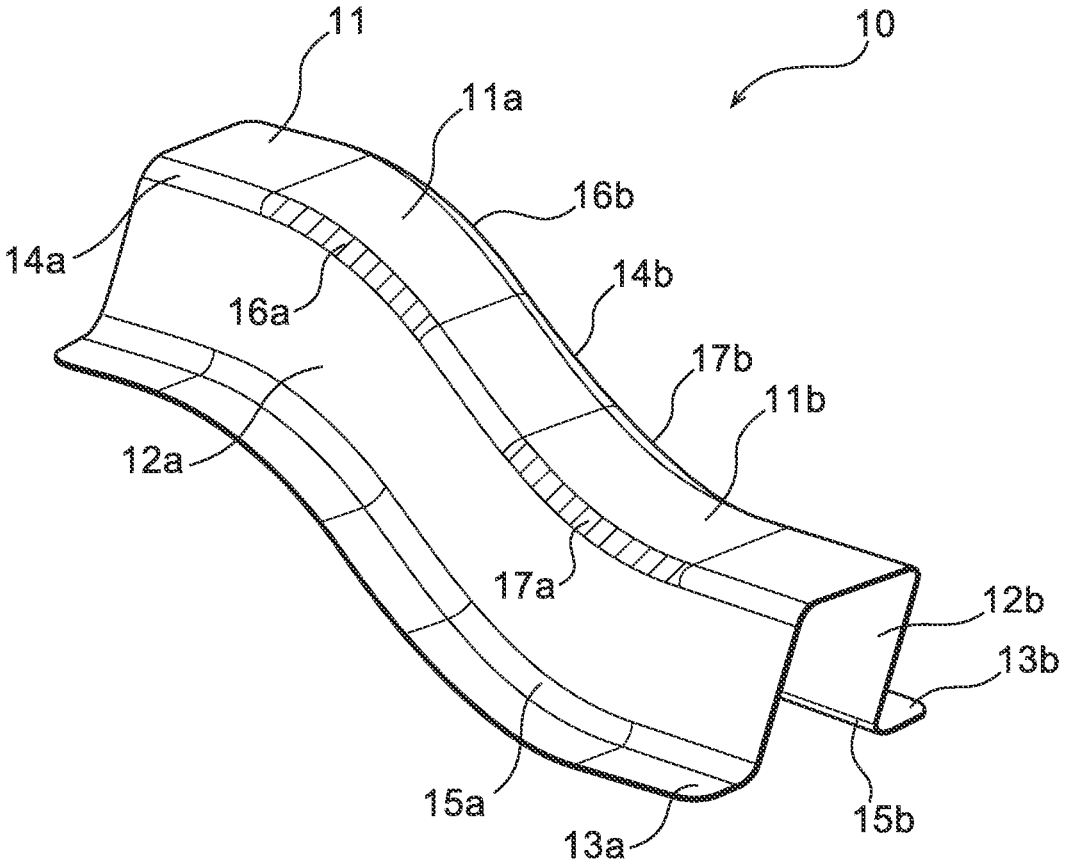
FIG. 2 is a perspective view corresponding to FIG. 1A, illustrating a preliminary curving component in order to explain ridge lines at locations corresponding to a concave shaped curved portion and a convex shaped curved portion.

As illustrated in FIG. 2, as viewed from the side, a portion of the top plate 11 is formed with a convex shaped curved portion 11*a* that curves in an arc shape toward the outside of the lateral cross-section profile of the hat shape, namely, toward the outer surface side (other sheet thickness direction side) of the top plate 11. Another portion of the top plate 11 is formed with a concave shaped curved portion 11*b* that curves in an arc shape toward the inside of the lateral cross-section profile of the hat shape, namely, toward the inner surface side (one sheet thickness direction side) of the top plate 11. At the convex shaped curved portion 11*a* and the concave shaped curved portion 11*b*, the ridge lines 14*a*, 14*b* between the top plate 11 and the vertical walls 12*a*, 12*b* are also curved in arc shapes, at locations 16*a*, 16*b*, and 17*a*, 17*b*, corresponding to the convex shaped curved portion 11*a* and the concave shaped curved portion 11*b*. Note that an "arc shape" is not limited to part of a perfect circle, and may be part of another curved line, such as of an ellipse, a hyperbola, or a sine wave.

Figure 3A:
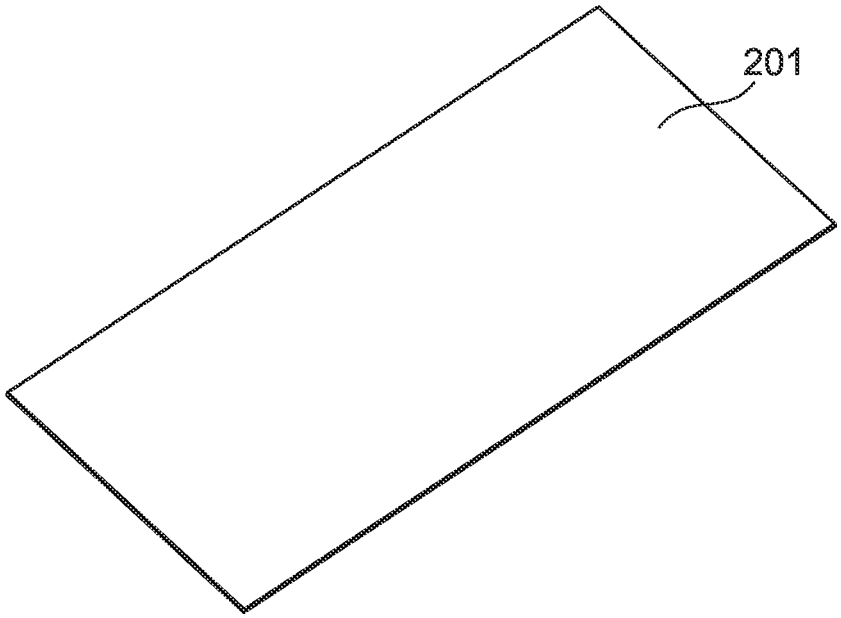
FIG. 3A is a perspective view illustrating a metal stock sheet before forming.
Figure 3B:
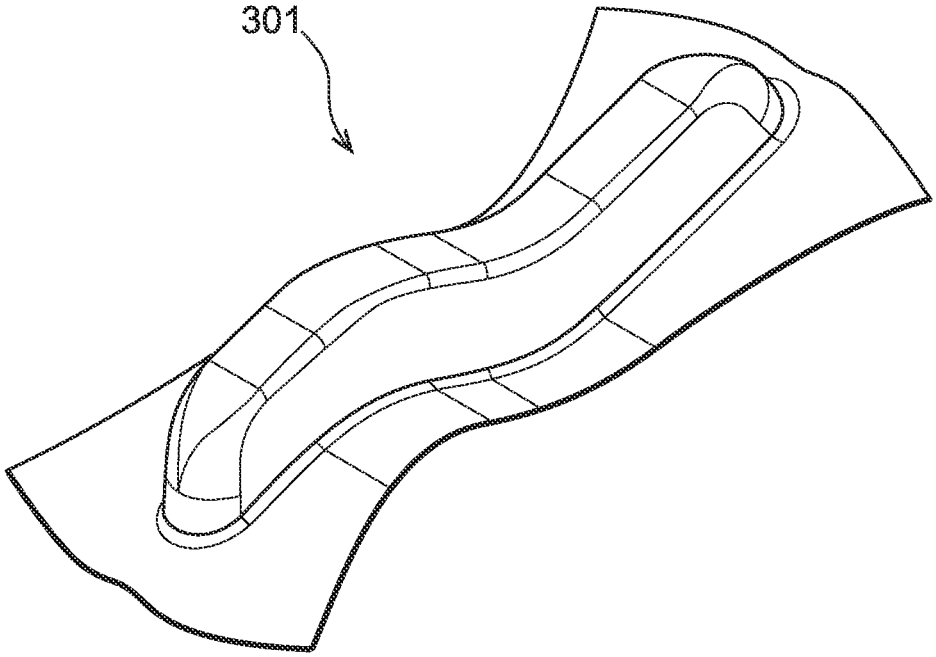
FIG. 3B is a perspective view illustrating a drawn panel.

The preliminary curving component 10 described above is formed by forming a drawn panel 301 (see FIG. 3B) by drawing a rectangular shaped metal stock sheet 201, serving as a "metal sheet", illustrated in FIG. 3A, and then trimming unwanted portions of the drawn panel 301.

Figure 4:
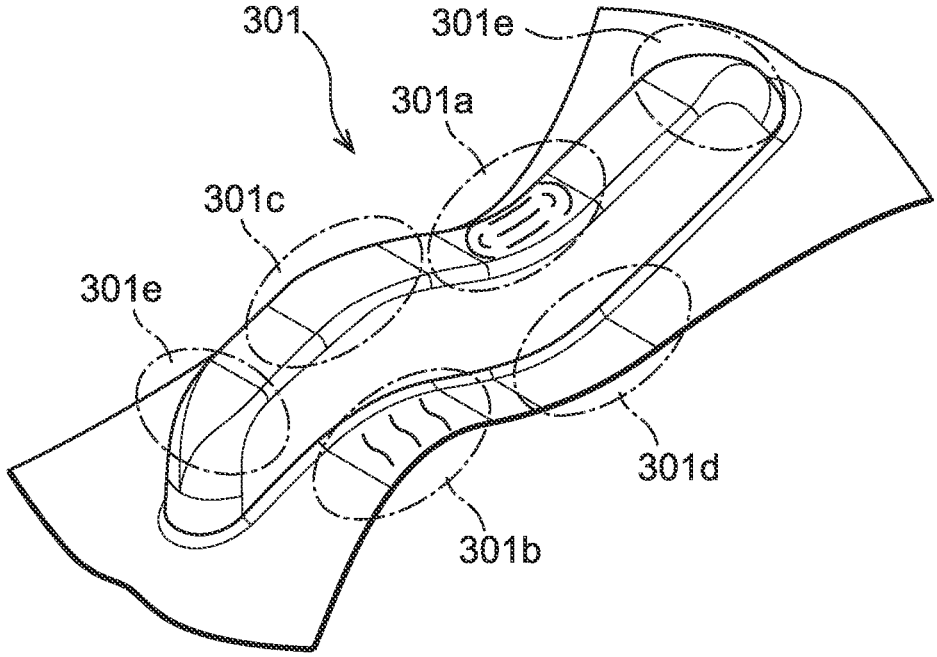
FIG. 4 is perspective view corresponding to FIG. 3B, illustrating locations in the drawn panel where cracks and creases are liable to occur.

However, when manufacturing the preliminary curving component 10 with a hat-shaped cross-section by drawing, excess material is present during the drawn panel 301 forming stage at a concave shaped curved portion top plate 301*a* and a convex shaped curved portion flange 301*b* of the drawn panel 301, as illustrated in FIG. 4, and creases are liable to occur. Increasing restraint at the periphery of the metal stock sheet 201 during the process of forming by, for example, raising the pressing force of a blank holder, or adding locations to the blank holder for forming draw beads, and thereby suppressing inflow of the metal stock sheet 201 into the blank holder, are known to be effective in suppressing the occurrence of creases.

However, when there is enhanced suppression of inflow of the metal stock sheet 201 into the blank holder, there is also a large reduction in the sheet thickness of the drawn panel 301 at respective portions, including at a convex shaped curved portion top plate 301*c*, a concave shaped curved portion flange 301*d*, and both length direction end portions 301*e*, 301*e*. In cases in which the metal stock sheet 201 is a material with particularly low extensibility (for example high tensile steel), it is conceivable that cracking could occur at these respective portions.

Accordingly, due to endeavoring to avoid creasing and cracking in the manufacture by pressing using drawing of curving components with a hat-shaped cross-section, such as front side members configuring part of a vehicle body framework, it has been difficult to employ high strength materials with low extensibility as the metal stock sheet 201, meaning that low strength materials with high extensibility have had to be employed.

However, the occurrence of such creasing and cracking can be suppressed by performing the first process, described later, employing the manufacturing apparatus 500 of the present exemplary embodiment.

Manufacturing Apparatus 500

Figure 6A:
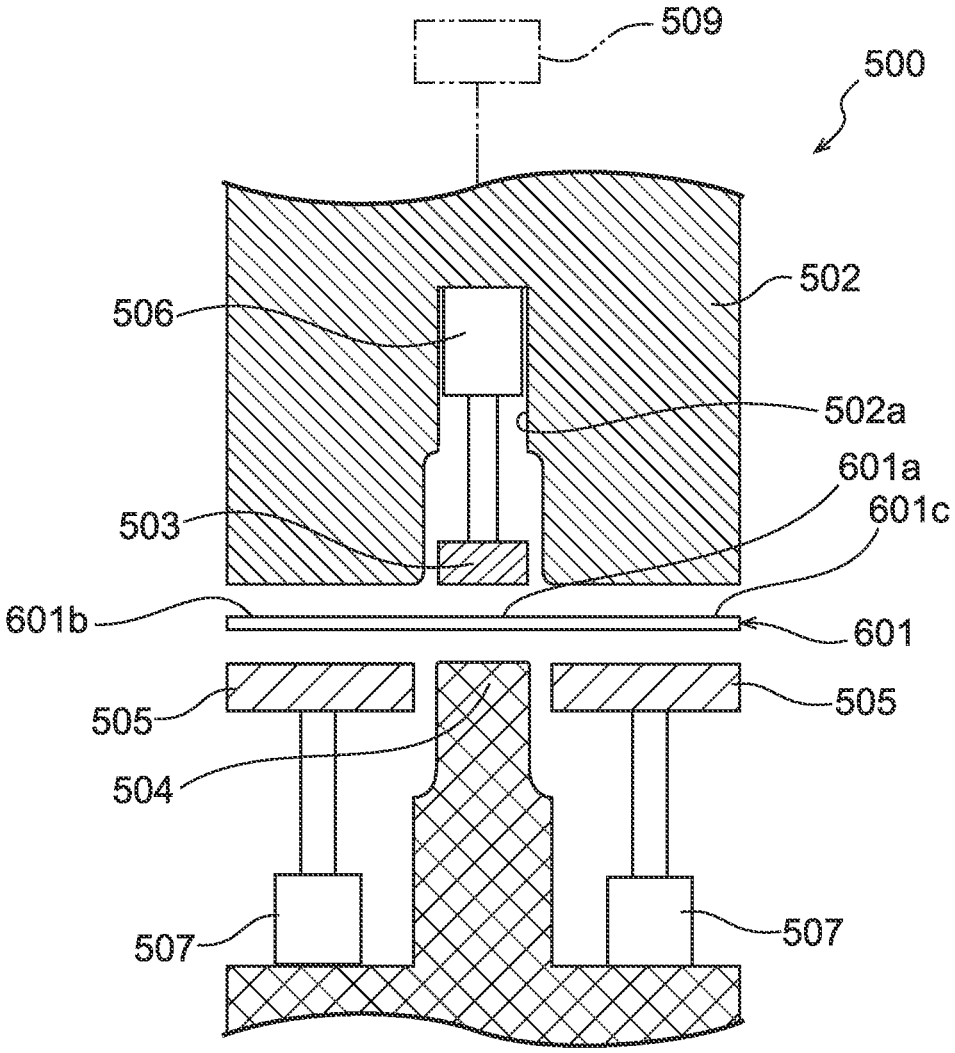
FIG. 6A is a cross-section illustrating a stage at the start of processing of the manufacturing apparatus illustrated in FIG. 5.
Figure 6B:
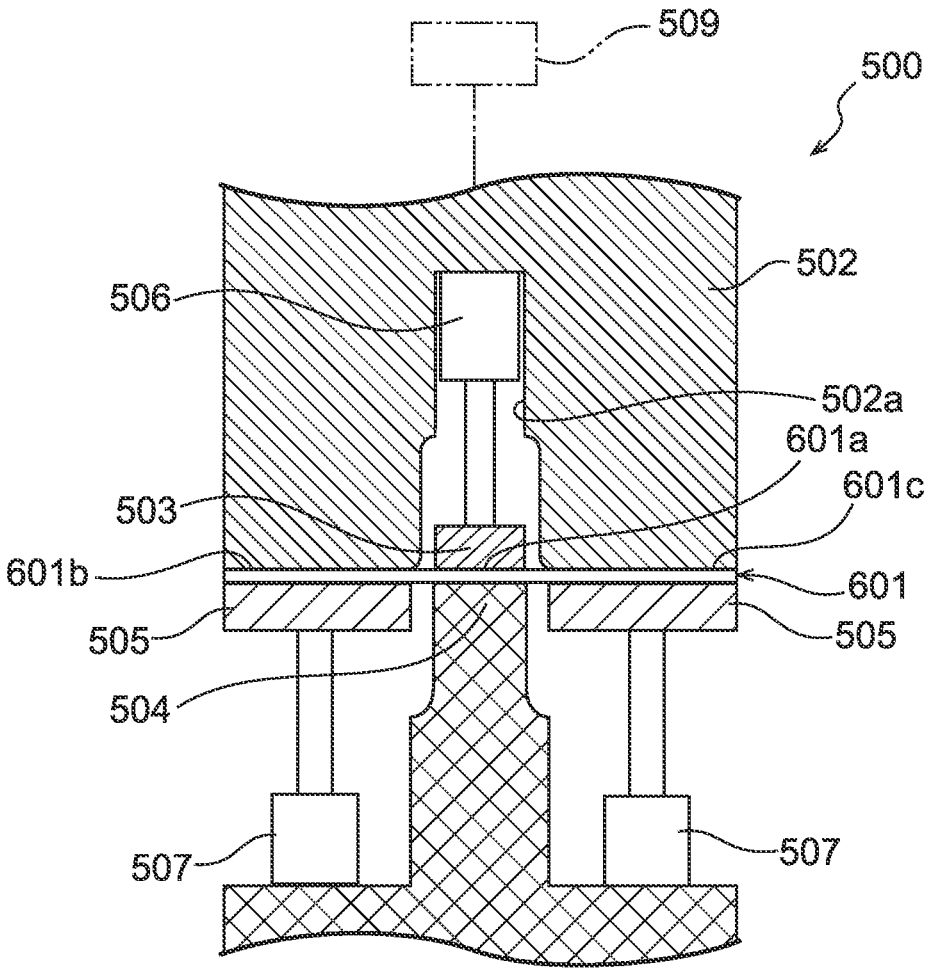
FIG. 6B is a cross-section illustrating the manufacturing apparatus illustrated in FIG. 5 at a stage at which a metal stock sheet is gripped and restrained between a die and pad, and a holder and a punch.
Figure 6C:
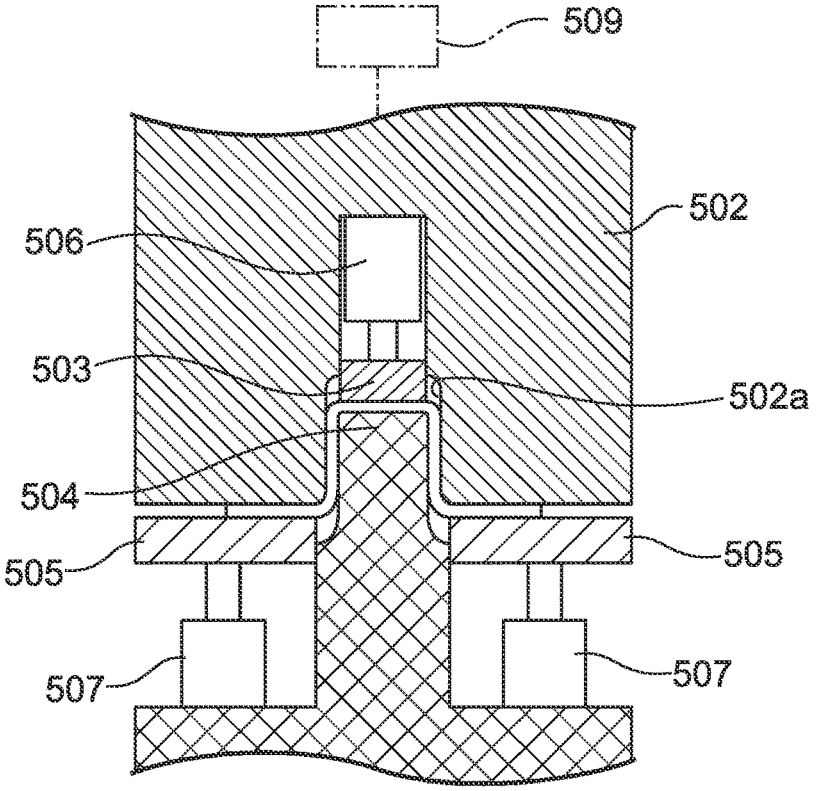
FIG. 6C is a cross-section illustrating a stage at which the punch has been pushed in from the stage illustrated in FIG. 6B.
Figure 6D:
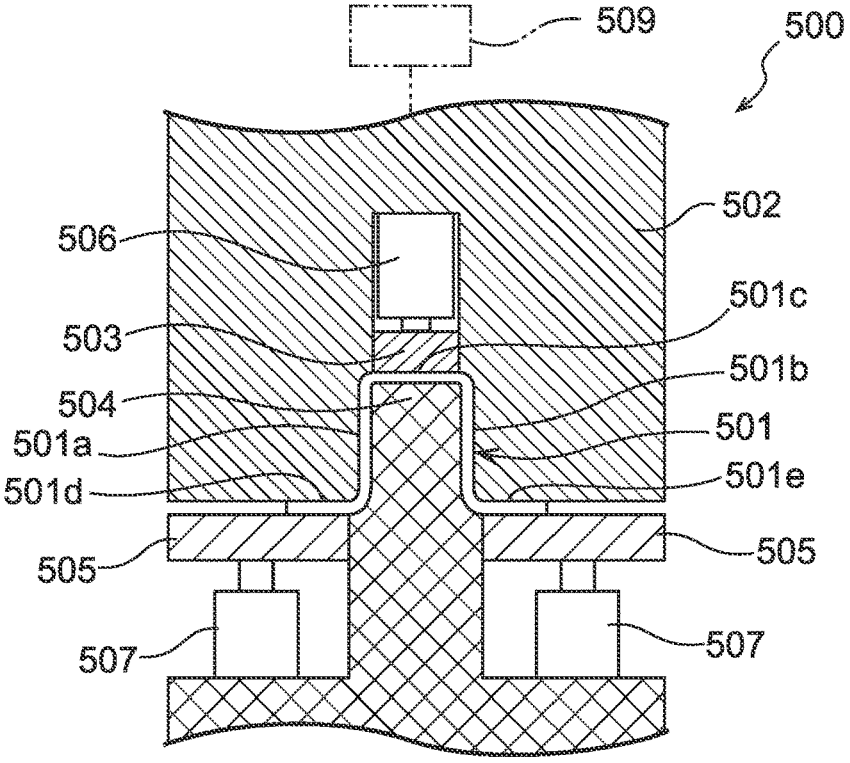
FIG. 6D is a cross-section illustrating a state in which the punch has been pushed in further from the stage illustrated in FIG. 6C, such that the punch has been fully pushed in with respect to the die.

Next, explanation follows regarding the manufacturing apparatus 500. FIG. 5 is an exploded perspective view illustrating the manufacturing apparatus 500 employed to manufacture a preliminary curving component 501 serving as a "preliminarily formed component". Note that configuration of the preliminary curving component 501 is substantially the same as the configuration of the preliminary curving component 10 (see FIG. 1A). FIG. 6A is a cross-section illustrating the manufacturing apparatus illustrated in FIG. 5 at the start of processing. FIG. 6B is a cross-section illustrating the manufacturing apparatus illustrated in FIG. 5 at a stage at which a metal stock sheet 601 is gripped and restrained between a preliminary forming die 502 and preliminary forming pad 503, and preliminary forming blank holders 505 and preliminary forming punch 504. FIG. 6C is a cross-section illustrating a stage at which the preliminary forming punch 504 has been pushed in from the stage illustrated in FIG. 6B. FIG. 6D is a cross-section illustrating a state in which the preliminary forming punch 504 has been pushed in further from the stage illustrated in FIG. 6C, such that the preliminary forming punch 504 has been fully pushed in with respect to the preliminary forming die 502.

As illustrated in FIG. 5, the manufacturing apparatus 500 is configured including the preliminary forming die 502 (referred to below as simply the "die 502") that has a shape corresponding to respective outer surface side profiles of vertical walls 501*a*, 501*b*, and flanges 501*d*, 501*e*, of the preliminary curving component 501, and the preliminary forming pad 503 (referred to below as simply the "pad 503") that has a shape corresponding to the outer surface side profile of a top plate 501*c*. The manufacturing apparatus 500 further includes the preliminary forming punch 504 (referred to below as simply the "punch 504") that is disposed facing the die 502 and the pad 503 and that has a shape corresponding to respective inner surface side profiles of the top plate 501*c* and the vertical walls 501*a*, 501*b* of the preliminary curving component 501, and the preliminary forming blank holders 505 (referred to below as simply the "blank holders 505"), serving as a "preliminary forming holder", with a shape corresponding to inner surface side profiles of the flanges 501*d*, 501*e*.

As illustrated in FIG. 6A to FIG. 6D, the die 502 and the punch 504 are disposed facing each other along the apparatus up-down direction, and the die 502 is disposed at the apparatus upper side of the punch 504. A central portion in the width direction (the left-right direction on the page) of the die 502 is formed with a recess 502*a* opening toward the apparatus lower side (the punch 504 side). Inner peripheral faces of the recess 502*a* of the die 502 configure forming faces corresponding to the profile of the outer surfaces of the vertical walls 501*a*, 501*b* (see FIG. 5) of the preliminary curving component 501. Moreover, end faces on the apparatus lower side (the blank holder 505 side) of both die 502 width direction side portions configure forming faces corresponding to the profile of upper faces (the faces on the vertical walls 501*a*, 501*b* (see FIG. 5) sides) of the flanges 501*d*, 501*e* of the preliminary curving component 501. A pad press unit 506, described later, is fixed to the closed off end (upper end) of the recess 502*a* formed in the die 502. Moreover, the die 502 is coupled to a mover device 509 such as a gas cushion, a hydraulic drive, a spring, or an electric drive mechanism. Actuating the mover device 509 moves the die 502 in the apparatus up-down direction.

The pad 503 is disposed inside the recess 502*a* formed to the die 502. The pad 503 is coupled to the pad press unit 506, this being a gas cushion, a hydraulic drive, a spring, an electric drive mechanism, or the like. A face on the punch 504 side of the pad 503 configures a forming face including the profile of the outer surface of the top plate 501*c* (see FIG. 5) of the preliminary curving component 501. When the pad press unit 506 is actuated, the pad 503 is pressed toward the punch 504 side, and a central portion 601*a* in the width direction (the left-right direction on the page) of the metal stock sheet 601 is pressed and gripped between the pad 503 and the punch 504.

The punch 504 is formed by a shape protruding toward the pad 503 side at a location in a lower mold that faces the pad 503 in the up-down direction. Blank holder press units 507, described later, are fixed at the sides of the punch 504. Outer faces of the punch 504 configure forming faces corresponding to the profile of the respective inner surfaces of the vertical walls 501*a*, 501*b* and of the top plate 501*c* (see FIG. 5) of the preliminary curving component 501.

The blank holders 505 are coupled to the blank holder press units 507, serving as holder press units, these being gas cushions, hydraulic drives, springs, electric drive mechanisms, or the like. Apparatus upper side (die 502 side) end faces of the blank holders 505 configure forming faces corresponding to the profile of lower faces (faces on the opposite side to the vertical walls 501*a*, 501*b* (see FIG. 5)) of the flanges 501*d*, 501*e* of the preliminary curving component 501. When the blank holder press units 507 are actuated, the blank holders 505 are pressed toward the die 502 side, and both width direction side portions 601*b*, 601*c* of the metal stock sheet 601 are pressed and gripped by the die 502 and the blank holders 505.

Next, explanation follows regarding the first process for pressing of the metal stock sheet 601 by the manufacturing apparatus 500 described above.

First, as illustrated in FIG. 6A, the metal stock sheet 601 is disposed between the die 502 and pad 503, and the punch 504 and the blank holders 505.

Next, as illustrated in FIG. 6B, the central portion 601*a* of the metal stock sheet 601 (namely, a portion of the metal stock sheet 601 that will form the top plate 501*c* (see FIG. 5)) is pressed against the punch 504 by the pad 503, and pressed and gripped therebetween. Both side portions 601*b*, 601*c* of the metal stock sheet 601 (namely, respective portions of the metal stock sheet 601 that will form the vertical walls 501*a*, 501*b* and the flanges 501*d*, 501*e* (see FIG. 5)) are pressed against the die 502 by the blank holders 505, and are pressed and gripped therebetween.

The pad press unit 506 and the blank holder press units 507 are actuated, such that the central portion 601*a* and both side portions 601*b*, 601*c* of the metal stock sheet 601 are pressed and gripped with a predetermined pressing force. The central portion 601*a* and both side portions 601*b*, 601*c* of the metal stock sheet 601 are formed into curved profiles to follow the curved profiles of the pressing curved faces as a result.

The mover device 509 is actuated in this state, and the blank holders 505 and the die 502 are moved toward the apparatus lower side (lowered), thereby forming the preliminary curving component 501. The pad press unit 506 and the blank holder press units 507 retract in the up-down direction accompanying lowering of the die 502. The central portion 601*a* and both side portions 601*b*, 601*c* of the metal stock sheet 601 are also pressed with a predetermined pressing force when the pad press unit 506 and the blank holder press units 507 are retracting in the up-down direction.

As illustrated in FIG. 6C, the metal stock sheet 601 gripped between the die 502 and the blank holders 505 flows into the recess 502*a* present between the punch 504 and the blank holders 505 accompanying the movement of the blank holders 505 and the die 502 toward the apparatus lower side, thereby forming the vertical walls 501*a*, 501*b* (see FIG. 5).

Then, as illustrated in FIG. 6D, the blank holders 505 and the die 502 move by a predetermined distance, and forming is completed at the point when the height of the vertical walls 501*a*, 501*b* reaches a predetermined height.

Note that in the example illustrated in FIG. 6A to FIG. 6D, the preliminary curving component 501 is formed by moving the blank holders 505 and the die 502 toward the apparatus lower side, in a stationary state of the punch 504 and the pad 503. However, the present invention is not limited thereto, and the preliminary curving component 501 may be formed in the following manner.

Figure 7:
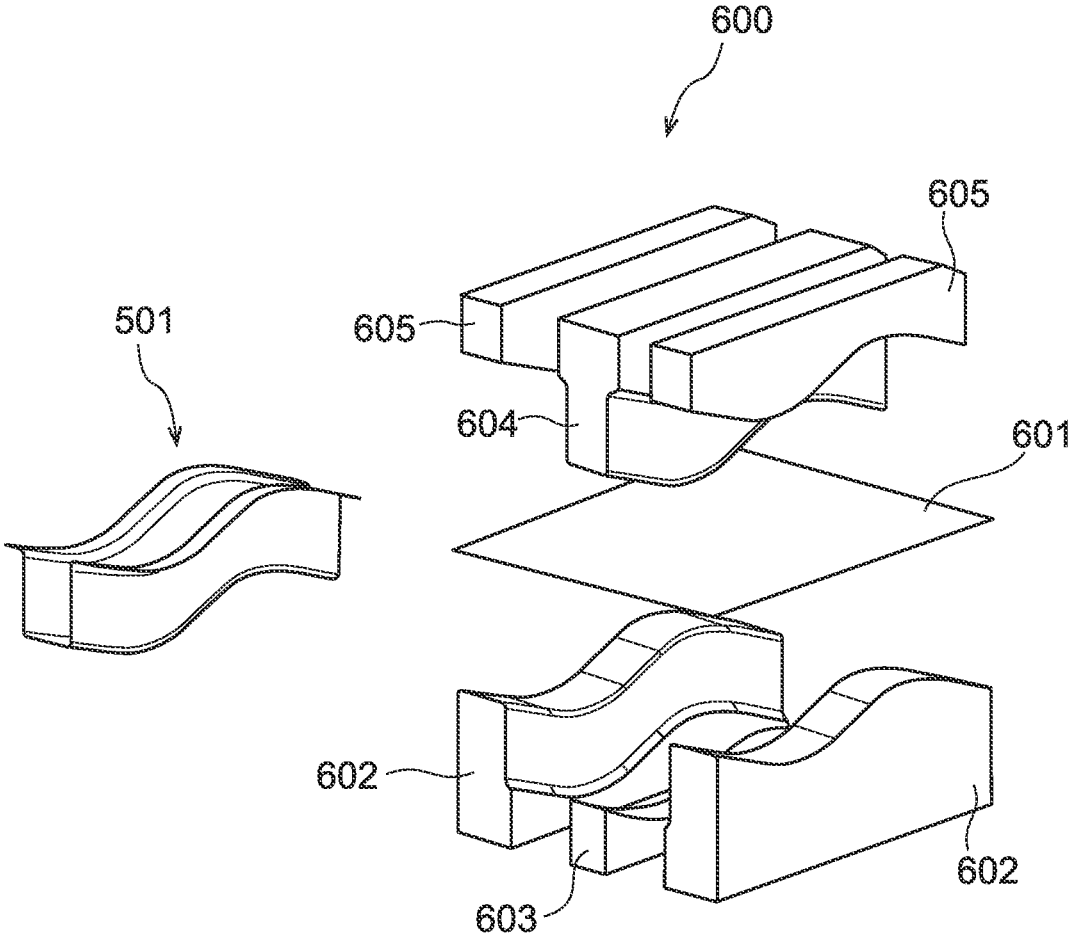
FIG. 7 is an exploded perspective view illustrating another manufacturing apparatus employed in the first process.
Figure 8A:
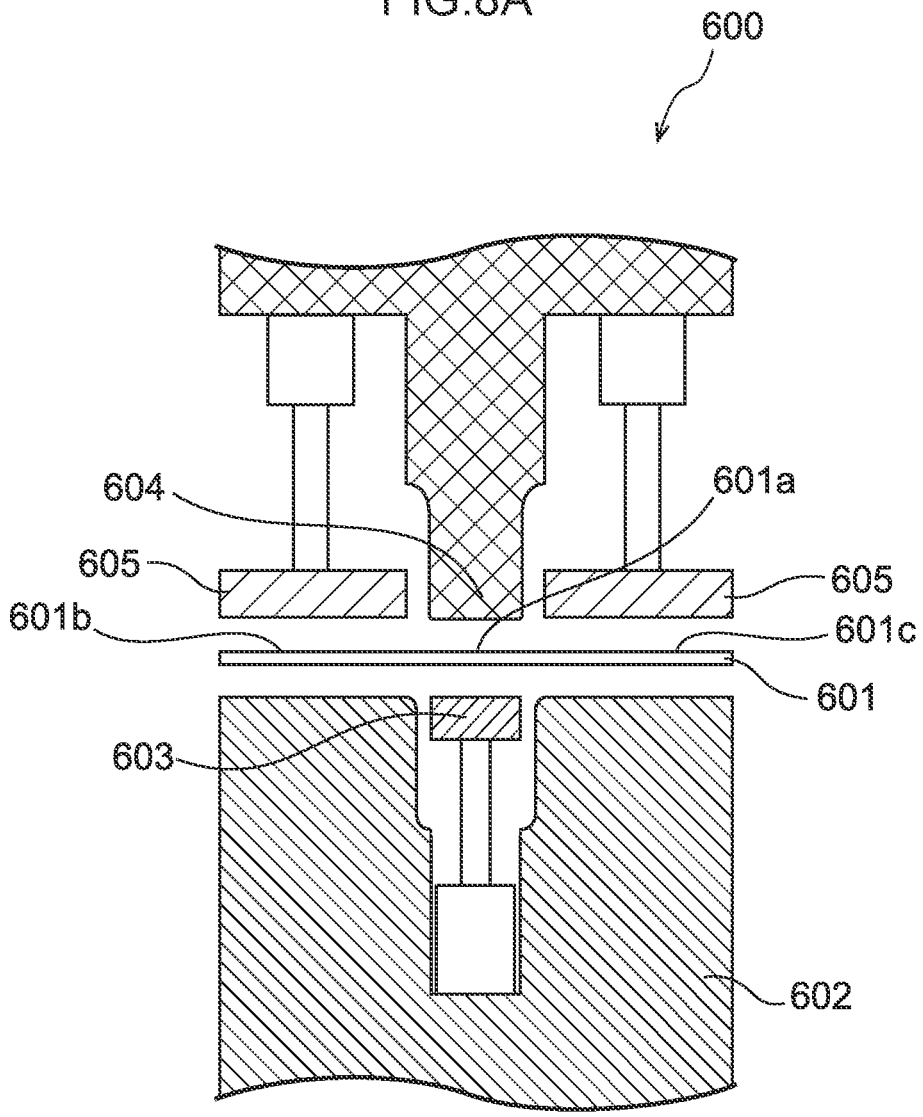
FIG. 8A is a cross-section illustrating the manufacturing apparatus illustrated in FIG. 7, at a stage at the start of processing.
Figure 8B:
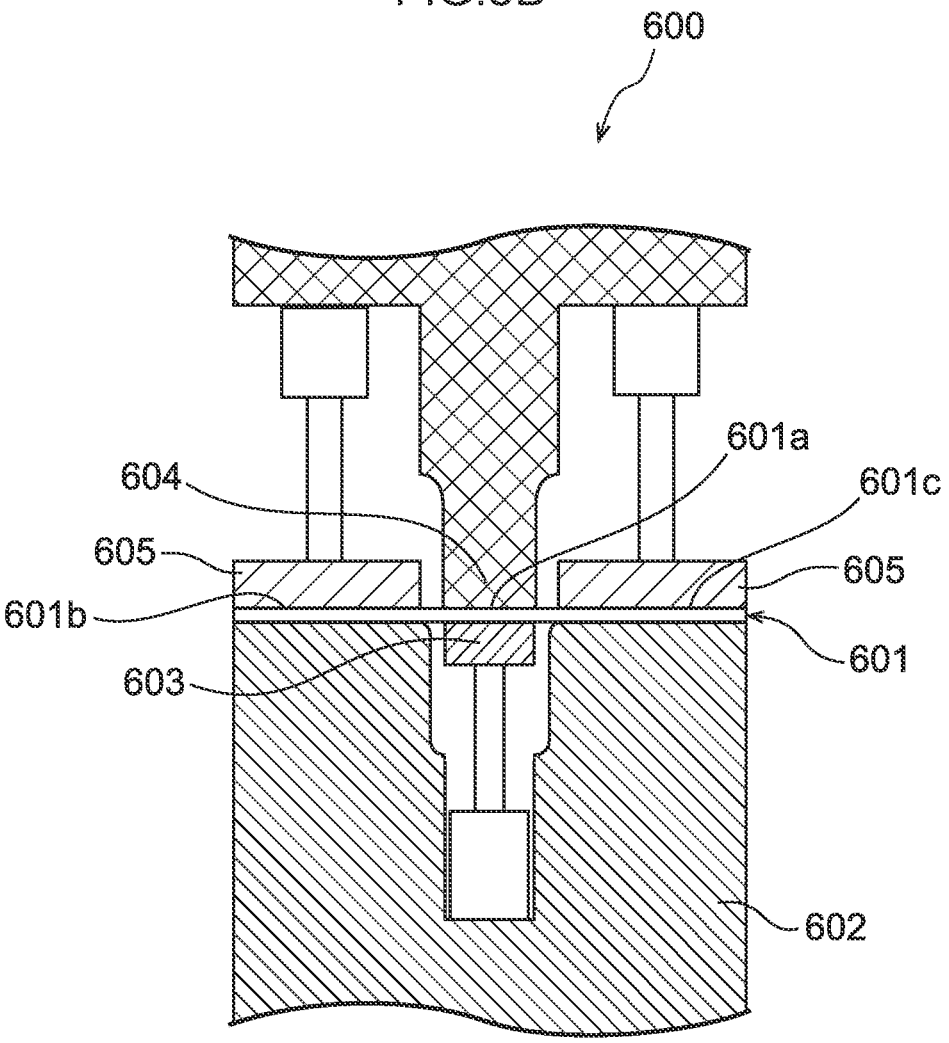
FIG. 8B is a cross-section illustrating a stage at which the metal stock sheet is gripped and restrained between a die and pad, and a holder and punch of the manufacturing apparatus illustrated in FIG. 7.
Figure 8C:
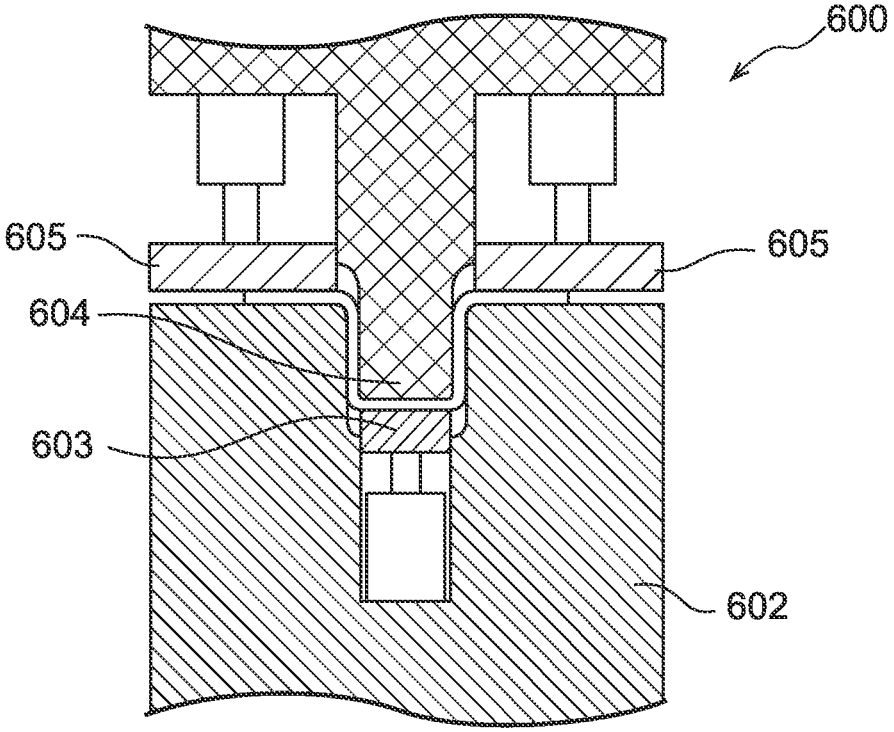
FIG. 8C is a cross-section illustrating a stage at which the punch has been pushed in from the stage illustrated in FIG. 8B.
Figure 8D:
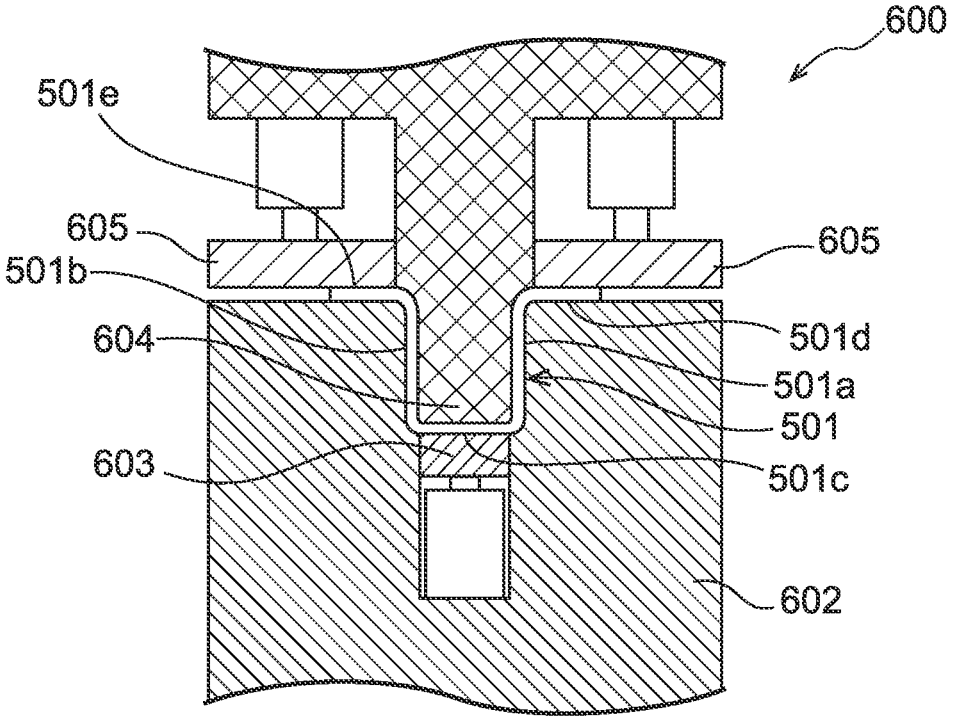
FIG. 8D is a cross-section illustrating a state in which the punch has been pushed in further from the stage illustrated in FIG. 8C, such that the punch has been fully pushed in with respect to the die.

FIG. 7 illustrates another manufacturing apparatus 600 for manufacturing the preliminary curving component 501. FIG. 8A is a cross-section illustrating the manufacturing apparatus illustrated in FIG. 7 at a stage at the start of processing. FIG. 8B is a cross-section illustrating a stage at which the metal stock sheet 601 is gripped and restrained between a preliminary forming die 602 (referred to below as simply "die 602") and a preliminary forming pad 603 (referred to below as simply "pad 603"), and preliminary forming blank holders 605 (referred to below as simply "blank holders 605") and preliminary forming punch 604 (referred to below as simply "punch 604") of the manufacturing apparatus illustrated in FIG. 7. FIG. 8C is a cross-section illustrating a stage at which the punch 604 has been pushed in from the stage illustrated in FIG. 8B. FIG. 8D is a cross-section illustrating a state in which the punch 604 has been pushed in further from the stage illustrated in FIG. 8C, such that the punch 604 has been fully pushed in with respect to the die 602.

In contrast to the hat-shaped cross-section component manufacturing apparatus 500 illustrated in FIG. 5 and FIG. 6A to FIG. 6D, in the manufacturing apparatus 600, the blank holders 605 and the punch 604 are provided at the apparatus upper side of the die 602 and the pad 603. In the manufacturing apparatus 600, the preliminary curving component 501 is formed by moving (lowering) the pad 603 and the punch 604 in a state in which the die 602 is fixed, and the blank holders 605 press the metal stock sheet 601 against the die 602 without moving. Note that in both the manufacturing apparatus 600 and the manufacturing apparatus 500, the relative movement within the mold is the same, and the metal stock sheet 601 can be formed into the preliminary curving component 501 by using whichever of the manufacturing apparatuses 500, 600.

Next, explanation follows regarding a removal process of the preliminary curving component 501 from the manufacturing apparatus 500 (mold) after pressing the metal stock sheet 601, namely, after forming the preliminary curving component 501.

Figure 9A:
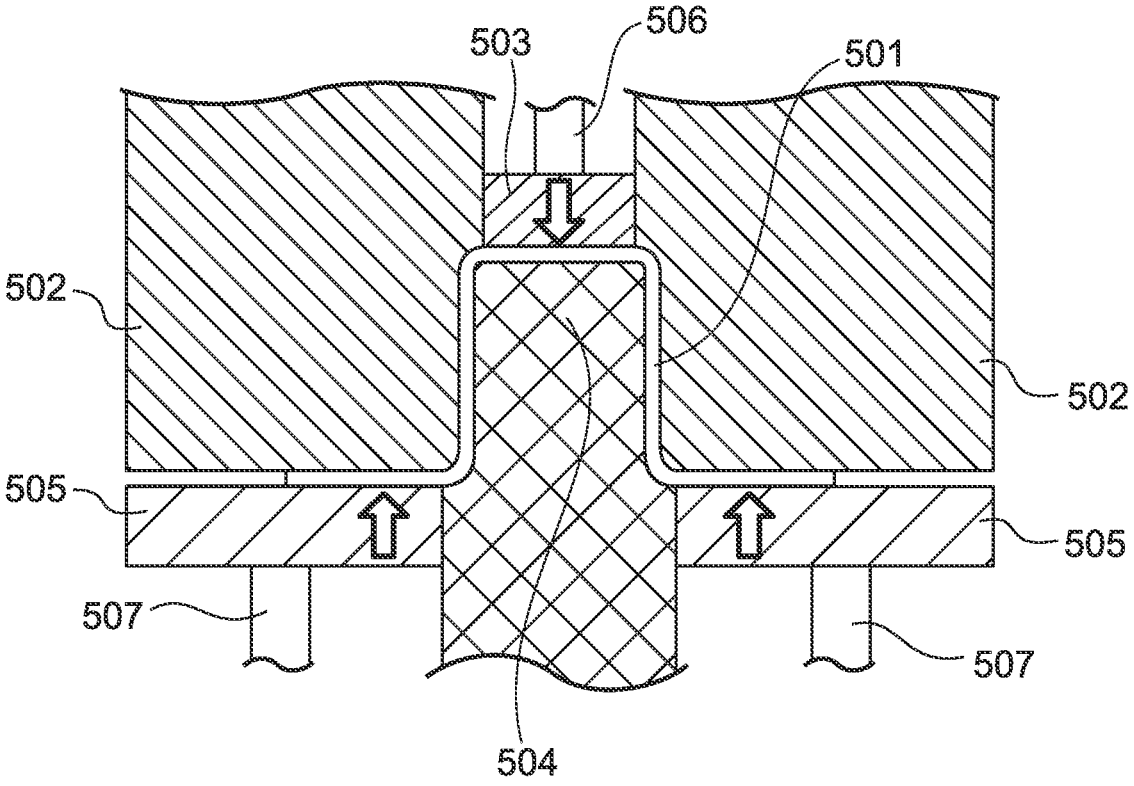
FIG. 9A is a cross-section illustrating a mold to explain a defect that occurs when removing a preliminary curving component from the mold after a punch has been fully pushed into a die and a metal stock sheet has been formed into a preliminary curving component.
Figure 9E:
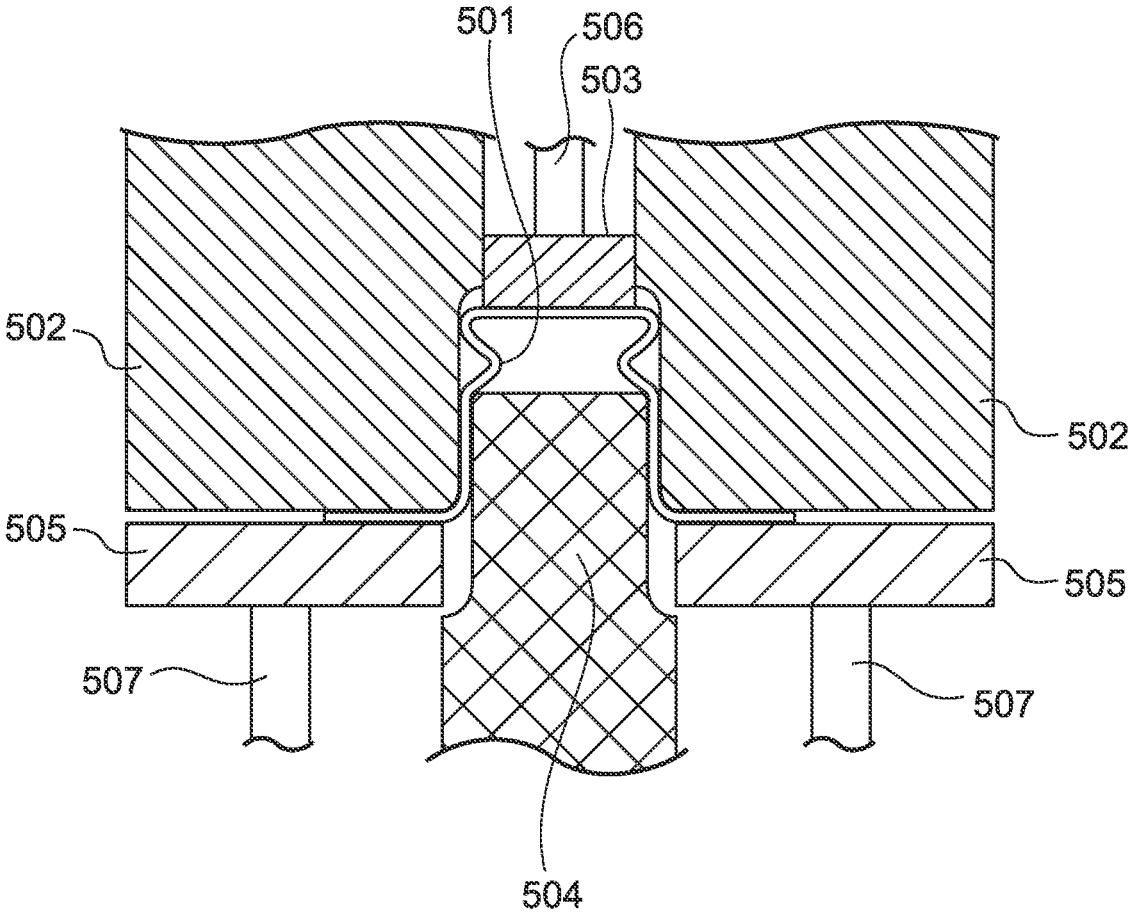
FIG. 9B is a cross-section illustrating the mold at a stage in which the punch is being retracted from the die from the state illustrated in FIG. 9A.
FIG. 9C is a cross-section illustrating the mold at a stage in which the punch has been fully retracted from the die from the state illustrated in FIG. 9B.
Figure 9C:
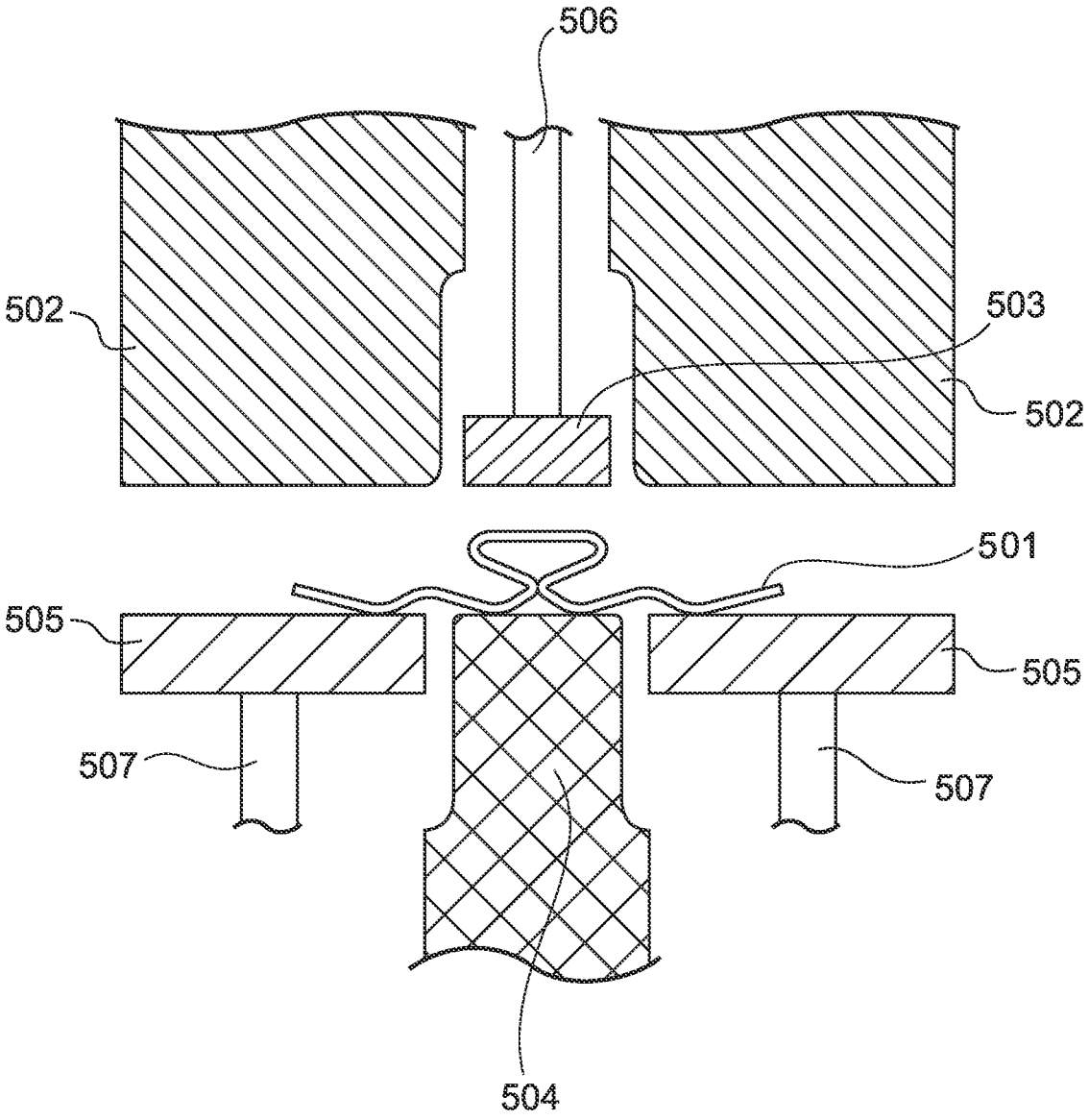

As illustrated in FIG. 9A to FIG. 9C, when demolding the preliminary curving component 501 from the manufacturing apparatus 500 (mold), the die 502 might be moved toward the apparatus upper side from the state in FIG. 6D and away from the punch 504 to create a gap within the mold. When this is performed, as illustrated in FIG. 9B and FIG. 9C, while the pad 503 and the blank holders 505 were being respectively pressed by the pad press unit 506 and the blank holder press units 507, during demolding the preliminary curving component 501 would directly bear pressing force in mutually opposing directions from the pad 503 and the blank holders 505, resulting in the preliminary curving component 501 being deformed and crushed by the pressing forces directed in opposite directions, as illustrated in FIG. 9C.

Figure 10A:
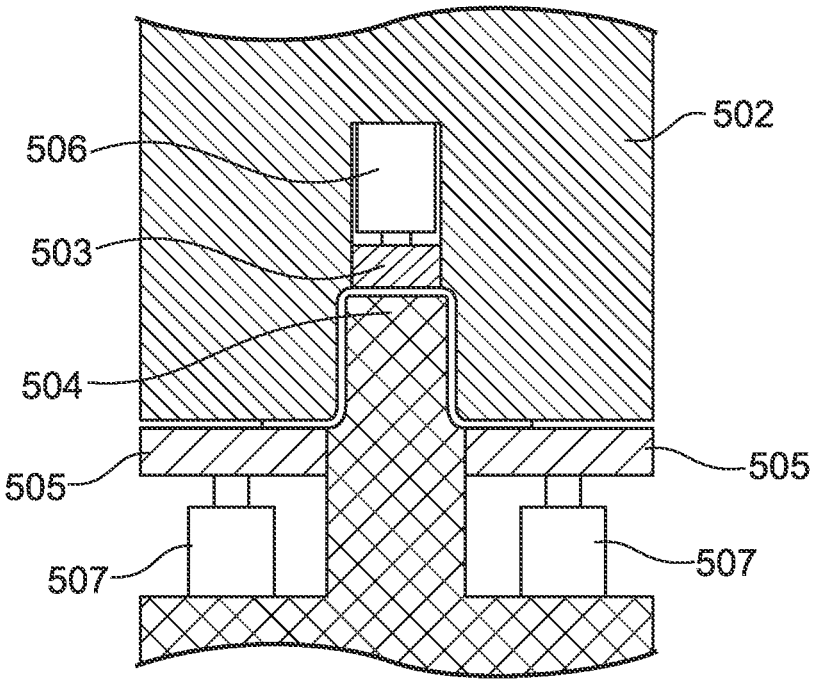
FIG. 10A is a cross-section illustrating a mold, in a state in which a punch has been fully pushed into a die.
Figure 10B:
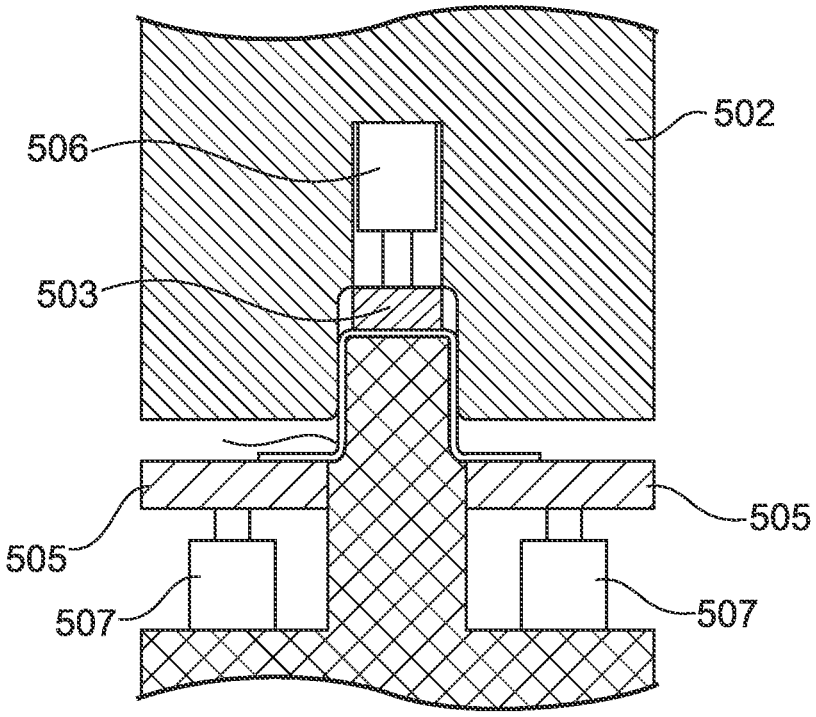
FIG. 10B is a cross-section illustrating the mold at a stage in which the punch is being retracted from the die from the state illustrated in FIG. 10A.
Figure 10C:
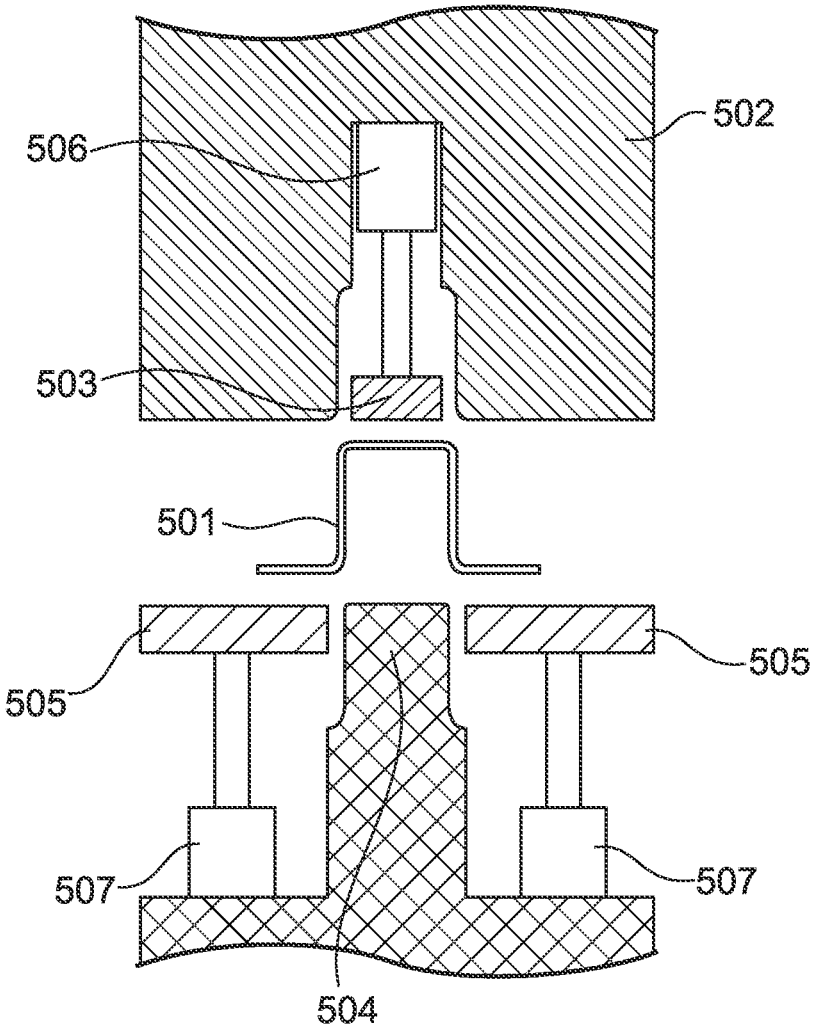
FIG. 10C is a cross-section illustrating the mold at a stage in which the punch has been fully retracted from the die from the state illustrated in FIG. 10B.

Accordingly, as illustrated in FIG. 10A to FIG. 10C, after the metal stock sheet 601 has been formed into the preliminary curving component 501, configuration is made such that the die 502 and the pad press unit 506 are separated from the blank holders 505 in a state in which the blank holders 505 do not move relative to the punch 504, and the blank holders 505 do not press the formed curving component against the die 502. Accordingly, although the pad 503 presses the curving component until the pad press unit 506 has extended to the end of its stroke, the pad 503 separates from the punch 504 after the pad press unit 506 has moved a specific distance or greater and the pad press unit 506 has fully extended to the end of its stroke. The preliminary curving component 501 therefore does not bear pressing at the same time from the pad 503 and the blank holders 505, and the die 502 and the pad 503 can be separated from the blank holders 505 and the punch 504, thereby enabling the preliminary curving component 501 to be removed from the mold without being deformed.

Figure 11A:
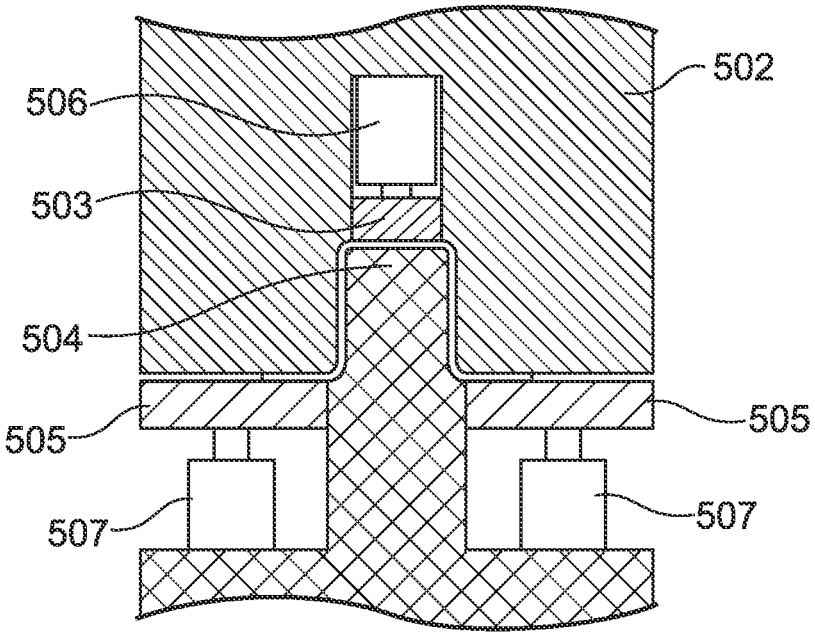
FIG. 11A is a cross-section illustrating a mold, in a state in which a punch has been fully pushed into a die.
Figure 11B:
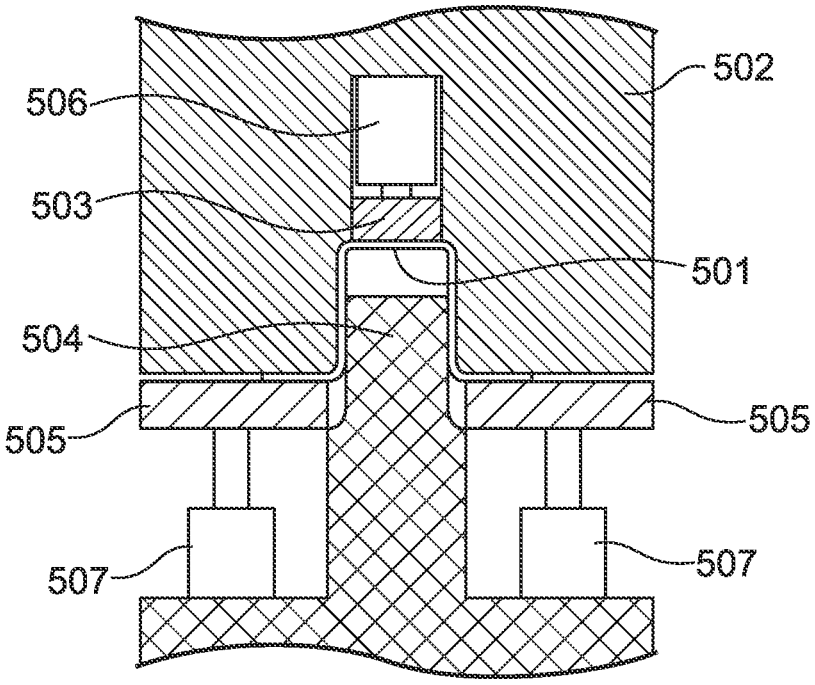
FIG. 11B is a cross-section illustrating the mold at a stage in which the punch is being retracted from the die from the state illustrated in FIG. 11A.
Figure 11C:
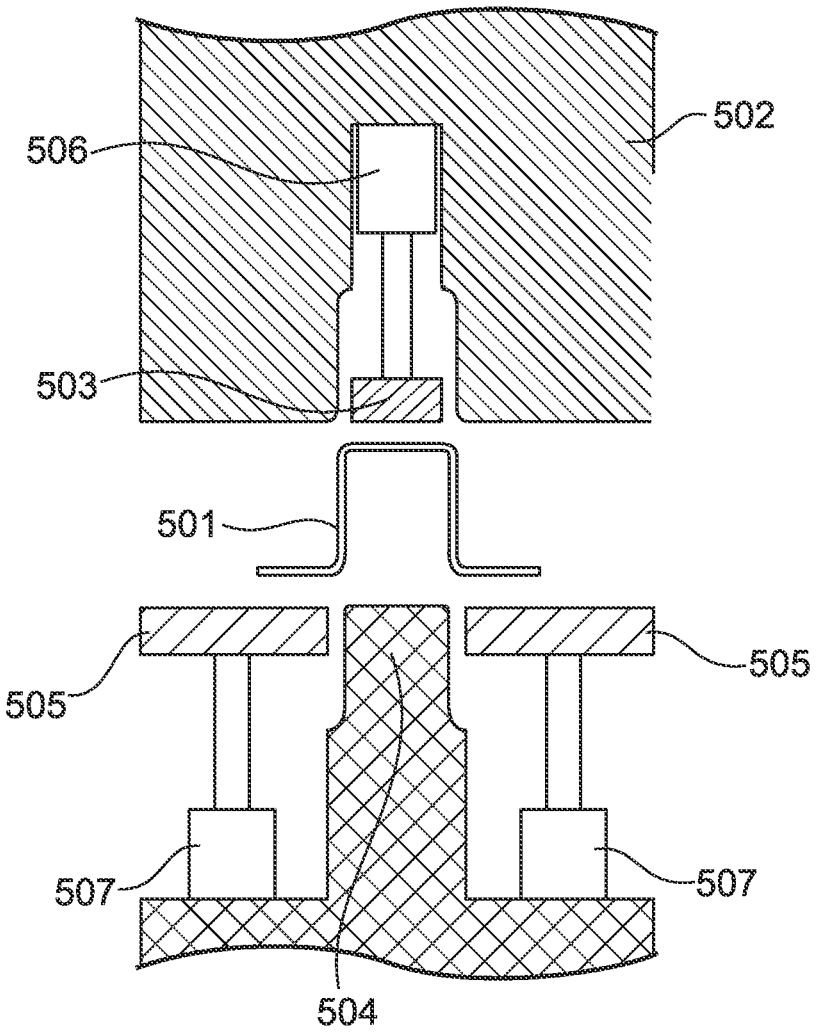
FIG. 11C is a cross-section illustrating the mold at a stage in which the punch has been fully retracted from the die from the state illustrated in FIG. 11B.

As another exemplary embodiment, as illustrated in FIG. 11A to FIG. 11C, after forming the metal stock sheet into the preliminary curving component 501, the pad 503 is not moved relative to the die 502, and the pad 503 does not press the formed preliminary curving component 501 against the punch 504. When the pad 503 and the die 502 are separated from the blank holders 505 and the punch 504 in this state, the blank holders 505 press the curving component until the blank holder press units 507 extend to the end of their stroke. The blank holders 505 then separate from the die 502 after the die 502 has moved a specific distance or greater and the blank holder press units 507 have fully extended to the end of their stroke. This thereby enables the die 502 and pad 503, and the blank holders 505 and punch 504, to be separated without the preliminary curving component 501 bearing pressure at the same time from the pad 503 and the blank holders 505, thereby enabling the preliminary curving component 501 to be removed from the mold.

Yet another exemplary embodiment is one in which, although not illustrated in the drawings, after forming the metal stock sheet into the preliminary curving component 501, the pad 503 does not move relative to the blank holders 505, and the pad 503 does not press the formed curving component against the punch 504. When the pad 503, die 502, and blank holders 505 are separated from the punch 504 in this state, the blank holders 505 press the preliminary curving component 501 until the blank holder press units 507 have extended to the end of their strokes. The blank holders 505 are then separated from the die 502 after the die 502 moves a specific distance or greater and the blank holder press units 507 have fully extended to the end of their stroke. This thereby enables the die 502 and pad 503 to be separated, from the blank holders 505 and punch 504, without the preliminary curving component 501 bearing pressure at the same time from the pad 503 and the blank holders 505, thereby enabling the preliminary curving component 501 to be removed from the mold.

Accordingly, in order to prevent damage to the preliminary curving component 501 during demolding, the manufacturing apparatus 500 may be provided with a pressure limiter capable of preventing the preliminary curving component 501 from bearing pressure from the pad 503 and the blank holders 505 at the same time.

The preliminary curving component 501 serving as a preliminarily formed component is formed in the above manner in the first process. However, settings (the shape and the like) of the die 502, the pad 503, the punch 504, and the blank holders 505 of the manufacturing apparatus 500 may be changed as appropriate to change the shape of the preliminary curving component. Explanation follows regarding modified examples of the preliminary curving component.

Preliminary Curving Component: Modified Example 1

A preliminary curving component 100 illustrated in FIG. 12A to FIG. 12D, serving as a preliminarily formed component, is curved in a substantially S-shape in plan view, but is not curved as viewed from the side. The preliminary curving component 100 is configured including a top plate 102, vertical walls 104, 106 provided extending parallel to each other following ridge lines 102*a*, 102*b* of the top plate 102, and flanges 108*a*, 108*b* formed at leading ends of the vertical walls 104, 106.

Figure 12A:
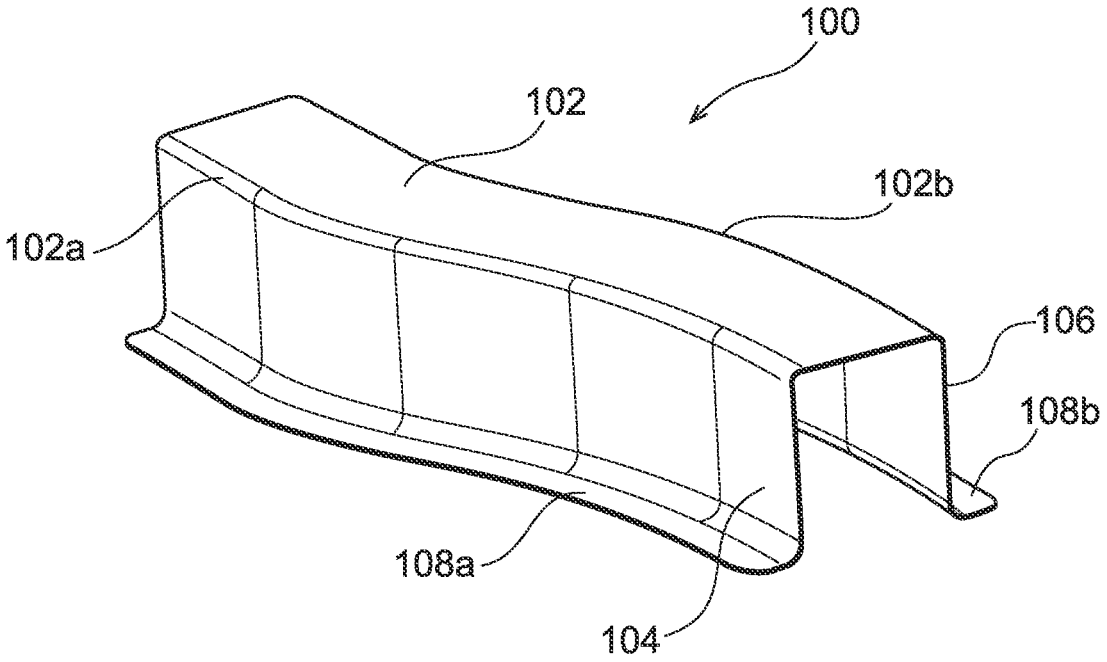
FIG. 12A is a perspective view illustrating another preliminary curving component formed by the first process.
Figure 12B:
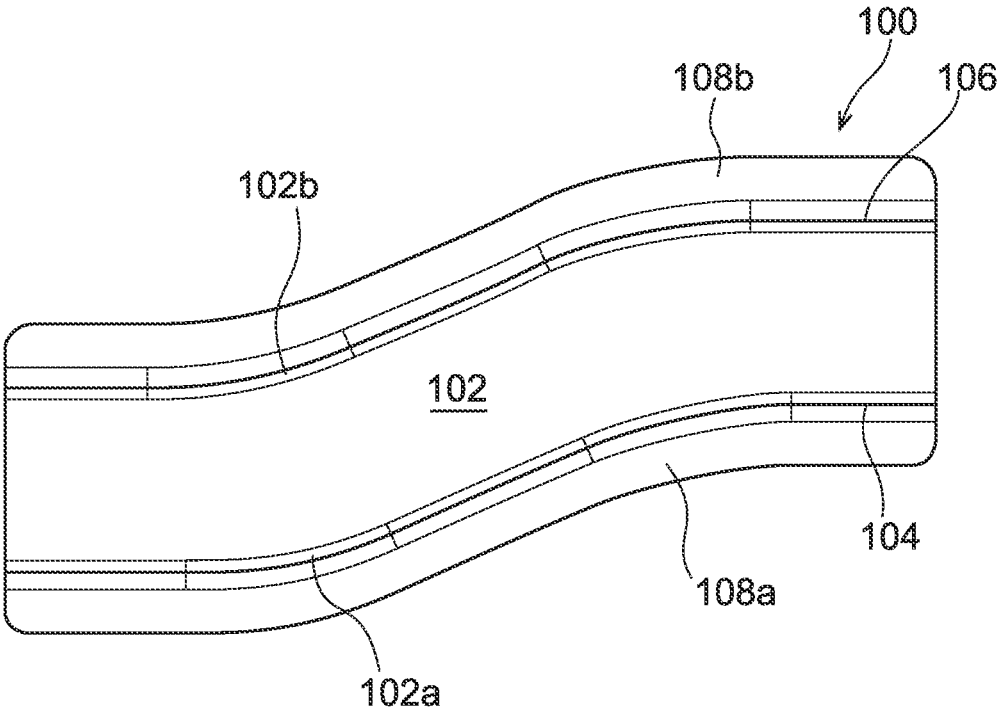
FIG. 12B is a plan view illustrating the preliminary curving component illustrated in FIG. 12A from above.
Figure 12C:
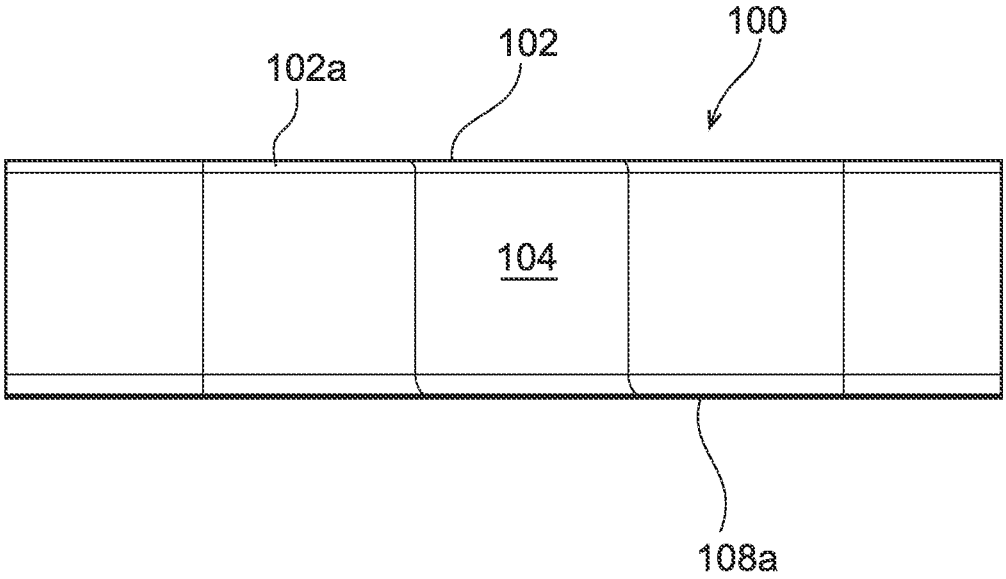
FIG. 12C is a side view illustrating the preliminary curving component illustrated in FIG. 12A from one width direction side.
Figure 12D:
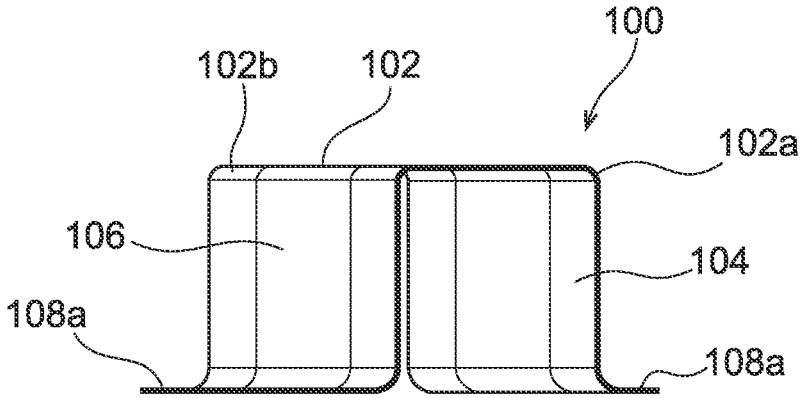
FIG. 12D is a front view illustrating the preliminary curving component illustrated in FIG. 12A from one length direction side.
Figure 13A:
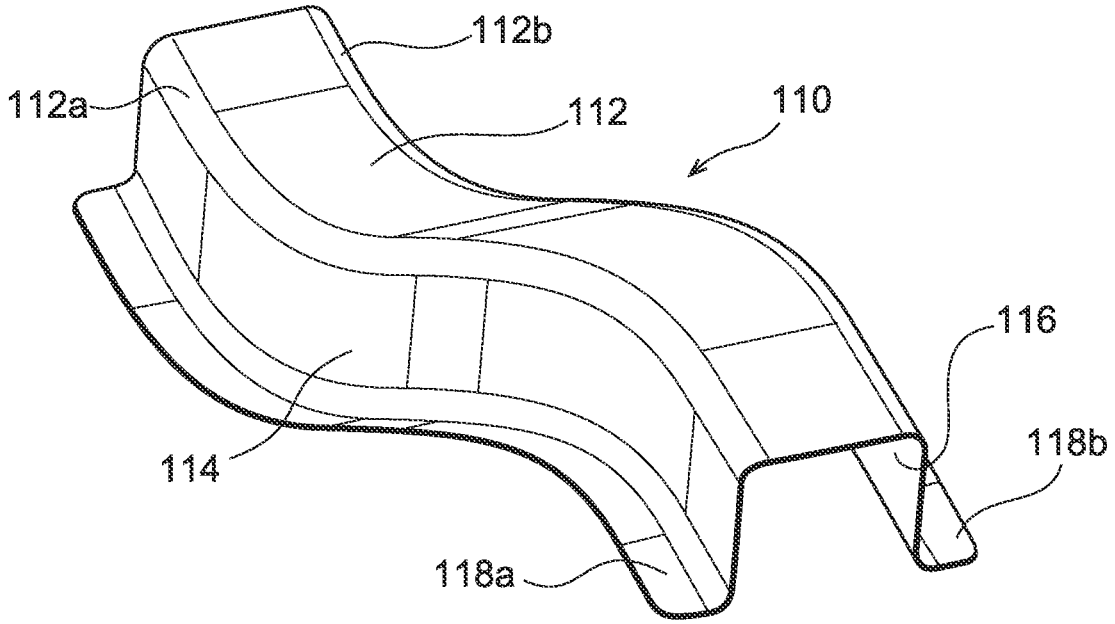
FIG. 13A is a perspective view illustrating another preliminary curving component formed by the first process.
Figure 13B:
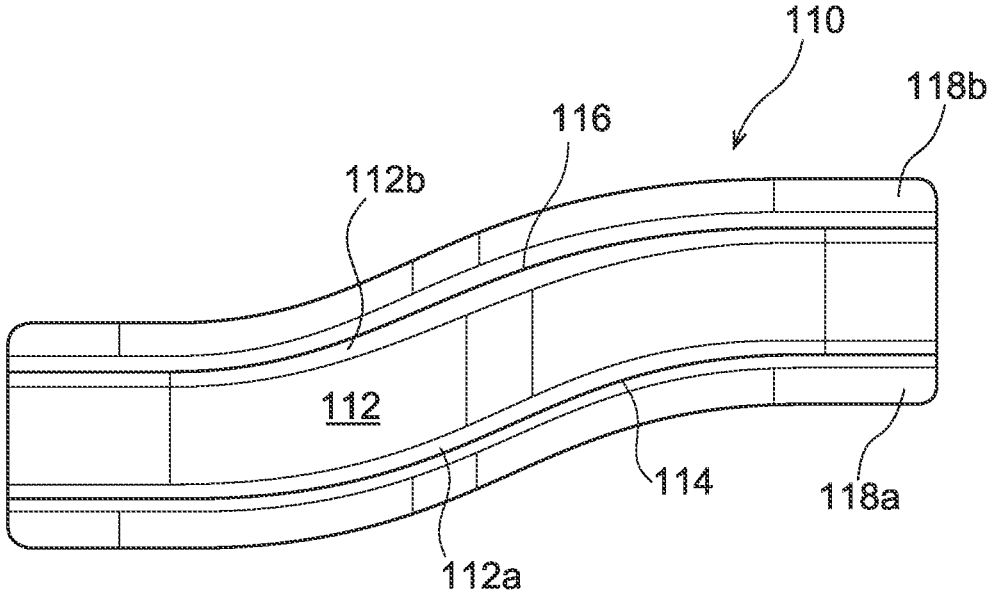
FIG. 13B is a plan view illustrating the preliminary curving component illustrated in FIG. 13A from above.
Figure 13C:
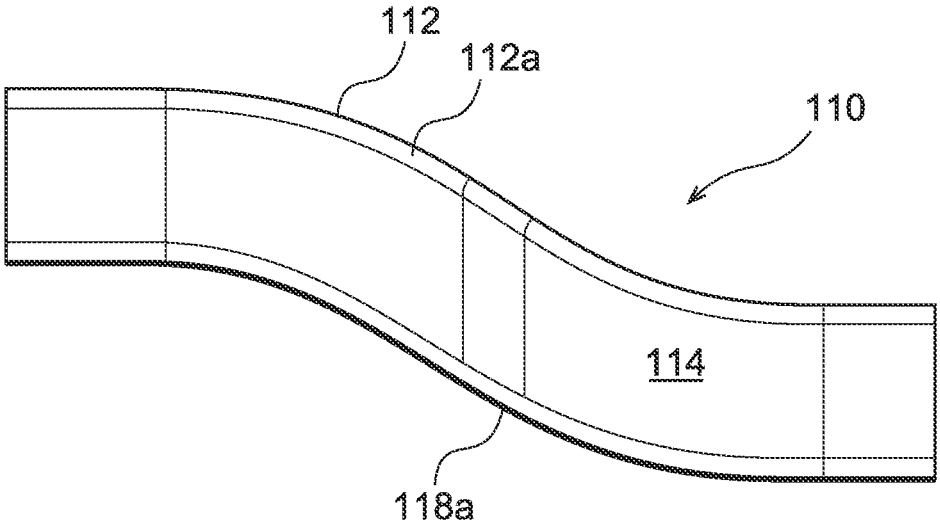
FIG. 13C is a side view illustrating the preliminary curving component illustrated in FIG. 13A from one width direction side.
Figure 13D:
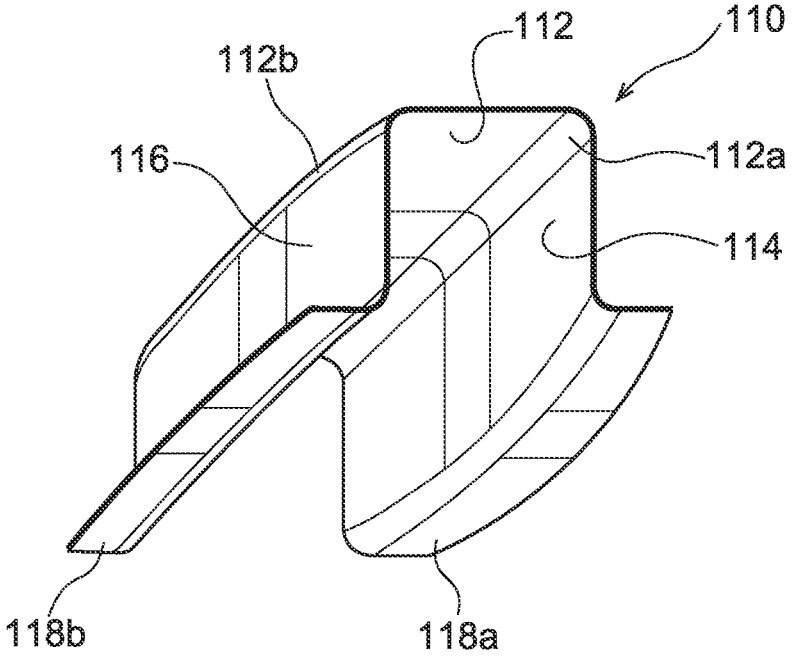
FIG. 13D is a perspective view illustrating the preliminary curving component illustrated in FIG. 13A from a bottom face side.
Figure 14A:
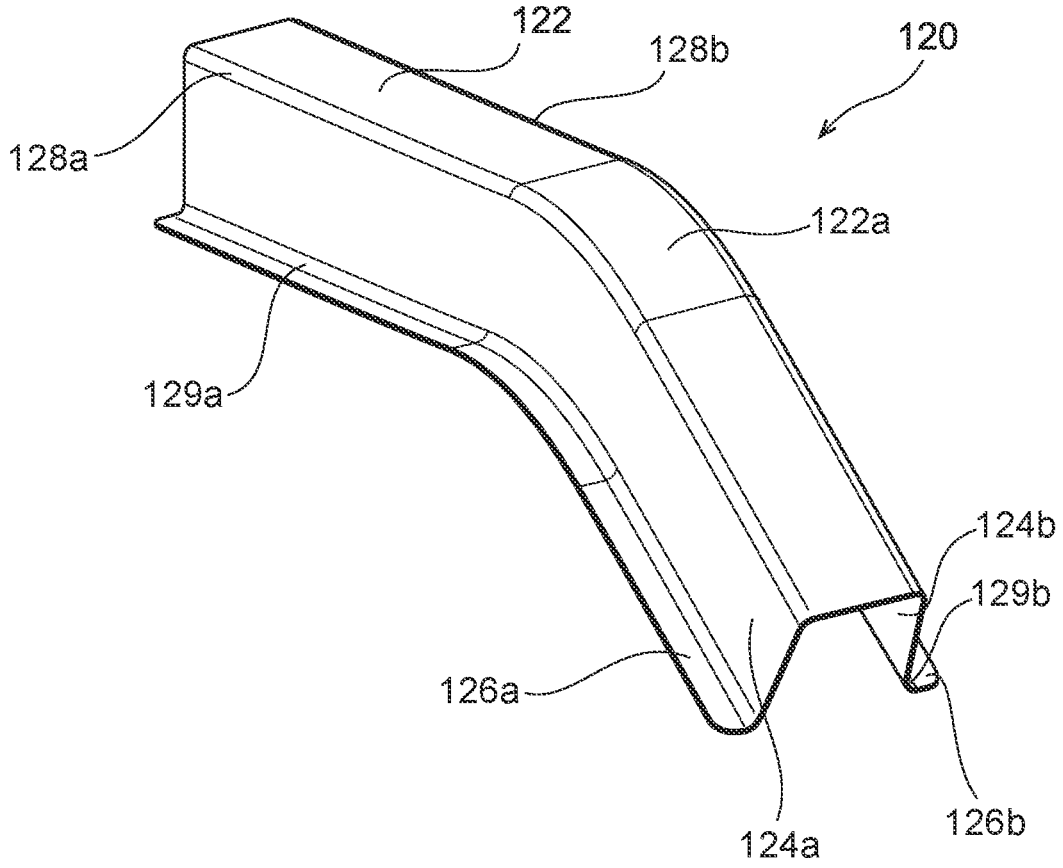
FIG. 14A is a perspective view illustrating another preliminary curving component formed by the first process.
Figure 14B:
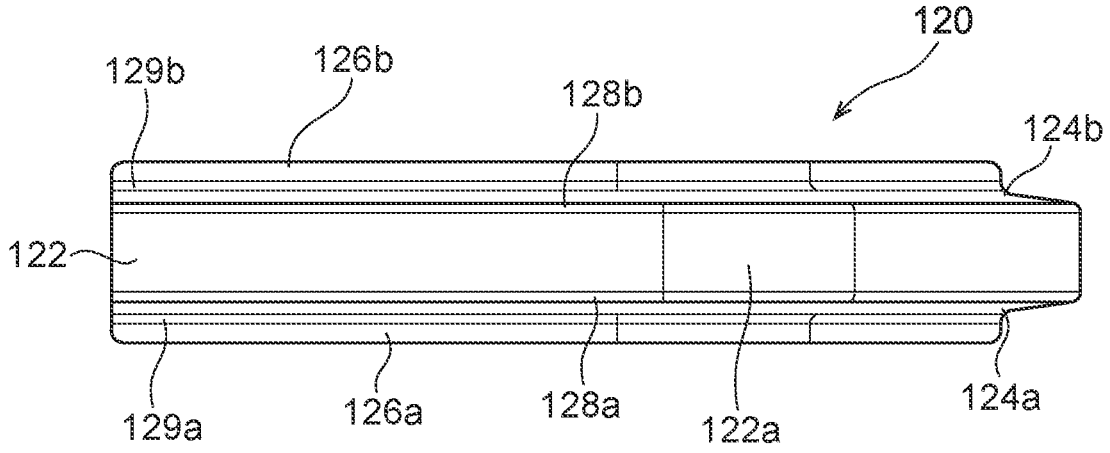
FIG. 14B is a plan view illustrating the preliminary curving component illustrated in FIG. 14A from above.
Figure 14C:
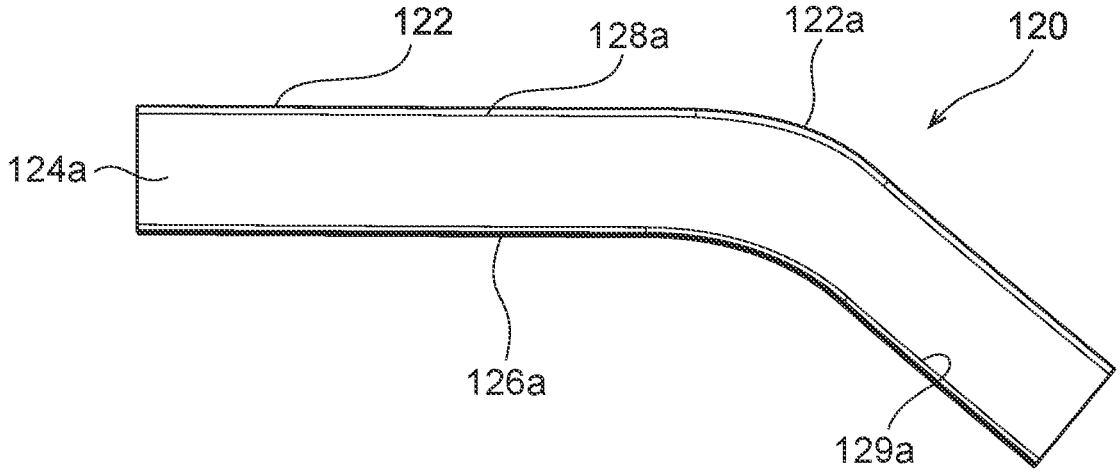
FIG. 14C is a side view illustrating the preliminary curving component illustrated in FIG. 14A from one width direction side.
Figure 14D:
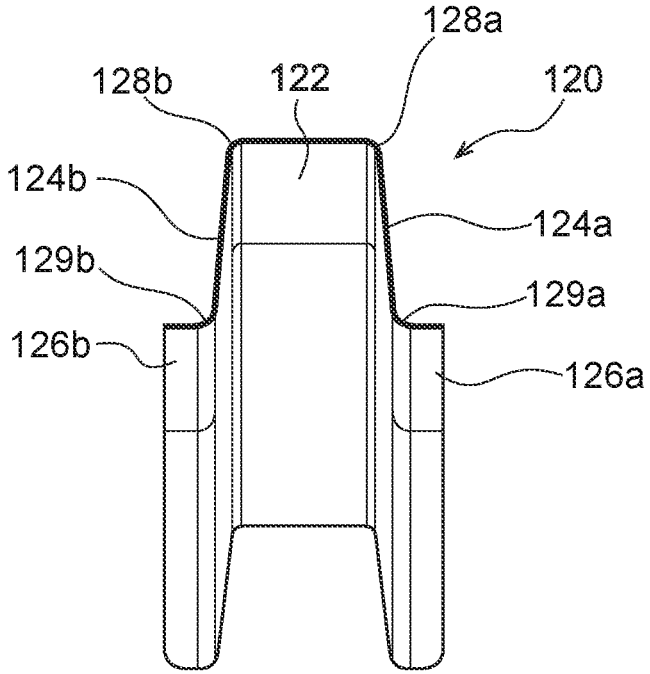
FIG. 14D is a front view illustrating the preliminary curving component illustrated in FIG. 14A from the other length direction side.
Figure 15A:
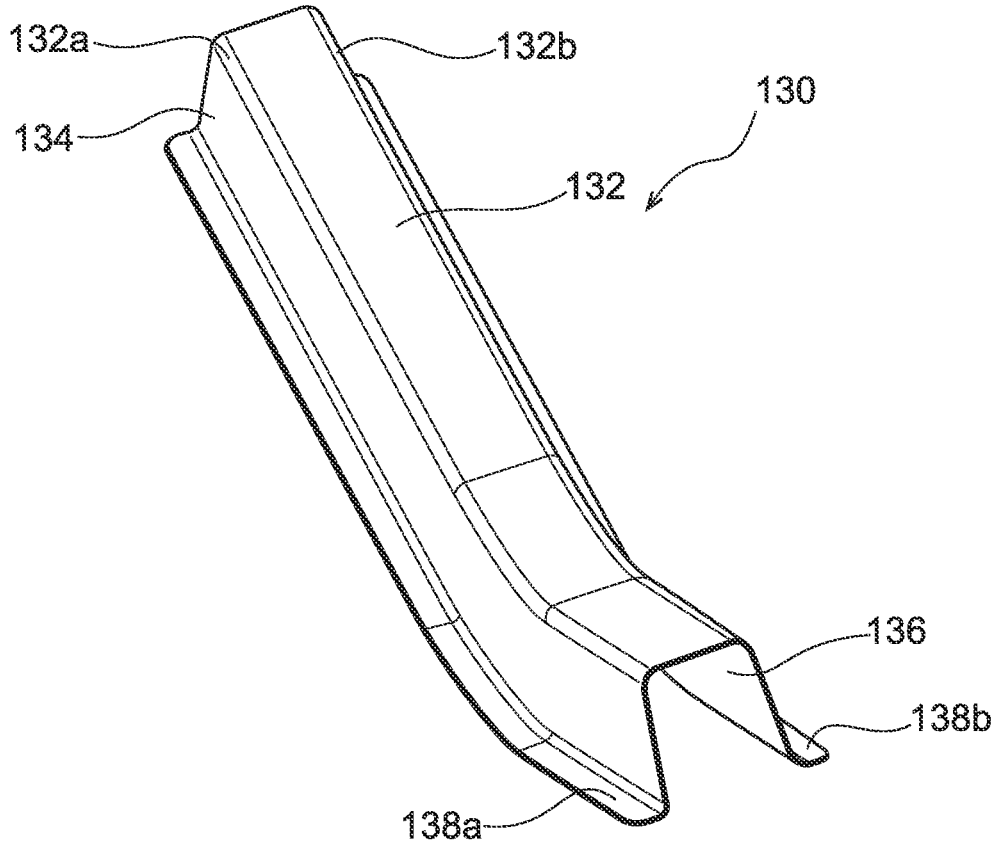
FIG. 15A is a perspective view illustrating another preliminary curving component formed by the first process.
Figure 15B:
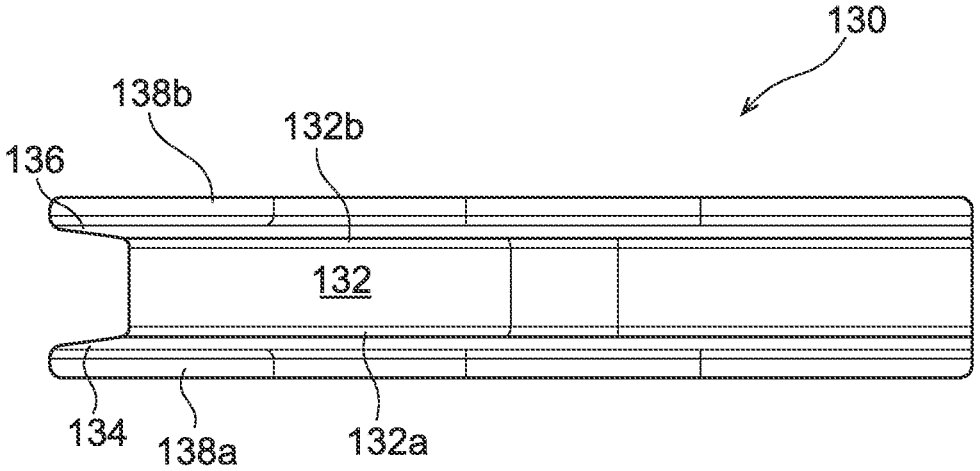
FIG. 15B is a plan view illustrating the preliminary curving component illustrated in FIG. 15A from above.
Figure 15C:
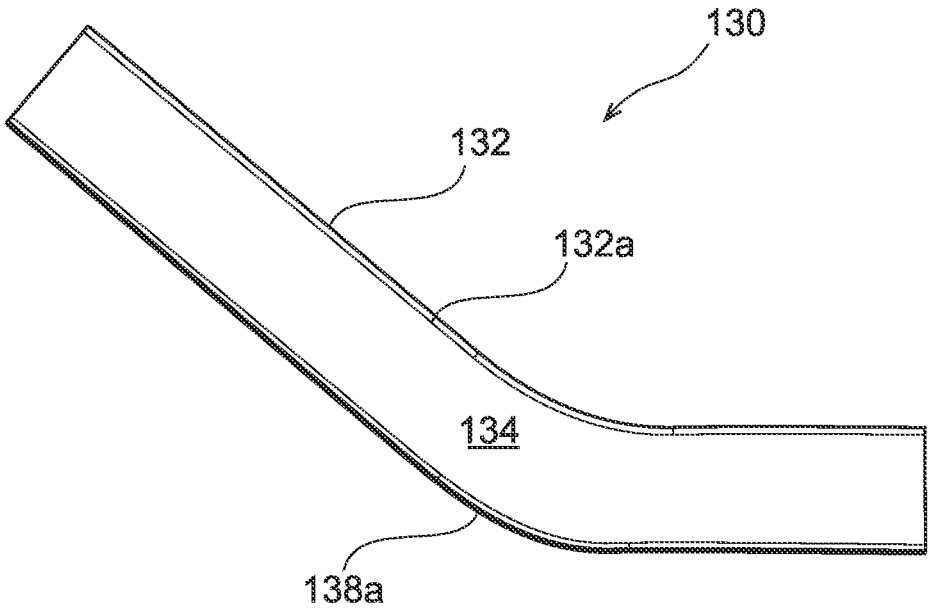
FIG. 15C is a side view illustrating the preliminary curving component illustrated in FIG. 15A from one width direction side.
Figure 15D:
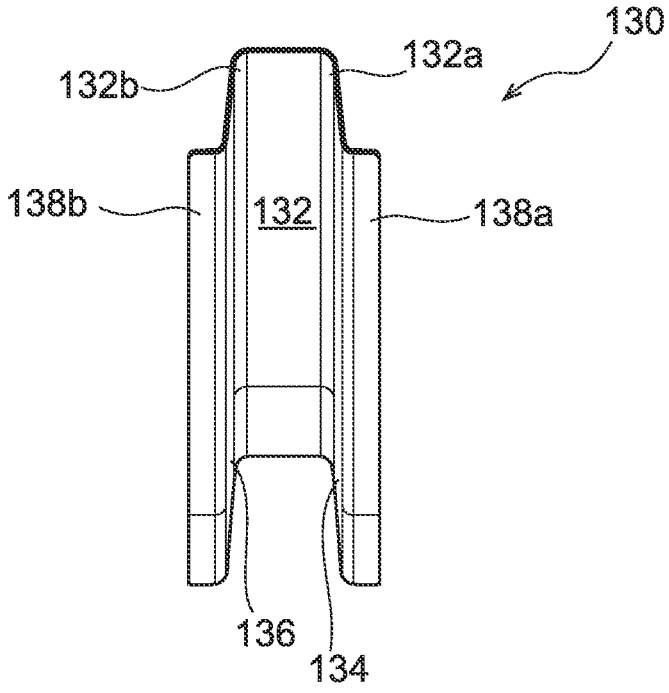
FIG. 15D is a front view illustrating the preliminary curving component illustrated in FIG. 15A from the other length direction side.
Figure 16A:
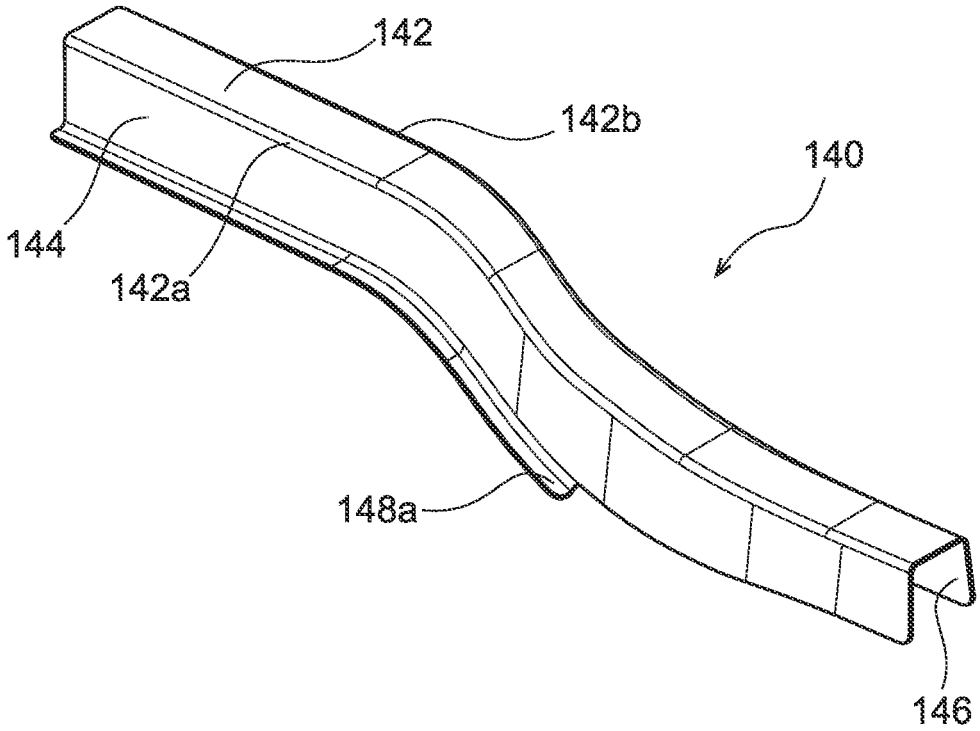
FIG. 16A is a perspective view illustrating another preliminary curving component formed by the first process.
Figure 16B:
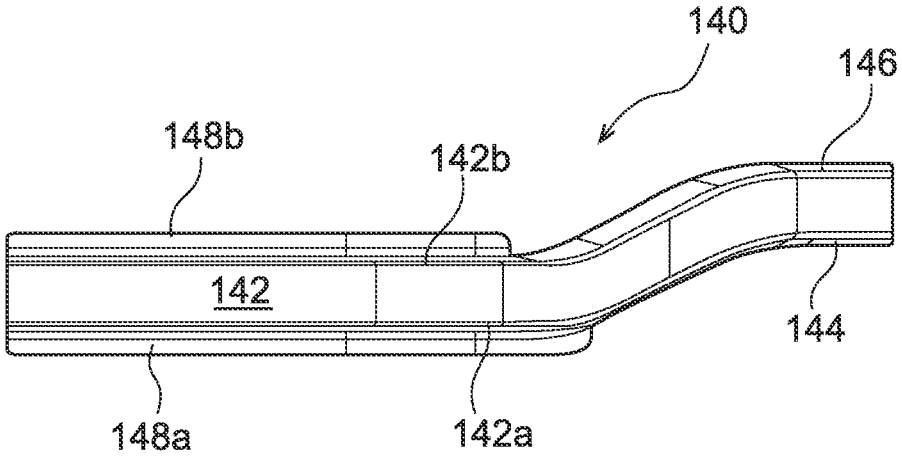
FIG. 16B is a plan view illustrating the preliminary curving component illustrated in FIG. 16A from above.
Figure 16C:
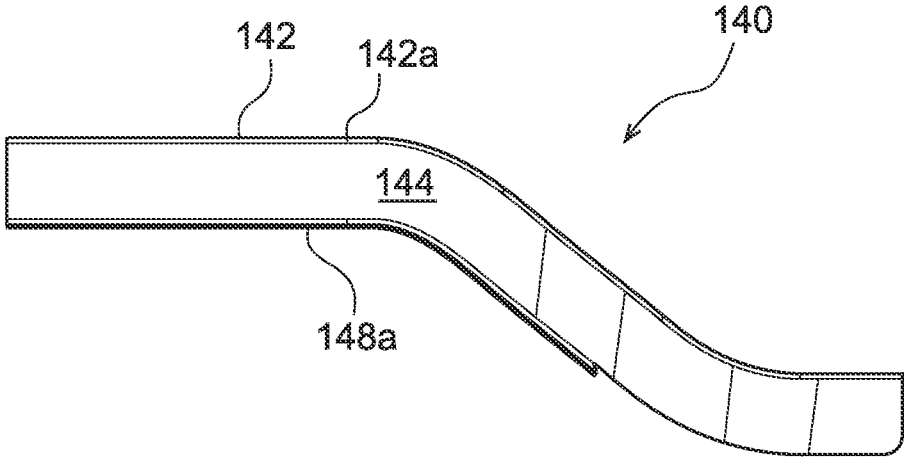
FIG. 16C is a side view illustrating the preliminary curving component illustrated in FIG. 16A from one width direction side.
Figure 16D:
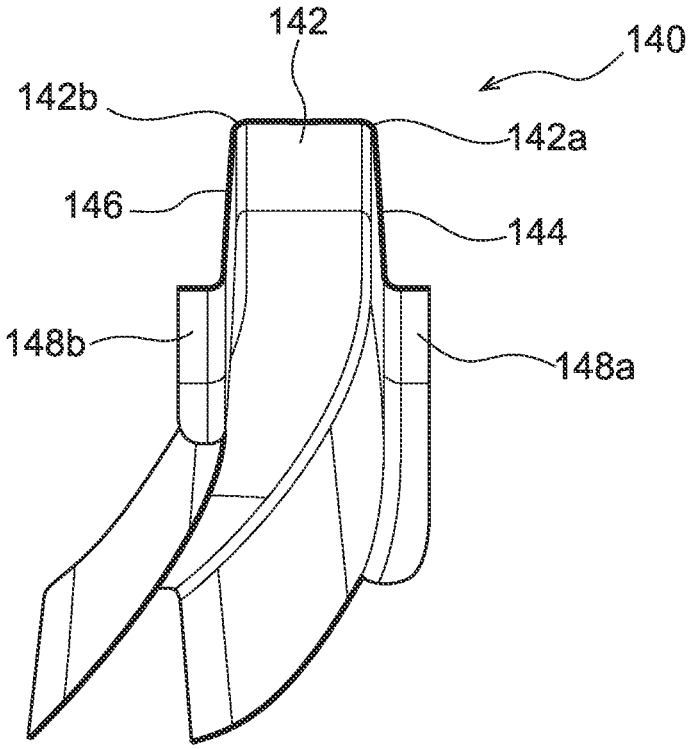
FIG. 16D is a perspective view illustrating the preliminary curving component illustrated in FIG. 16A from a bottom face side.

As illustrated in FIG. 12B, the top plate 102 is configured by a flat plate curving in a substantially S-shape within a plane parallel to the page in FIG. 12B. The flanges 108*a*, 108*b* are provided extending substantially parallel to the top plate 102, and are flat plates curving in substantially S-shapes. The vertical walls 104, 106 are curving plates that curve in substantially S-shapes in the thickness direction of the vertical walls 104, 106, and that are disposed parallel to each other.

Preliminary Curving Component: Modified Example 2

As illustrated in FIG. 13A to FIG. 13D, a preliminary curving component 110, serving as a preliminarily formed component is curved in a substantially S-shape in plan view and is also curved in a substantially S-shape as viewed from the side. The preliminary curving component 110 is configured including a top plate 112, vertical walls 114, 116 provided extending parallel to each other following ridge lines 112*a*, 112*b* of the top plate 112, and flanges 118*a*, 118*b* formed at leading ends of the vertical walls 114, 116. The top plate 112 is a curving plate curving in a substantially S-shape in the thickness direction of the top plate 112. The flanges 118*a*, 118*b* are provided extending substantially parallel to the top plate 112, and, similarly to the top plate 112, are curving plates that curve in substantially S-shapes in the thickness direction of the flanges 118*a*, 118*b*. The vertical walls 114, 116 are also curving plates that curve in substantially S-shapes in the thickness direction of the vertical walls 114, 116.

Preliminary Curving Component: Modified Example 3

As illustrated in FIG. 14A to FIG. 14D, a preliminary curving component 120, serving as a preliminarily formed component, is curved in an arc shape in side view at a length direction intermediate portion. The preliminary curving component 120 is configured including a top plate 122, vertical walls 124*a*, 124*b* provided extending parallel to each other following ridge lines 128*a*, 128*b* of the top plate 122, and flanges 126*a*, 126*b* formed at leading ends of the vertical walls 124*a*, 124*b*. Ridge lines between the vertical walls 124*a*, 124*b* and the flanges 126*a*, 126*b* configure respective ridge lines 129*a*, 129*b*.

The top plate 122 is configured by a curving plate that curves in the thickness direction of the top plate 122, and the flanges 126*a*, 126*b* are curving plates provided extending substantially parallel to the top plate 122. A length direction intermediate portion of the top plate 122 is formed with a convex shaped curved portion 122*a*, serving as a "curved portion", that curves in an arc shape toward the outer surface side (other sheet thickness direction side) of the top plate 122. The vertical walls 124*a*, 124*b* are flat plates running parallel to the page in FIG. 14C.

Preliminary Curving Component: Modified Example 4

As illustrated in FIG. 15A to FIG. 15D, as viewed from the side, a preliminary curving component 130, serving as a preliminarily formed component, has the opposite curvature to the preliminary curving component 120 of Modified Example 3. The preliminary curving component 130 is configured including a top plate 132, vertical walls 134*a*, 134*b* provided extending parallel to each other following ridge lines 133*a*, 133*b* of the top plate 132, and flanges 136*a*, 136*b* respectively extending toward the width direction outsides from ridge lines 135*a*, 135*b* at leading ends of the vertical walls 134*a*, 134*b*. Moreover, a concave shaped curved portion 132*a*, serving as a "curved portion" and curved in an arc shape convex on an inner surface side (one sheet thickness direction side) of the top plate 132 is formed at a length direction intermediate portion of the top plate 132. The flanges 136*a*, 136*b* extend substantially parallel to the top plate 132, and the vertical walls 134*a*, 134*b* are disposed parallel to the page in FIG. 15C.

Preliminary Curving Component: Modified Example 5

As illustrated in FIG. 16A to FIG. 16D, a preliminary curving component 140, serving as a preliminarily formed component, is configured including a top plate 142, vertical walls 144, 146 provided extending parallel to each other following ridge lines 142*a*, 142*b* of the top plate 142, and flanges 148*a*, 148*b* formed at leading ends of the vertical walls 144, 146. The top plate 142 is a curving plate that curves in a substantially S-shape in the thickness direction of the top plate 142. The flanges 148*a*, 148*b* are substantially S-shaped curving plates provided extending substantially parallel to the top plate 142. The vertical walls 144, 146 are also configured by curving plates that curve in substantially S-shapes in the thickness direction of the vertical walls 144, 146. In this preliminary curving component 140, the flanges 148*a*, 148*b* are not provided so as to extend along the entire length of the vertical walls 144, 146. Namely, the vertical walls 144, 146 include portions where the flanges 148*a*, 148*b* are not present. In FIG. 16A to FIG. 16D, the lengths of the flanges 148*a*, 148*b* are shorter lengths than a length of the vertical walls 144, 146 along lower edge portions of the vertical walls 144, 146 from one end portion of the preliminary curving component 140. The flange 148*a* has a longer dimension than the flange 148*b*.

Preliminary Curving Component: Modified Example 6

Figure 17A:
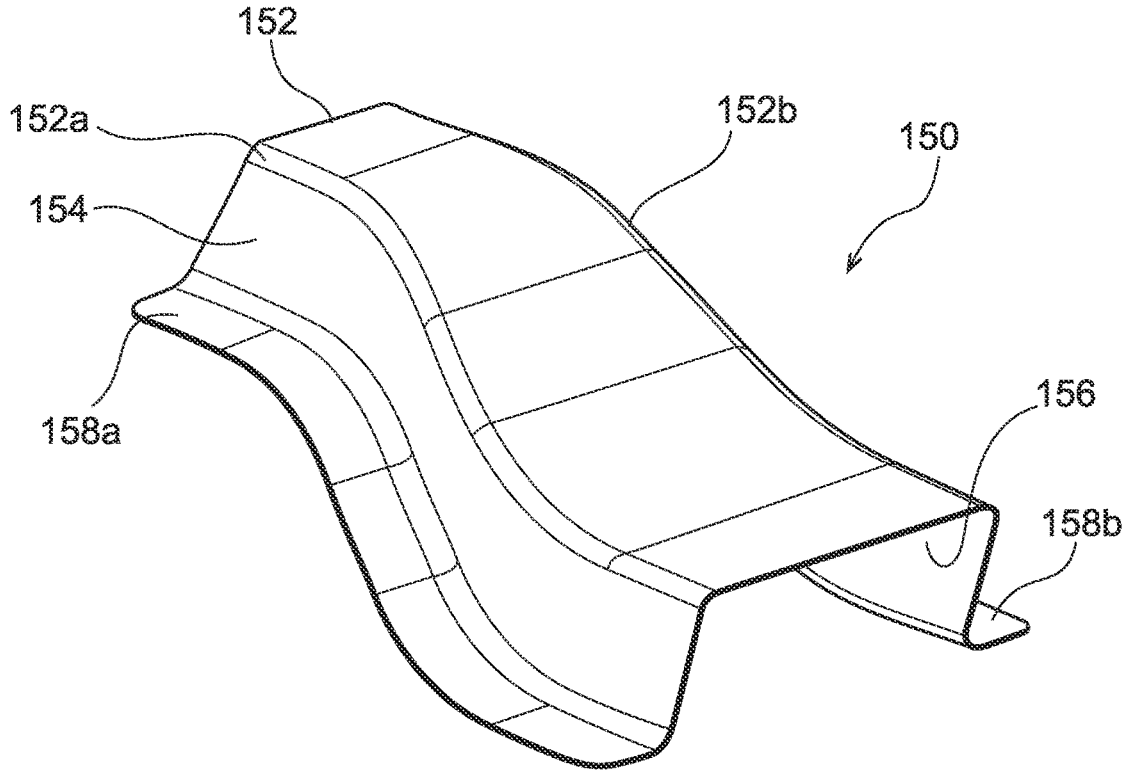
FIG. 17A is a perspective view illustrating another preliminary curving component formed by the first process.
Figure 17B:
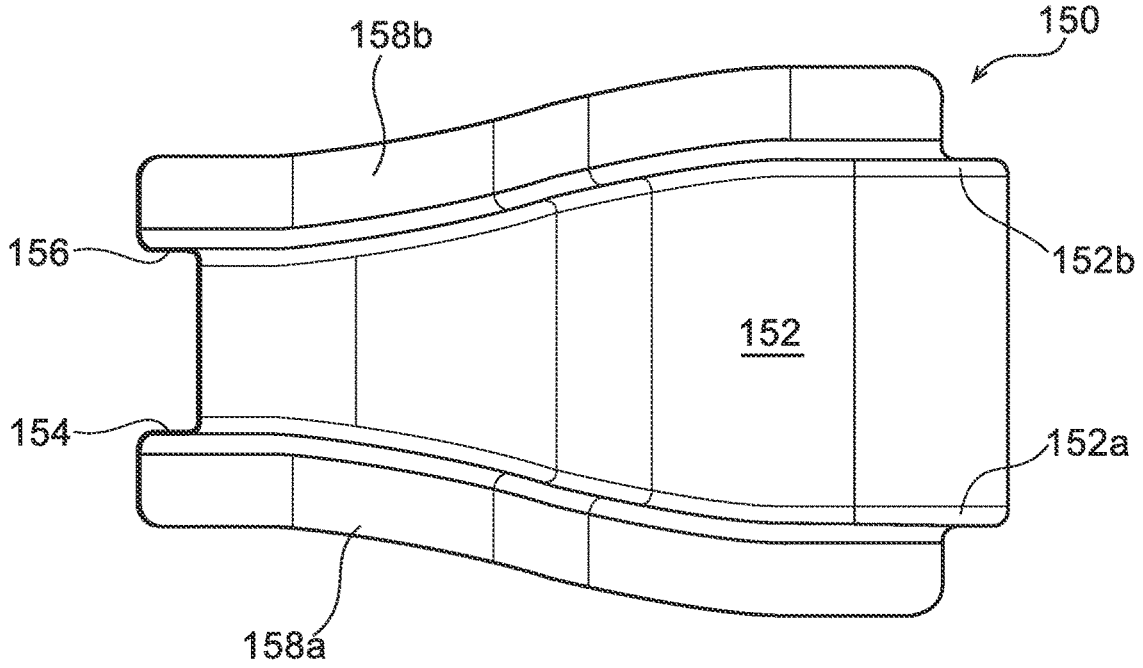
FIG. 17B is a plan view illustrating the preliminary curving component illustrated in FIG. 17A from above.
Figure 17C:
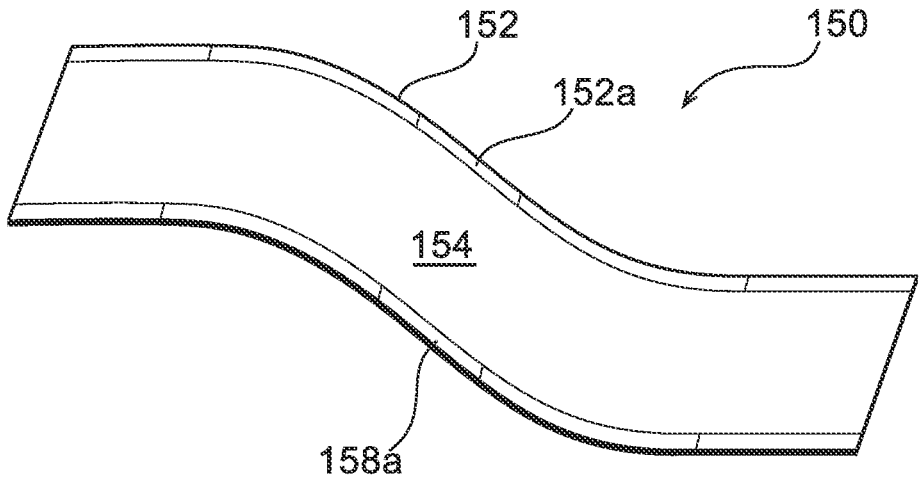
FIG. 17C is a side view illustrating the preliminary curving component illustrated in FIG. 17A from one width direction side.
Figure 17D:
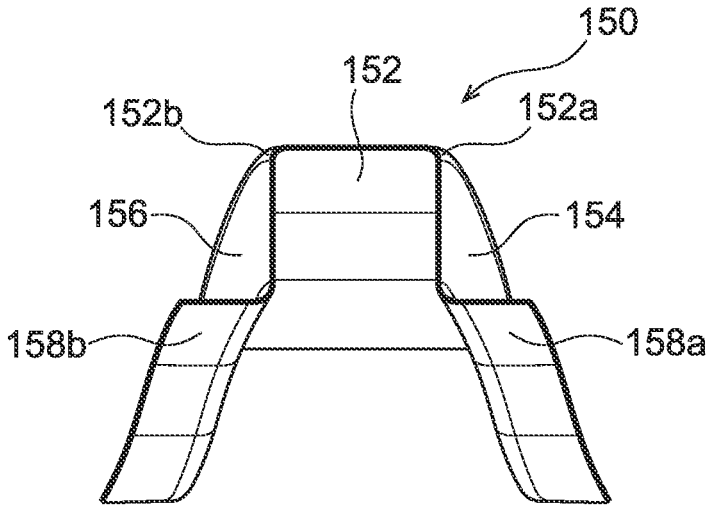
FIG. 17D is a perspective view illustrating the preliminary curving component illustrated in FIG. 17A from a bottom face side.

As illustrated in FIG. 17A to FIG. 17D, a preliminary curving component 150, serving as a preliminarily formed component, curves in a substantially S-shape as viewed from the side, and gradually increases in width on progression toward one length direction side in plan view. The preliminary curving component 150 is configured including a top plate 152, vertical walls 154, 156 provided extending parallel to each other following ridge lines 152*a*, 152*b* of the top plate 152, and flanges 158*a*, 158*b* formed at leading ends of the vertical walls 154, 156. The top plate 152 is configured by a curving plate curving in a substantially S-shape in the thickness direction of the top plate 152. The flanges 158*a*, 158*b* are configured by curving plates provided extending substantially parallel to the top plate 152. Each of the vertical walls 154, 156 is configured by a flat plate that curves in a substantially S-shape as viewed from the side, as illustrated in FIG. 17B. The width of the top plate 152 gradually increases on progression toward an end portion on the one side of the preliminary curving component 150. The vertical wall 154 and the vertical wall 156 gradually become further away from each other on progression toward the end portion on the one side of the preliminary curving component 150.

Preliminary Curving Component: Modified Example 7

Figure 18A:
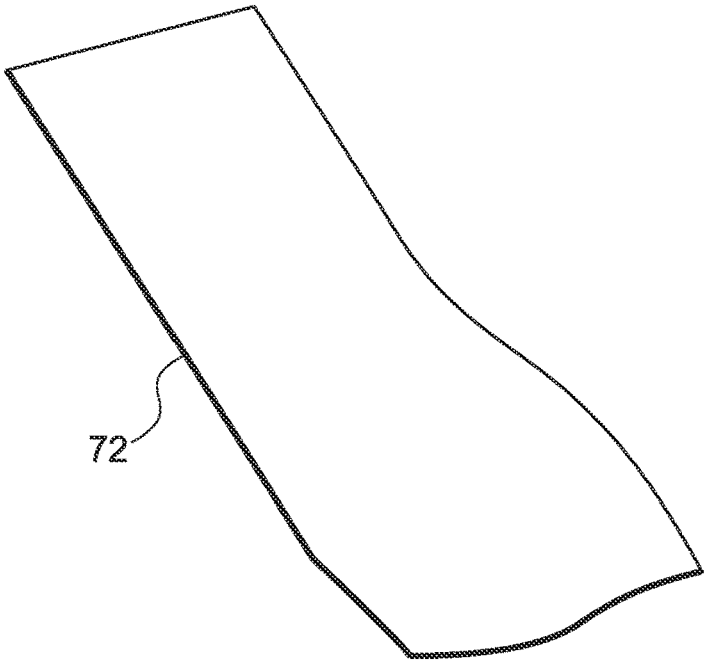
FIG. 18A is a perspective view illustrating a metal stock sheet before pre-processing.
Figure 18B:
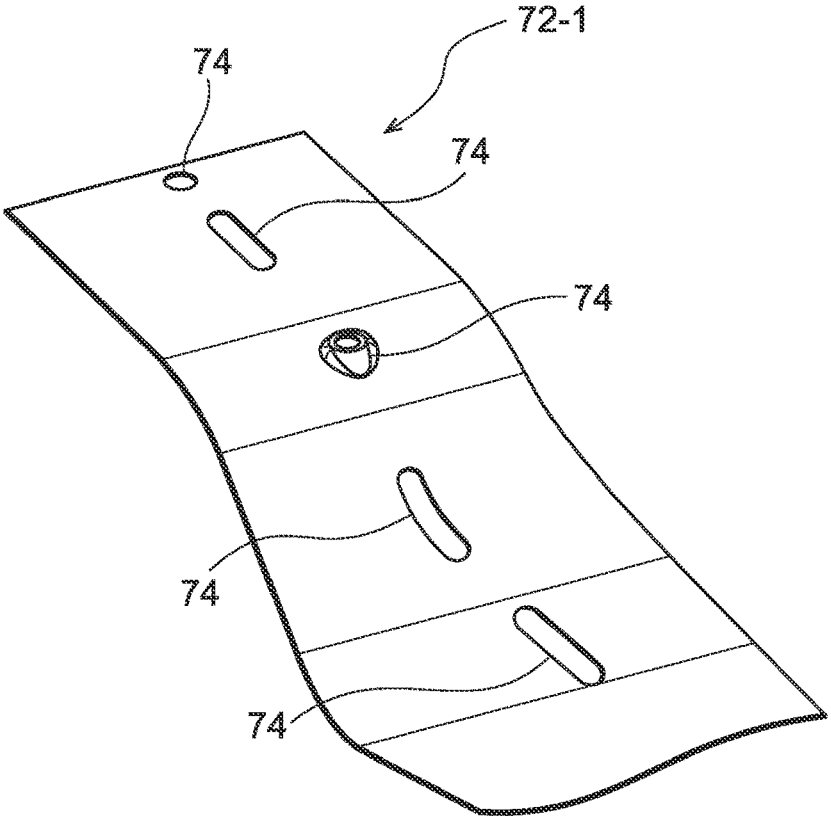
FIG. 18B is perspective view illustrating a pre-processed metal stock sheet.
Figure 18C:
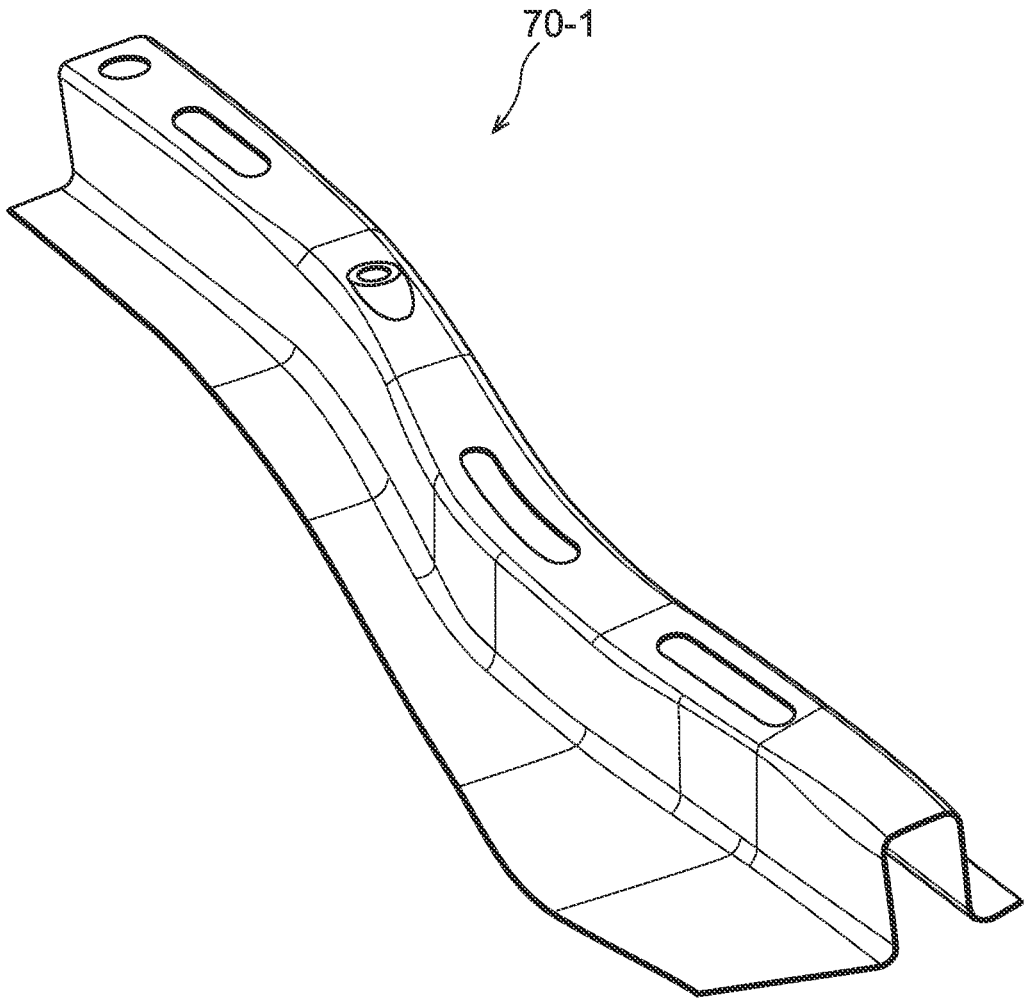
FIG. 18C is perspective view illustrating a preliminary curving component formed from the pre-processed metal stock sheet.
Figure 18D:
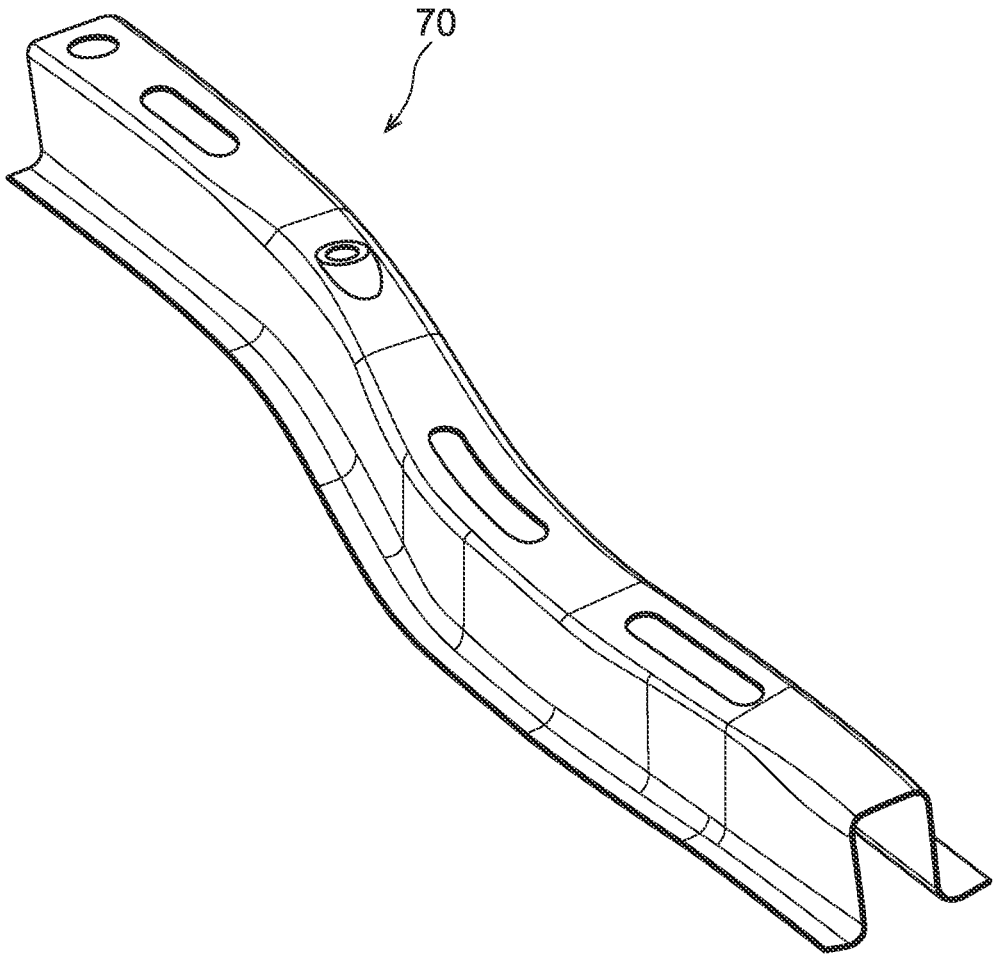
FIG. 18D is perspective view illustrating a state in which the preliminary curving component illustrated in FIG. 18C has been trimmed.

A preliminary curving component 70 illustrated in FIG. 18D, serving as a preliminarily formed component, is formed by press working, and then trimming, a pre-processed metal sheet formed by performing pre-processing on a metal stock sheet.

A pre-processed metal sheet 72-1 is formed by forming plural protrusion shaped portions 74, illustrated in FIG. 18B, in a rectangular shaped metal stock sheet 72, illustrated in FIG. 18A. Next, the pre-processed metal sheet 72-1 is press worked by the hat-shaped cross-section component manufacturing apparatus 500 (see FIG. 5) described above, thereby forming a preliminary curving component 70-1, as illustrated in FIG. 18C, that includes portions that are not wanted in the manufactured product. The unwanted portions of the preliminary curving component 70-1 are then trimmed to form the preliminary curving component 70 illustrated in FIG. 18D.

Note that as illustrated in FIG. 18C, when forming the pre-processed metal sheet 72-1 including the protrusion shaped portions 74 using the manufacturing apparatus 500 (see FIG. 5), a top plate portion is pressed against the punch 504 by the pad 503, and it is conceivable that the pre-processed protrusion shaped portions 74 could be deformed. Accordingly, the pad 503 and the punch 504 are preferably provided with shapes respectively corresponding to the protrusion shaped portions 74 to enable pressing and gripping without deforming the protrusion shaped portions 74.

Second Process

Next, explanation follows regarding the second process. Explanation first follows regarding configuration of an intermediate curving component 700, serving as a "hat-shaped cross-section component", formed in the second process (by working), followed by explanation regarding a manufacturing apparatus 710 employed in the second process, and then explanation regarding the second process. Note that in the following explanation, explanation is given regarding a case in which the preliminary curving component 120 serving as a "preliminarily formed component" is formed into the intermediate curving component 700 in the second process.

Intermediate Curving Component 700

Figure 19:
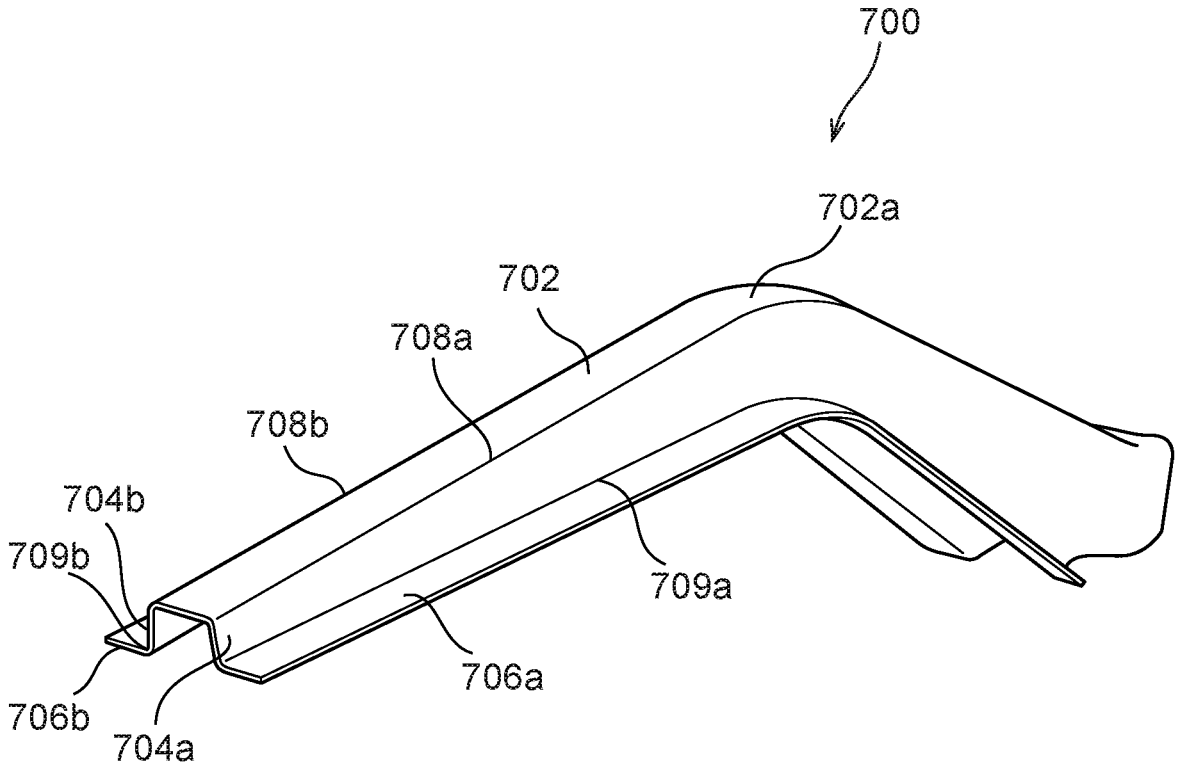
FIG. 19 is a perspective view illustrating an example of an intermediate curving component that has been processed in a second process of a hat-shaped cross-section component manufacturing method according to the present exemplary embodiment.

As illustrated in FIG. 19, the intermediate curving component 700 is formed with a hat-shaped cross-section profile forming an elongated shape similar to that of the preliminary curving component 120. Namely, the intermediate curving component 700 is configured including a top plate 702 extending along the length direction, a pair of vertical walls 704*a*, 704*b* respectively extending from both width direction ends of the top plate 702 toward the lower side (one sheet thickness direction side of the top plate 702), and a pair of flanges 706*a*, 706*b* extending from lower ends of the respective vertical walls 704*a*, 704*b* toward the width direction outside of the top plate 702. Ridge lines between the top plate 702 and the respective vertical walls 704*a*, 704*b* configure ridge lines 708*a*, 708*b*, and ridge lines between the respective vertical walls 704*a*, 704*b* and the flanges 706*a*, 706*b* configure ridge lines 709*a*, 709*b*. A length direction intermediate portion of the top plate 702 is formed with a convex shaped curved portion 702*a* that curves in an arc shape toward the outer surface side (other sheet thickness direction side) of the top plate 702.

The intermediate curving component 700 has a similar configuration to the preliminary curving component 120, with the exception of the following points. Namely, although a width dimension of the intermediate curving component 700 is set the same as a width dimension of the preliminary curving component 120, a height dimension of the intermediate curving component 700 (the vertical walls 704*a*, 704*b*) is set as a different dimension to the height dimension of the preliminary curving component 120 (the vertical walls 124*a*, 124*b*). Specific explanation follows regarding this point. Note that since the intermediate curving component 700 is formed with a left-right symmetrical shape in the width direction, the following explanation deals with a portion on one width direction side of the intermediate curving component 700, and explanation regarding the other width direction side of the intermediate curving component 700 is omitted.

Figure 20:
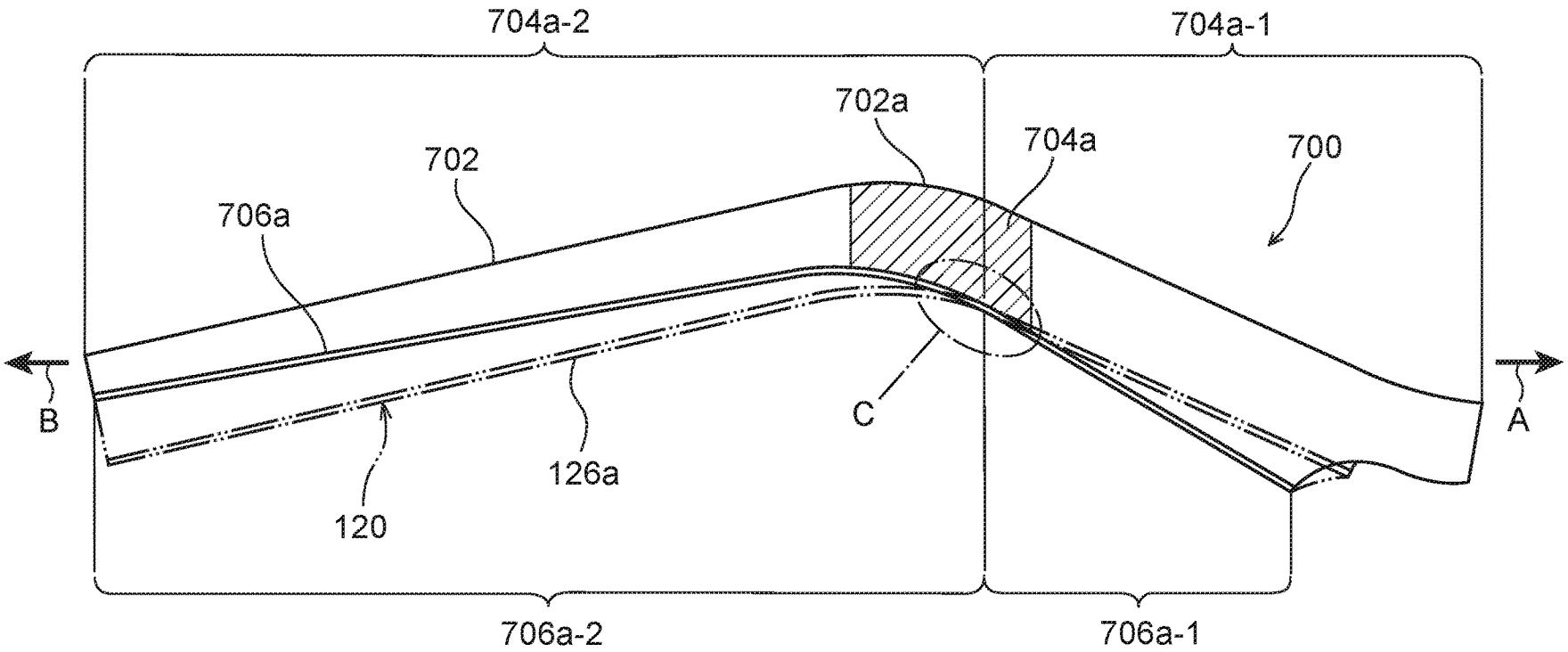
FIG. 20 is a side view of the intermediate curving component illustrated in FIG. 19, as viewed from one width direction side.

As illustrated in FIG. 20, the height dimension of a portion at one side in a length direction of the intermediate curving component 700 (specifically, a portion on the side in the direction of the arrow A in FIG. 20 with respect to the convex shaped curved portion 702*a*) is configured higher than a height dimension of the preliminary curving component 120. More specifically, a flange 706*a*-1 at one side in the length direction of the intermediate curving component 700 is inclined so as to move away toward the lower side (in a direction to move away from the top plate 702) on progression toward the one side in the length direction of the intermediate curving component 700 with respect to the flanges 126*a* of the preliminary curving component 120 (see the flange 126*a* illustrated by the double-dotted dashed lines in FIG. 20). Accordingly, the height dimension of a vertical wall 704*a*-1 connected to the flange 706*a*-1 is set so as to increase on progression toward the one side in the length direction of the intermediate curving component 700.

The height dimension of a portion at another side in the length direction of the intermediate curving component 700 (specifically, an adjacent portion on the side in the direction of the arrow B in FIG. 20 with respect to the vertical wall 704*a*-1 and the flange 706*a*-1) is configured lower than the height dimension of the preliminary curving component 120. Specifically, a flange 706*a*-2 at another side in the length direction of the intermediate curving component 700 is inclined with respect to the flanges 126*a* of the preliminary curving component 120 (see the flanges 126*a* illustrated by double-dotted dashed lines in FIG. 20) so as to draw closer to the upper side (in a direction approaching the top plate 702) on progression toward the other side in the length direction toward the other side in the length direction of the intermediate curving component 700. The height dimension of a vertical wall 704*a*-2 connected to the flange 706*a*-2 is thus set so as to become smaller on progression toward the other side in the length direction. Accordingly, the height dimension of the intermediate curving component 700 (vertical walls 704*a*) is configured so as to become larger on progression from an end portion at another side in the length direction of the intermediate curving component 700 toward the one side in the length direction of the intermediate curving component 700. Namely, the height dimension of the intermediate curving component 700 (vertical wall 704*a*) is changed continuously with respect to the preliminary curving component 120 over the entire length direction of the intermediate curving component 700.

Manufacturing Apparatus 710

Figure 21:
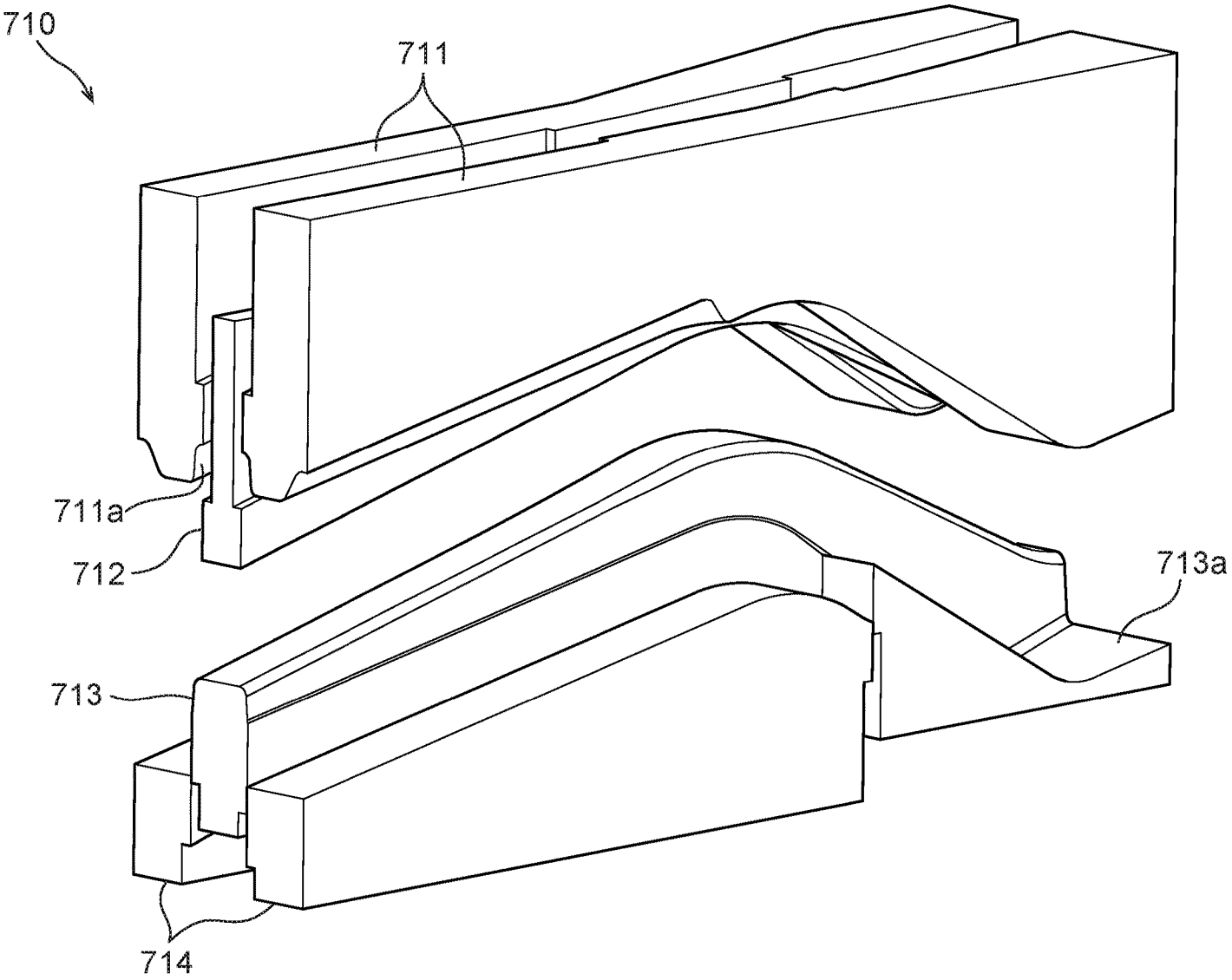
FIG. 21 is a perspective view illustrating relevant portions of a manufacturing apparatus employed in the second process.

As illustrated in FIG. 21, the manufacturing apparatus 710 is configured including an intermediate forming die 711 (referred to below as simply the "die 711"), serving as a "die", and an intermediate forming pad 712 (referred to below as simply the "pad 712"), serving as a "pad", that configure an apparatus upper side portion of the manufacturing apparatus 710. The manufacturing apparatus 710 further includes an intermediate forming punch 713 (referred to below as simply the "punch 713"), serving as a "punch", and an intermediate forming holder 714 (referred to below as simply the "holder 714"), serving as a "holder", configuring an apparatus lower side portion of the manufacturing apparatus 710. In FIG. 21, for simplicity, the die 711 is illustrated divided along the width direction of the manufacturing apparatus 710; however, the die 711 is actually integrally joined at an upper end portion. The holder 714 is likewise illustrated divided along the width direction of the manufacturing apparatus 710; however, the holder 714 is also integrally joined at a lower end portion.

Figure 22A:
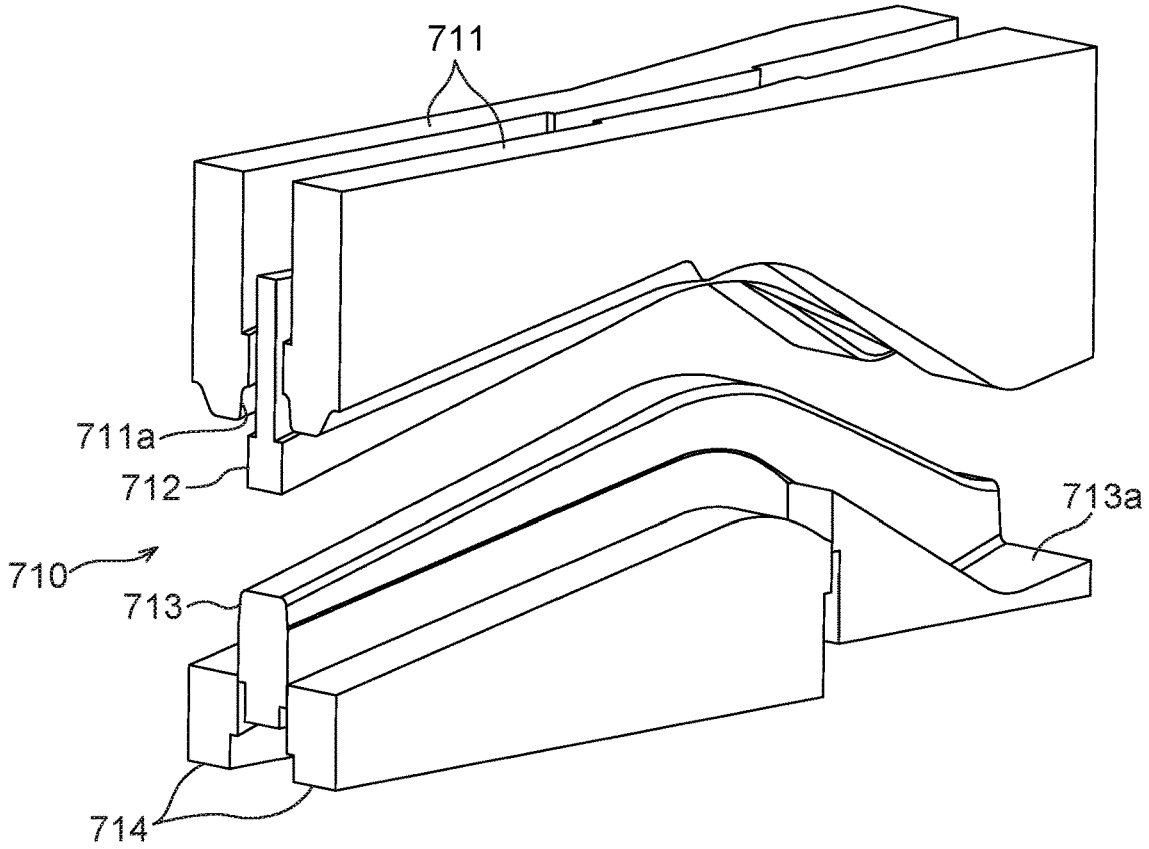
FIG. 22A is a perspective view illustrating the manufacturing apparatus illustrated in FIG. 21, at a stage at the start of processing.
Figure 22B:
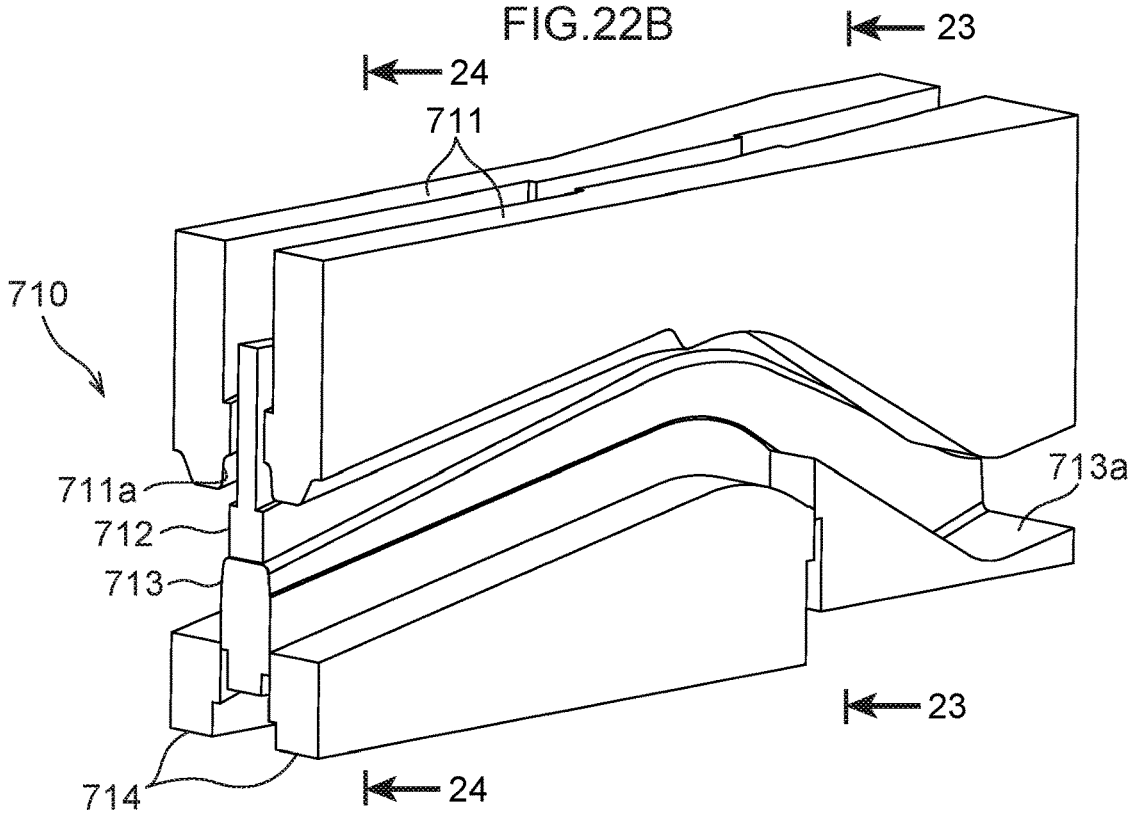
FIG. 22B is a perspective view illustrating a stage at which a pad and a die have been moved from the stage illustrated in FIG. 22A, and a top plate of a preliminary curving component is gripped and restrained between the pad and the punch.
Figure 22C:
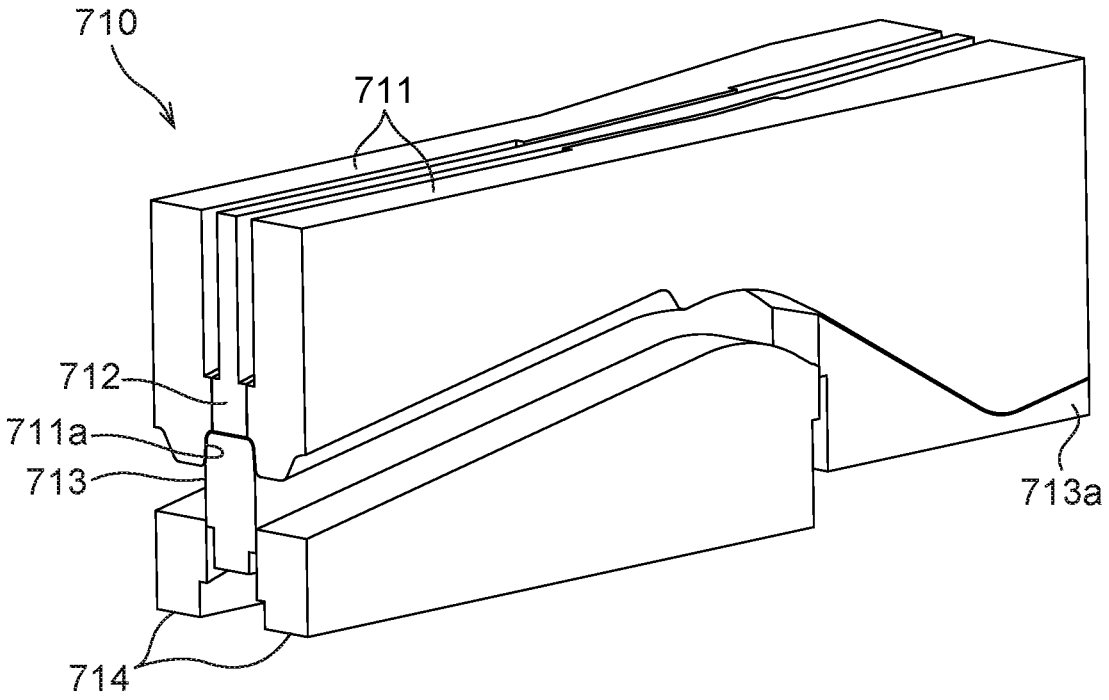
FIG. 22C is a perspective view illustrating a stage of a bending and stretching process in which the die is moved relatively toward the side of the punch from the stage illustrated in FIG. 22B and vertical walls at one side in the length direction of the preliminary curving component are bent and stretched.
Figure 22D:
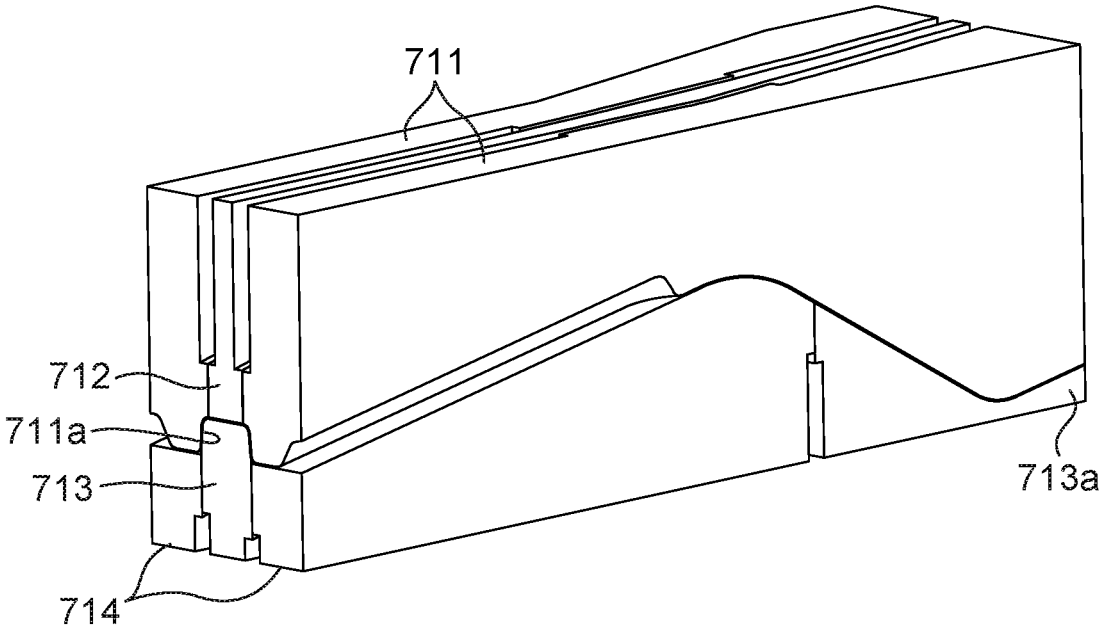
FIG. 22D is a perspective view illustrating a stage of a bend back process in which the holder is moved relatively toward the side of the die from the stage illustrated in FIG. 22C, and vertical walls at another side in the length direction of the preliminary curving component are bent back.
Figure 23:
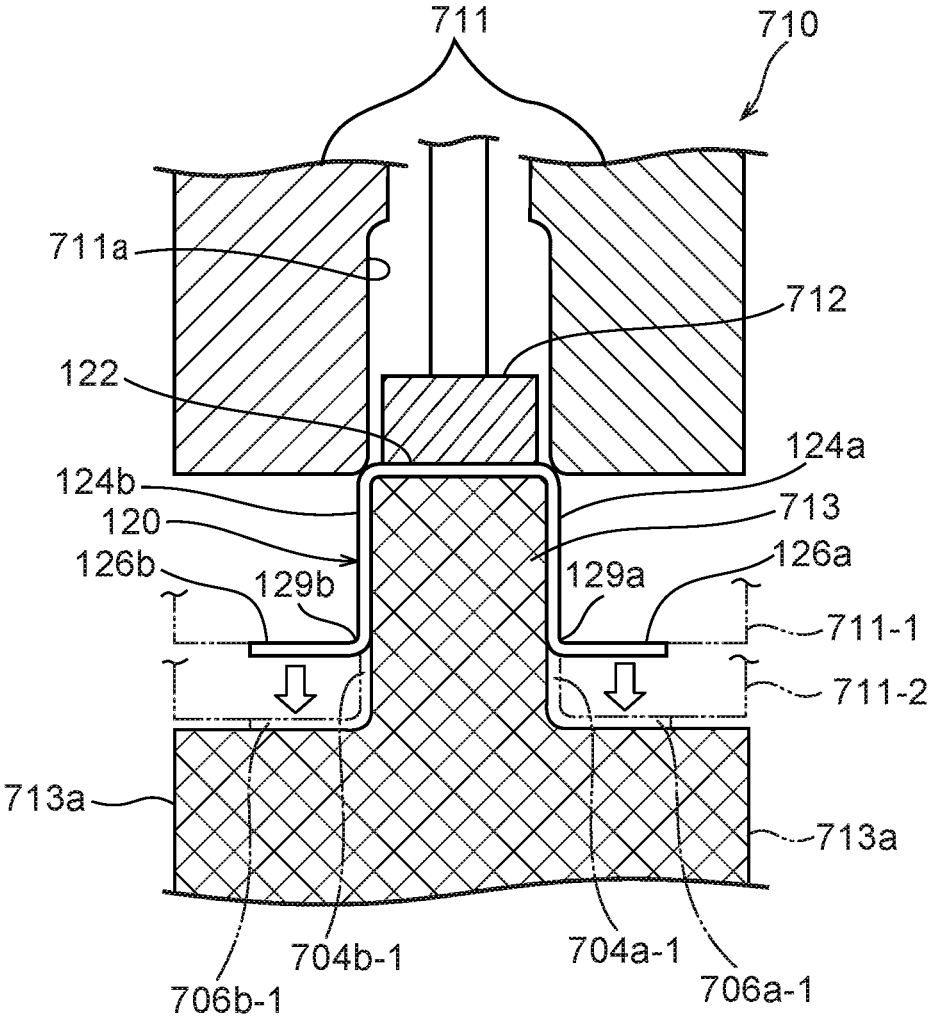
FIG. 23 is a cross-section (a cross-section taken along line 23-23 in FIG. 22B) illustrating a state in which a portion at one side in the length direction of a top plate of the preliminary curving component is gripped and restrained by the pad and the punch at the stage illustrated in FIG. 22B.
Figure 24:
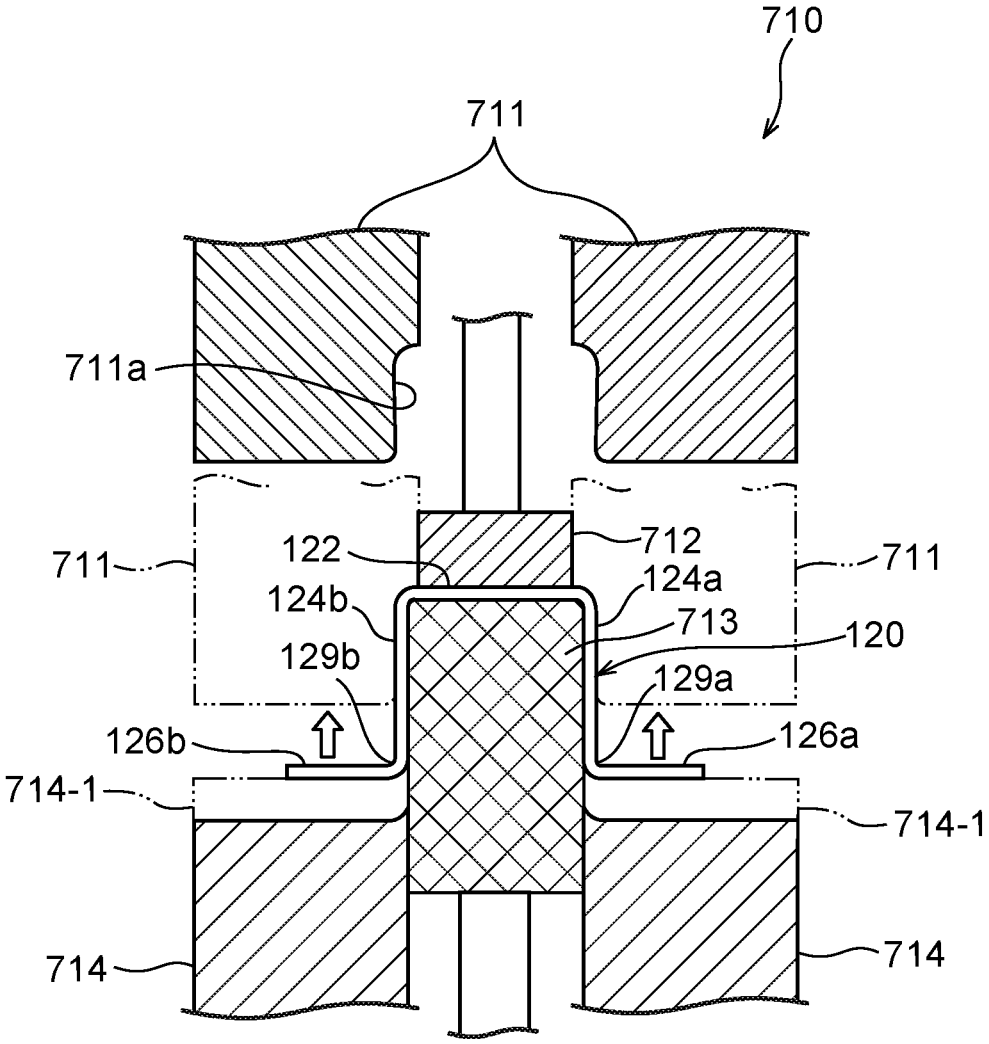
FIG. 24 is a cross-section (a cross-section taken along line 24-24 in FIG. 22B) illustrating a state in which a portion at another side in the length direction of a top plate of the preliminary curving component is gripped and restrained by the pad and the punch at the stage illustrated in FIG. 22B.
Figure 25:
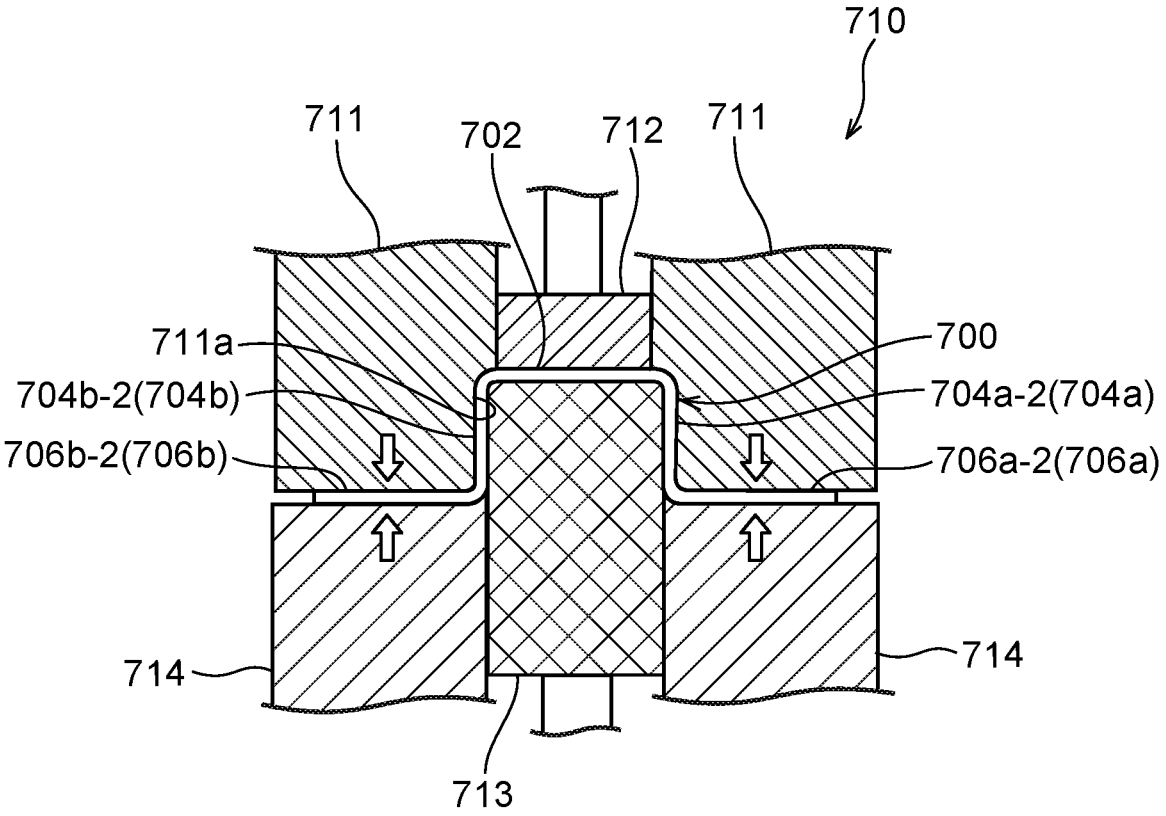
FIG. 25 is a cross-section illustrating a stage of the bend back process illustrated in FIG. 22D.

As illustrated in FIG. 22A to FIG. 22D, and in FIG. 23 to FIG. 25, the die 711 is disposed at the apparatus upper side of the punch 713. A width direction central portion of the die 711 is formed with a recess 711*a* open toward the apparatus lower side, and inner peripheral faces of lower end portions of the recess 711*a* are formed with a profile corresponding to outer surfaces of the top plate 122 and the vertical walls 124*a*, 124*b* of the preliminary curving component 120. Namely, the width dimension of the recess 711*a* is set substantially the same as the width dimension of the outer surface side of the preliminary curving component 120 (intermediate curving component 700).

Moreover, a lower face (apparatus lower side end face) of the die 711 configures a forming face corresponding to the profile of the outer surfaces of the flanges 706*a*, 706*b* of the intermediate curving component 700. The die 711 is coupled to a mover device (not illustrated in the drawings) configured similarly to the mover device 509 of the manufacturing apparatus 500. Actuating the mover device moves the die 711 in the apparatus up-down direction.

The pad 712 is disposed inside the recess 711*a* of the die 711. The pad 712 is coupled to a pad press unit 715 (see FIG. 23) configured similarly to the pad press unit 506 of the manufacturing apparatus 500. A lower face (apparatus lower side face) of the pad 712 is formed with a profile corresponding to the profile of the outer surface of the top plate 122 of the preliminary curving component 120. When the pad press unit 715 is actuated, the pad 712 presses the top plate 122 of the preliminary curving component 120 toward the apparatus lower side (the punch 713 side), and the top plate 122 of the preliminary curving component 120 is pressed and gripped between the punch 713, described later, and the pad 712.

The punch 713 is disposed at the apparatus lower side of the pad 712, and faces the pad 712 along the apparatus up-down direction. Outer faces of the punch 713 have a profile corresponding to the profile of the inner surface sides of the top plate 702 and the respective vertical walls 704*a*, 704*b* of the intermediate curving component 700. A portion at one side in the length direction of the punch 713 is integrally formed with a pair of flange forming portions 713*a*, and the flange forming portions 713*a* project out from the punch 713 toward the width direction outside. Upper faces of the flange forming portions 713*a* configure forming faces corresponding to the profiles of inner surfaces of the flanges 706*a*, 706*b* of the intermediate curving component 700.

The holder 714 is disposed adjacent to the punch 713 at the width direction outside, and is disposed adjacent to the flange forming portions 713*a* of the punch 713 at another side in the length direction of the punch 713. The holder 714 is disposed at the apparatus lower side of a portion at another side in the length direction of the die 711, and is disposed facing the die 711 along the apparatus up-down direction. Upper faces of the holder 714 configure forming faces corresponding to the profile of inner surfaces of the flanges 706*a*, 706*b* of the intermediate curving component 700. The holder 714 is coupled to holder press units 716 (see FIG. 24) configured similarly to the blank holder press units 507 of the manufacturing apparatus 500. Actuating the holder press units 716 moves the holder 714 in the apparatus up-down direction.

In a non-actuated state of the holder press units 716, the holder 714 is disposed at the apparatus lower side of the flange forming portions 713*a* of the punch 713. Namely, in this state, the upper faces of the flange forming portions 713*a* and the upper faces of the holder 714 are disposed offset in the apparatus up-down direction.

Next, explanation follows regarding the second process for forming the intermediate curving component 700 using the manufacturing apparatus 710, with reference to FIG. 22A to FIG. 22D, and FIG. 23 to FIG. 25. Note that for simplicity, the preliminary curving component 120 (intermediate curving component 700) is omitted from illustration in FIG. 22A to FIG. 22D.

First, with the manufacturing apparatus 710 in the state illustrated in FIG. 22A, the preliminary curving component 120 is set on the punch 713 from the apparatus upper side, and the top plate 122 of the preliminary curving component 120 is disposed on the punch 713. The top plate 122 is thereby supported from the apparatus lower side by the punch 713. Next, as illustrated in FIG. 22B, FIG. 23, and FIG. 24, the die 711 and the pad 712 are moved toward the apparatus lower side (the punch 713 side), and the top plate 122 is pressed and gripped by the pad 712 and the punch 713 (gripping process).

In this state, as illustrated in FIG. 22C, the die 711 is moved (lowered) further toward the apparatus lower side (the punch 713 side), thereby forming the vertical walls 704*a*-1, 704*b*-1, and the flanges 706*a*-1, 706*b*-1 at one side in the length direction of the intermediate curving component 700 (a bending and stretching process). Specifically, as illustrated by the double-dotted dashed lines in FIG. 23, lower faces at one side in the length direction of the die 711 contact upper faces of the flanges 126*a*, 126*b* at one side in the length direction of the preliminary curving component 120 accompanying lowering of the die 711 (see the die 711-1 illustrated by double-dotted dashed lines in FIG. 23), thereby pressing the flanges 126*a*, 126*b* toward the apparatus lower side. The ridge lines 129*a*, 129*b* between the vertical walls 124*a*, 124*b* and the flanges 126*a*, 126*b* of the preliminary curving component 120 thereby move gradually toward the apparatus lower side (toward the side of the direction away from the top plate 122), and the flanges 126*a*, 126*b* at one side in the length direction of the preliminary curving component 120 are moved toward the apparatus lower side while following the lower faces of the die 711. Then, when the die 711 reaches a position at the end of its stroke (see the die 711-2 illustrated by double-dotted dashed lines in FIG. 23), the flanges 126*a*, 126*b* of the preliminary curving component 120 are pressed and gripped by the flange forming portions 713*a* of the punch 713 and the die 711, thus forming the flanges 706*a*-1, 706*b*-1 of the intermediate curving component 700. Namely, bending and stretching in the present exemplary embodiment is a processing procedure in which the bend positions of bent portions of the ridge lines 129*a*, 129*b* between the vertical walls 704*a*-1, 704*b*-1 and the flanges 126*a*, 126*b* are progressively shifted and deformed while being stretched.

Figure 26A:
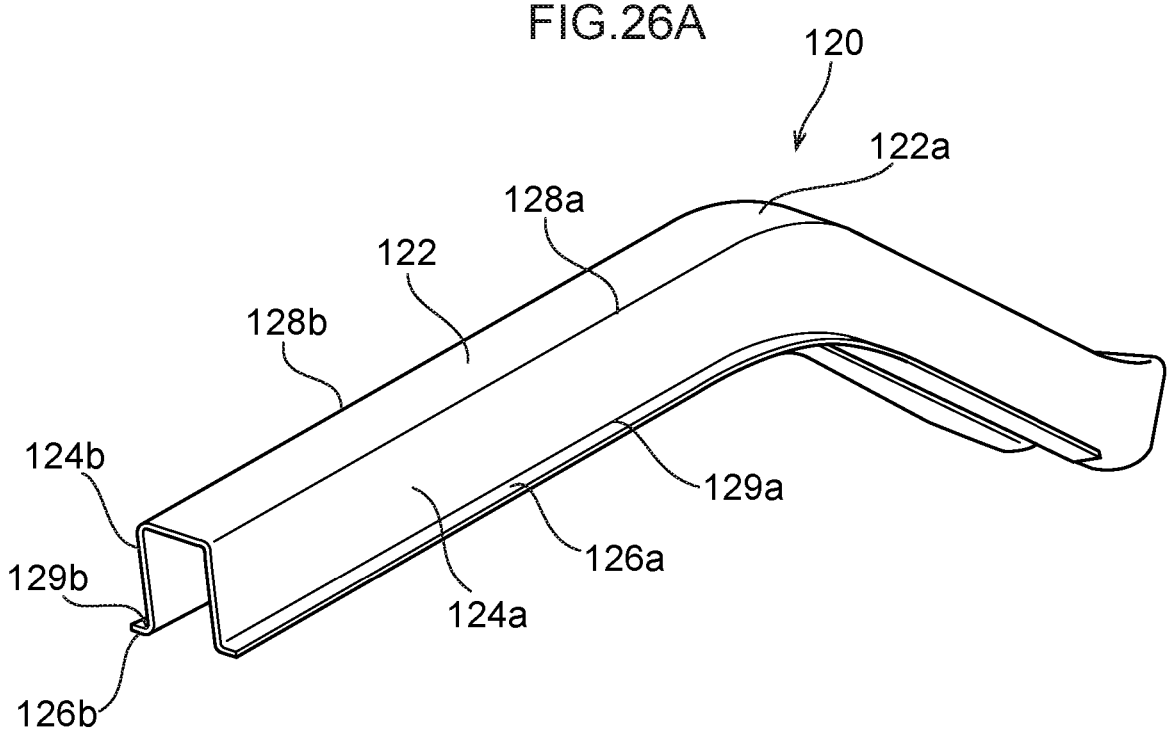
FIG. 26A is a perspective view illustrating a state prior to processing a preliminary curving component in a second process.
Figure 26B:
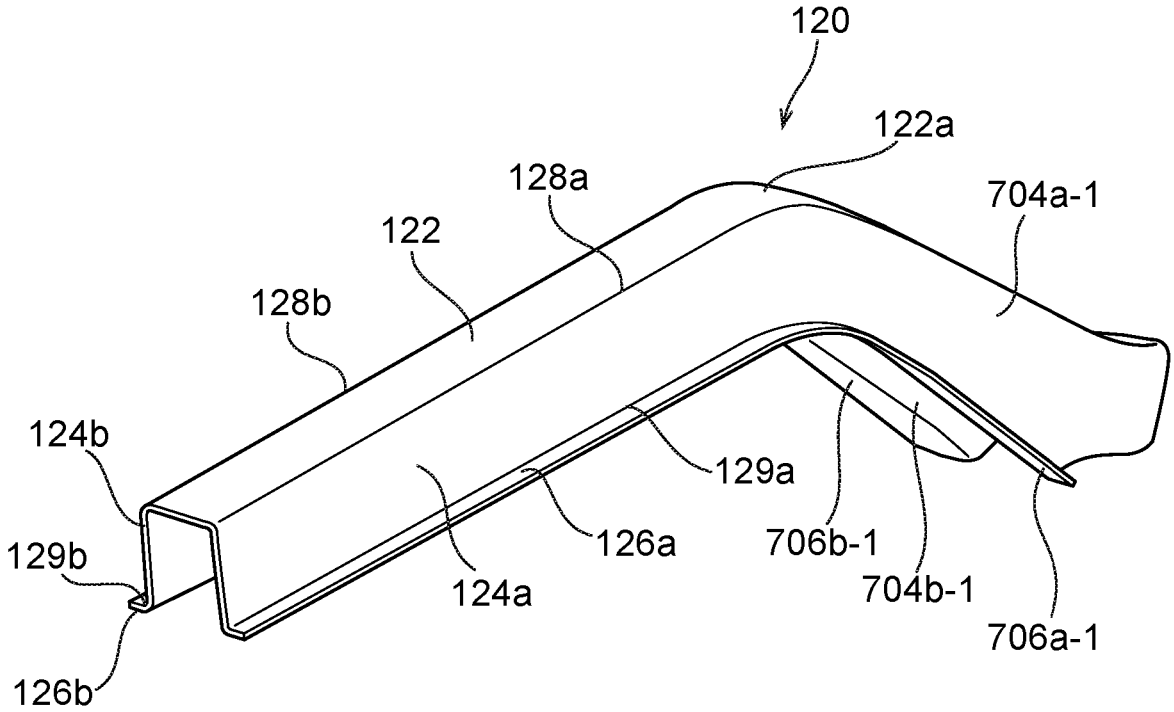
FIG. 26B is a perspective view illustrating a state of a preliminary curving component that has been processed by a bending and stretching process of a second process.

Due to the above, in the bending and stretching process, the vertical walls 124*a*, 124*b* of the preliminary curving component 120 are bent and stretched toward the apparatus lower side such that the positions of the ridge lines 129*a*, 129*b* move away from the top plate 122 at one side in the length direction of the preliminary curving component 120. As a result, the vertical walls 704*a*-1, 704*b*-1 of the intermediate curving component 700 are formed, and the flanges 706*a*-1, 706*b*-1 of the intermediate curving component 700 are formed, such that a portion of each of the flanges 126*a*, 126*b* of the preliminary curving component 120 forms part of the respective vertical walls 124*a*, 124*b*, (the preliminary curving component 120 is formed into the shape illustrated in FIG. 26B from the shape illustrated in FIG. 26A). Moreover, as described above, the height dimension of the vertical wall 704*a*-1 connected to the flange 706*a*-1 is set so as to become larger on progression toward the one side in the length direction of the intermediate curving component 700. Accordingly, in the bending and stretching process, the bending and stretching amount of the preliminary curving component 120 becomes greater on progression toward the one side in the length direction of the preliminary curving component 120.

Note that as illustrated by the double-dotted dashed lines in FIG. 24, during the bending and stretching process, when the die 711 has reached the position at the end of its stroke, the die 711 is disposed at a separation to the apparatus upper side of the flanges 126*a*, 126*b* at another side in the length direction of the preliminary curving component 120. Namely, in the bending and stretching process, the vertical walls 124*a*, 124*b* are only bent and stretched at one side in the length direction of the preliminary curving component 120, and the vertical walls 124*a*, 124*b* are not bent and stretched at another side in the length direction of the preliminary curving component 120 (see FIG. 26B).

As illustrated in FIG. 22D, after the bending and stretching process, the holder press units 716 are actuated, moving (raising) the holder 714 toward the apparatus upper side, thereby forming the vertical walls 704*a*-2, 704*b*-2 and the flanges 706*a*-2, 706*b*-2 at another side in the length direction of the intermediate curving component 700 (bend back process). Specifically, as illustrated in FIG. 24, the upper faces of the holder 714 contact the lower faces of the flanges 126*a*, 126*b* at another side in the length direction of the preliminary curving component 120 as the holder 714 rises (see the holder 714-1 illustrated by double-dotted dashed lines in FIG. 24), pressing the flanges 126*a*, 126*b* toward the apparatus upper side. Accordingly, the ridge lines 129*a*, 129*b* between the vertical walls 124*a*, 124*b* and the flanges 126*a*, 126*b* at another side in the length direction of the preliminary curving component 120 are gradually moved toward the apparatus upper side (the side of a direction approaching the top plate 122), and the flanges 126*a*, 126*b* at another side in the length direction of the preliminary curving component 120 are moved toward the apparatus upper side, while following the upper faces of the holder 714. Then, as illustrated in FIG. 25, when the holder 714 has reached a position at the end of its stroke, the flanges 126*a*, 126*b* of the preliminary curving component 120 are pressed and gripped by the holder 714 and the die 711, thereby forming the flanges 706*a*-2, 706*b*-2 of the intermediate curving component 700. Namely, bend back in the present exemplary embodiment is a processing procedure in which the bend positions of the bent portions of the ridge lines 129*a*, 129*b* between the vertical walls 704*a*-1, 704*b*-1 and the flanges 126*a*, 126*b* are progressively shifted and deformed while being bent back.

Due to the above, in the bend back process, the vertical walls 124*a*, 124*b* of the preliminary curving component 120 are bent back toward the apparatus upper side such that the positions of the ridge lines 129*a*, 129*b* approach the top plate 122 at another side in the length direction of the preliminary curving component 120. As a result, the flanges 706*a*-2, 706*b*-2 of the intermediate curving component 700 are formed, and the vertical walls 704*a*-2, 704*b*-2 of the intermediate curving component 700 are formed, such that a portion of each of the vertical walls 124*a*, 124*b* of the preliminary curving component 120 forms part of the respective flanges 126*a*, 126*b* (formed into the shape illustrated in FIG. 19 from the shape illustrated in FIG. 26B). Note that as described above, the height dimension of the vertical wall 704*a*-2 connected to the flange 706*a*-2 is set so as to become smaller on progression toward the other side in the length direction toward the other side in the length direction of the intermediate curving component 700. Accordingly, during the bend back process, a bend back amount with respect to the preliminary curving component 120 becomes greater on progression toward the other side in the length direction toward the other side in the length direction of the preliminary curving component 120.

Accordingly, in the second process, during the bending and stretching process, the die 711 is lowered such that the vertical walls 124*a*, 124*b* at one side in the length direction of the preliminary curving component 120 are bent and stretched toward the apparatus lower side. Then, during the bend back process following the bending and stretching process, the holder 714 is raised such that the vertical walls 124*a*, 124*b* at another side in the length direction of the preliminary curving component 120 are bent back toward the apparatus upper side to form the intermediate curving component 700. The height dimensions of the vertical walls 124*a*, 124*b* of the preliminary curving component 120 are thus changed in the second process.

Third Process

Next, explanation follows regarding the third process for restriking the intermediate curving component 700 formed in the second process. In the third process, the intermediate curving component 700 in which spring-back has occurred is restruck to form a completed curving component 800, serving as a "hat-shaped cross-section component". Explanation first follows regarding the completed curving component 800 formed (processed) in the third process, followed by explanation regarding a manufacturing apparatus 820 employed in the third process, and then explanation regarding the third process.

Completed Curving Component 800

Figure 27:
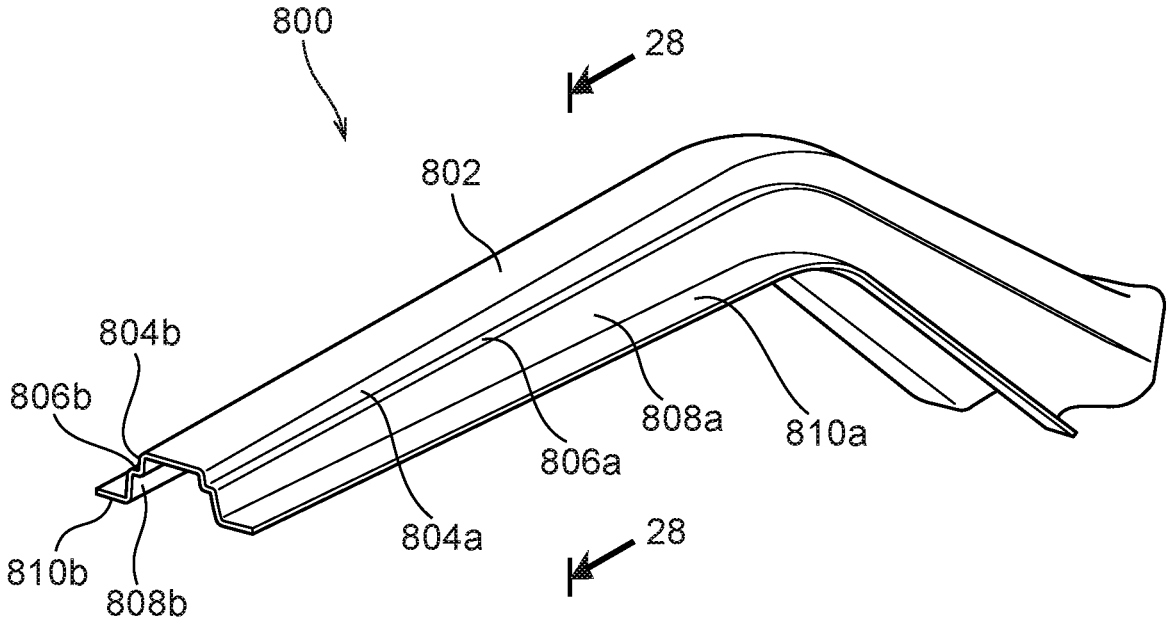
FIG. 27 is a perspective view illustrating an example of a completed curving component that has been processed by a third process of a hat-shaped cross-section component manufacturing method according to the present exemplary embodiment.
Figure 28:
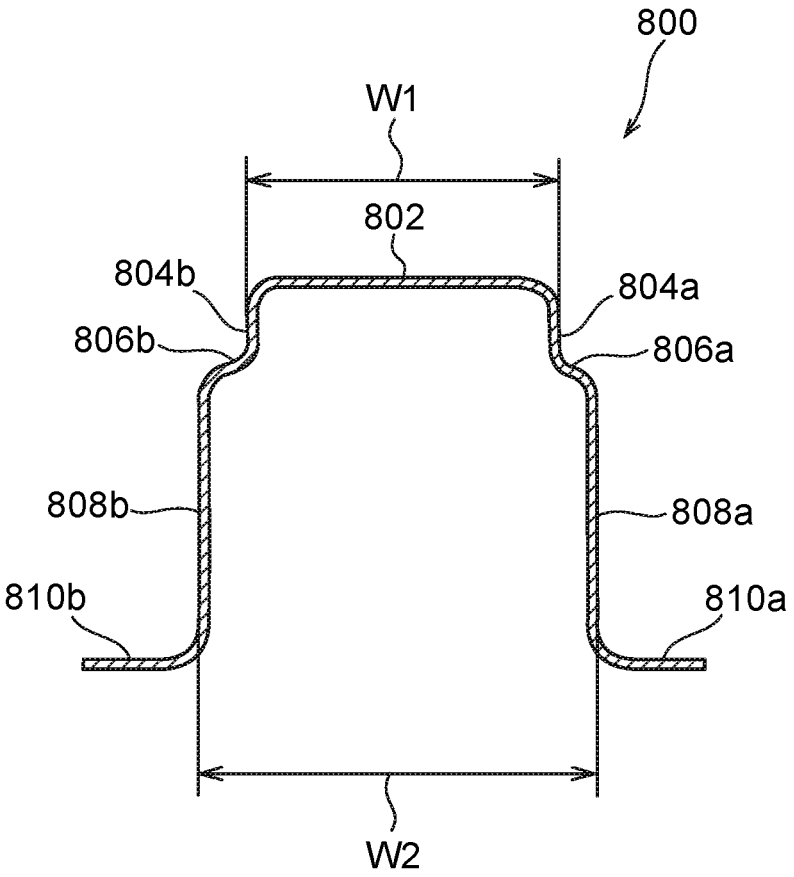
FIG. 28 is a cross-section (a cross-section taken along line 28-28 in FIG. 27) viewed along the length direction illustrating an example of a completed curving component that has been processed by a third process of a hat-shaped cross-section component manufacturing method according to the present exemplary embodiment.

As illustrated in FIG. 27 and FIG. 28, the completed curving component 800 is formed in an elongated shape with a hat-shaped cross-section. Specifically, the completed curving component 800 is configured including a top plate 802 extending along the length direction, a pair of first vertical walls 804*a*, 804*b* respectively extending from both width direction ends of the top plate 802 toward the lower side (one sheet thickness direction side of the top plate 802), a pair of horizontal walls 806*a*, 806*b* respectively extending from leading ends of the first vertical walls 804*a*, 804*b* toward the width direction outside of the top plate 802, a pair of second vertical walls 808*a*, 808*b* respectively extending from leading ends of the horizontal walls 806*a*, 806*b* toward the lower side, and a pair of flanges 810*a*, 810*b* respectively extending from leading ends of the second vertical walls 808*a*, 808*b* toward the width direction outside of the top plate 802. Namely, the portions to the width direction outside of the top plate 802 on the completed curving component 800 are each formed with a stepped shape by the first vertical walls 804*a*, 804*b* and the horizontal walls 806*a*, 806*b*.

Figure 29A:
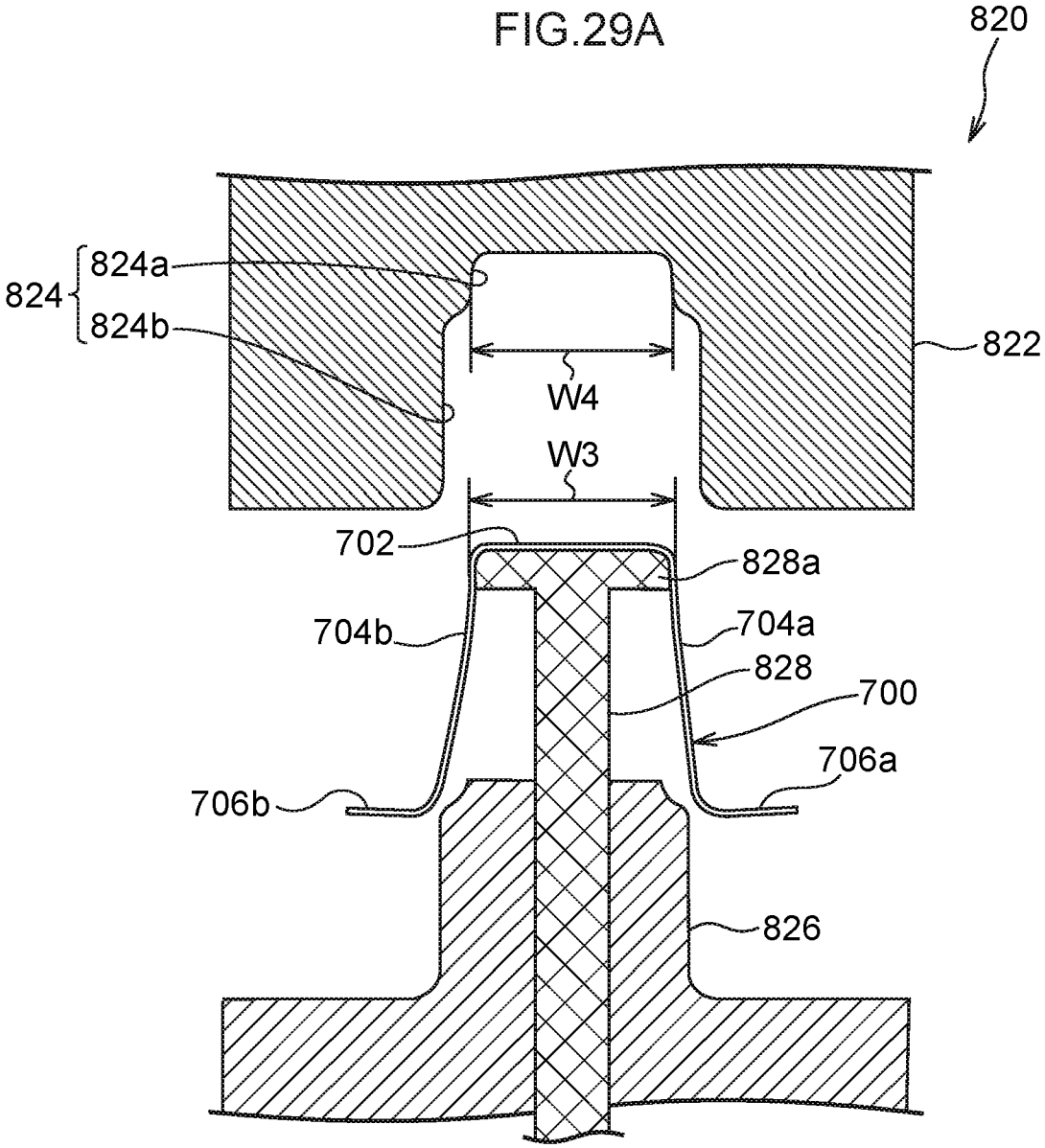
FIG. 29A is a cross-section illustrating a stage at which a top plate of an intermediate curving component is supported from an apparatus lower side by a support member in a manufacturing apparatus employed in a third process.

A width dimension W1 (see FIG. 28) of outer surface sides at the locations of the first vertical walls 804*a*, 804*b* of the completed curving component 800 is set as the same dimension as a width dimension W3 (see FIG. 29A) of the outer surface sides of the intermediate curving component 700. However, a width dimension W2 of the outer surface sides at the locations of the second vertical walls 808*a*, 808*b* of the completed curving component 800 is set larger than the width dimension W3 of the outer surface sides of the intermediate curving component 700. Namely, in the third process, the intermediate curving component 700 is restruck so as to increase the width dimension W3 on the opening side of the intermediate curving component 700, thereby forming the completed curving component 800, and raising the dimensional precision of the completed curving component 800.

Manufacturing Apparatus 820

As illustrated in FIG. 29A to FIG. 29D, the manufacturing apparatus 820 is configured including a restriking die 822 (referred to below as simply the "die 822") configuring an apparatus upper side portion of the manufacturing apparatus 820, and a restriking punch 826 (referred to below as simply the "punch 826") configuring an apparatus lower side portion of the manufacturing apparatus 820.

The die 822 is formed with a forming recess 824 opening toward the apparatus lower side, and the forming recess 824 extends along the length direction of the die 822 corresponding to the length direction of the intermediate curving component 700. The forming recess 824 is configured including a first recess portion 824*a* configuring a portion on a top face side (apparatus upper side) of the forming recess 824, and a second recess portion 824*b* configuring a portion on an opening side (apparatus lower side) of the forming recess 824. A width dimension of the second recess portion 824*b* is set larger than the width dimension of the first recess portion 824*a*.

The first recess portion 824*a* is formed with a shape corresponding to the outer surfaces of the top plate 702 and upper parts of the vertical walls 704*a*, 704*b* of the intermediate curving component 700. Namely, a top face of the first recess portion 824*a* is curved corresponding to the top plate 702 of the intermediate curving component 700, and a width dimension W4 (see FIG. 29A) of the first recess portion 824*a* is set substantially the same as the width dimension W3 (see FIG. 29A) of the intermediate curving component 700. Although explained in more detail later, in the third process, the intermediate curving component 700 is restruck in a state in which an upper portion (a portion on the top plate 702 side) of the intermediate curving component 700 is fitted inside the first recess portion 824*a* (see FIG. 29B).

The second recess portion 824*b* is formed with a shape corresponding to the horizontal walls 806*a*, 806*b* and the second vertical walls 808*a*, 808*b* of the completed curving component 800. Namely, inner peripheral faces of the second recess portion 824*b* configure forming faces corresponding to the profile of outer surfaces of the respective horizontal walls 806*a*, 806*b* and the second vertical walls 808*a*, 808*b* of the completed curving component 800. Moreover, the die 822 is coupled to a mover device (not illustrated in the drawings) configured similarly to the mover device 509 of the manufacturing apparatus 500. Actuating the mover device moves the die 822 in the apparatus up-down direction.

The punch 826 is disposed at the apparatus lower side of the die 822, and extends along the length direction of the die 822. The punch 826 has a projecting shape projecting out toward the side of the forming recess 824 of the die 822, and faces the forming recess 824 in the apparatus up-down direction. Outer faces of the punch 826 configure forming faces corresponding to the profile of the respective inner surfaces of the horizontal walls 806*a*, 806*b* and the second vertical walls 808*a*, 808*b* of the completed curving component 800.

A support member 828 for supporting the top plate 702 of the intermediate curving component 700 is provided at a width direction central portion of the punch 826. The support member 828 extends along the length direction of the punch 826 so as to support the top plate 702 continuously along the length direction of the top plate 702. The support member 828 is disposed at the apparatus lower side of the forming recess 824 of the die 822, and is capable of extending toward the apparatus upper side from the punch 826. Specifically, the support member 828 is, for example, coupled to a support member press device (not illustrated in the drawings) such a gas cushion, a hydraulic drive, a spring, or an electric drive mechanism. Actuating the support member press device extends the support member 828 from the punch 826 toward the apparatus upper side.

The support member 828 is formed with a substantially T-shaped profile as viewed along the length direction. In other words, an upper portion of the support member 828 is formed with portions jutting out toward the width direction outside. The upper portion of the support member 828 configures a support portion 828*a*. In a non-actuated state of the support member press device, the support portion 828*a* is disposed adjacent to the punch 826 at the apparatus upper side. The support portion 828*a* is also formed with a shape corresponding to the inner surface side of the top plate 702 and upper portions of the pair of vertical walls 704*a*, 704*b* of the intermediate curving component 700. Namely, an upper face of the support portion 828*a* is curved corresponding to the top plate 702, and a width dimension of the support portion 828*a* is set substantially the same as the width dimension of the inner surface side of the intermediate curving component 700. Although described in more detail later, in the third process, the support portion 828*a* is fitted inside the first recess portion 824*a* of the forming recess 824 of the die 822 together with the intermediate curving component 700 (see FIG. 29B). A height dimension of the support portion 828*a* is accordingly set smaller than a depth dimension of the first recess portion 824*a* by the amount of the sheet thickness dimension of the top plate 802.

Next, explanation follows regarding the third process for restriking the intermediate curving component 700 using the manufacturing apparatus 820.

First, the support member press device is actuated and the support member 828 extends from the punch 826 toward the apparatus upper side. In this state, the intermediate curving component 700 is set on the support portion 828*a* of the support member 828 from the apparatus upper side, and the top plate 702 of the intermediate curving component 700 is disposed on the upper face of the support portion 828*a* (see FIG. 29A). The entire top plate 702 of the intermediate curving component 700 is thereby supported from the apparatus lower side by the support member 828 (support process). Note that since the width dimension of the support portion 828*a* is set substantially the same as the width dimension of the inner surface side of the intermediate curving component 700, in this state, both width direction end portions of the support portion 828*a* abut the vertical walls 704*a*, 704*b* of the intermediate curving component 700, thereby restricting movement of the intermediate curving component 700 in the width direction with respect to the support member 828. Moreover, in this state, the extension length of the support member 828 when extended from the punch 826 is set as appropriate, such that leading end portions of the vertical walls 704*a*, 704*b* of the intermediate curving component 700 do not contact the punch 826.

Figure 29B:
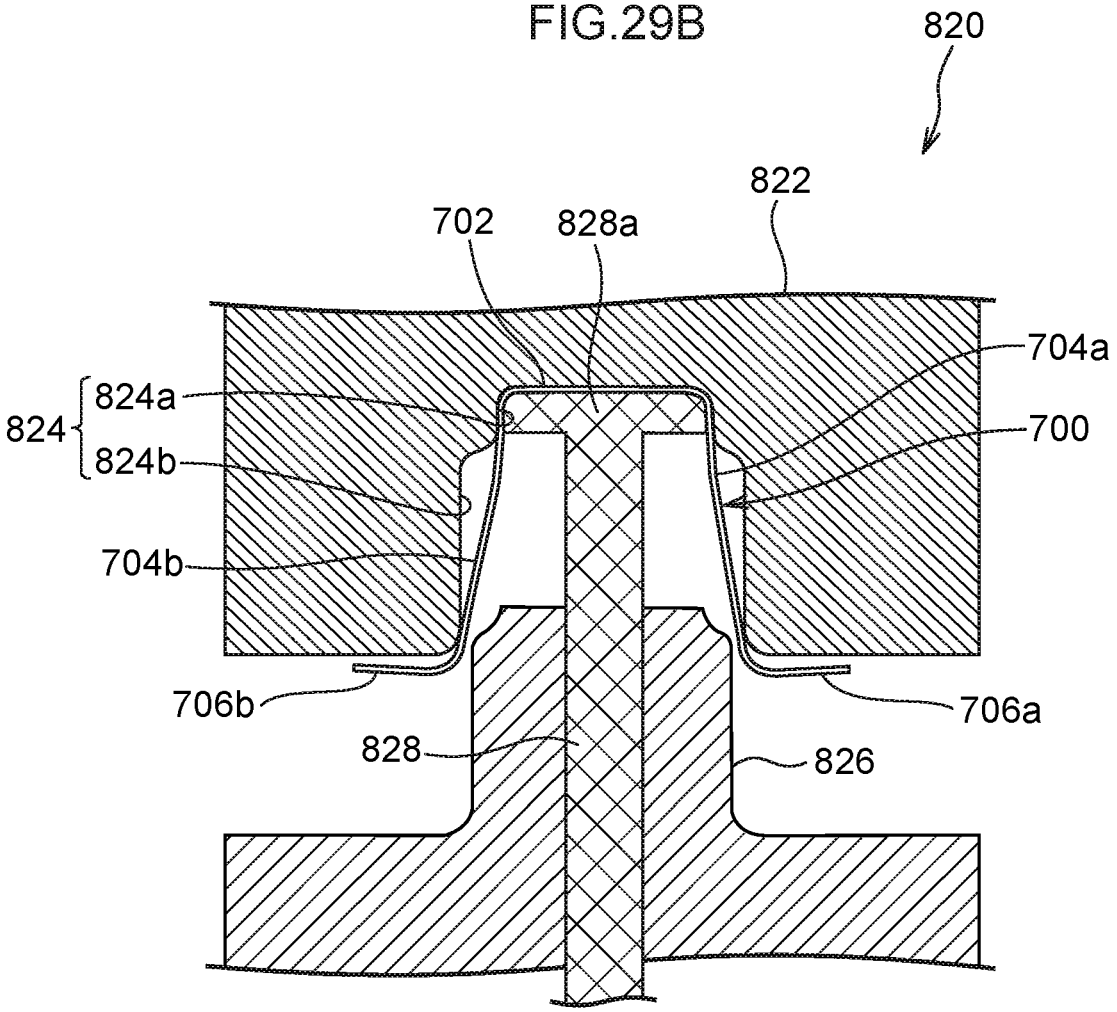
FIG. 29B is a cross-section illustrating a stage at which, from the stage illustrated in FIG. 29A, the top plate of the intermediate curving component has been fitted into a first recess portion of a die and is being gripped and restrained by the die and the support member.

Next, the mover device is actuated, moving the die 822 toward the apparatus lower side (the punch 826 side). The intermediate curving component 700 and the support member 828 are accordingly moved relatively together toward the apparatus upper side with respect to the die 822, and are inserted inside the forming recess 824 of the die 822. Then, as illustrated in FIG. 29B, the die 822 is lowered to a predetermined position, thereby fitting an upper portion of the intermediate curving component 700 and the support portion 828*a* inside the first recess portion 824*a* of the die 822 (positioning process). Since the width dimension W4 of the first recess portion 824*a* is set substantially the same as the width dimension W3 of the intermediate curving component 700, in this state, movement of the intermediate curving component 700 in the width direction is restricted by the first recess portion 824*a*. Accordingly, the top plate 702 of the intermediate curving component 700 is pressed and gripped by the support portion 828*a* and the die 822 in a state in which the intermediate curving component 700 has been positioned in the width direction by the first recess portion 824*a* at each portion along the length direction of the intermediate curving component 700.

Figure 29C:
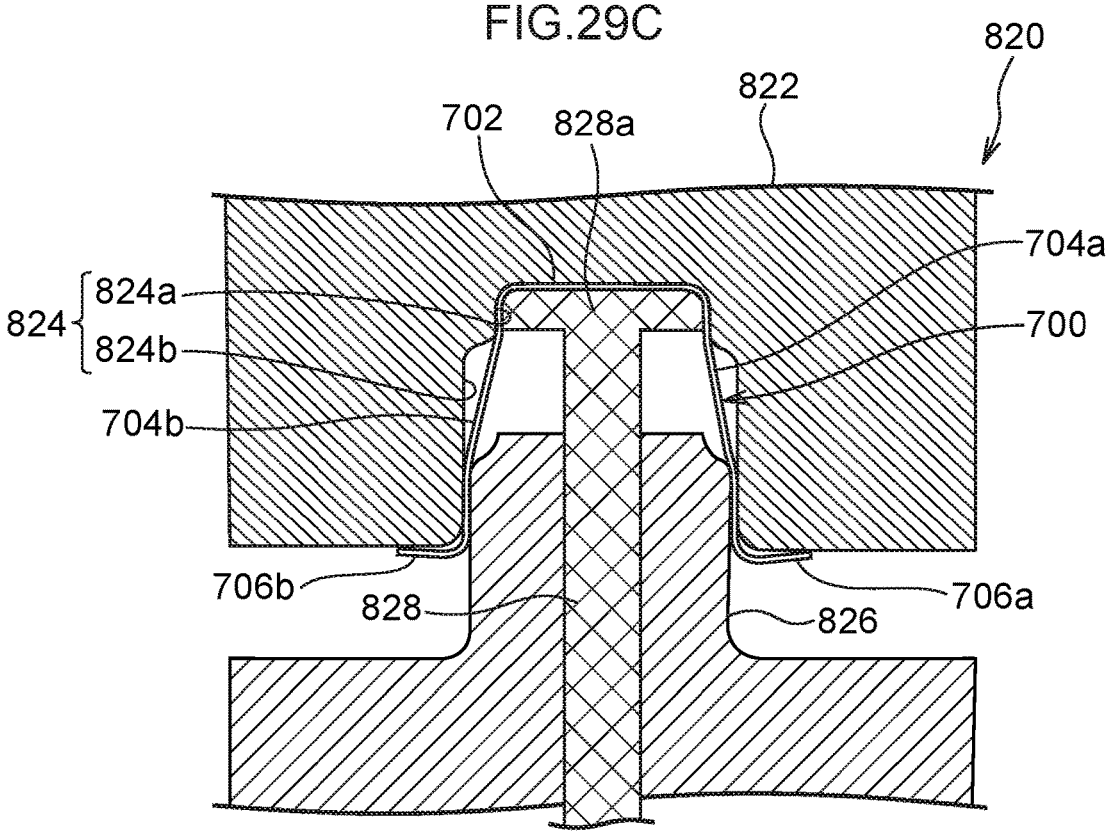
FIG. 29C is a cross-section illustrating a stage at which, from the stage illustrated in FIG. 29B, a punch has been pushed into a second recess portion of the die.

Then, as illustrated in FIG. 29C, the die 822 is moved further toward the apparatus lower side in a state in which the top plate 702 of the intermediate curving component 700 is gripped by the support portion 828*a* and the die 822. The punch 826 is thereby moved toward the apparatus upper side relative to the die 822, and is inserted inside the forming recess 824 of the die 822. The second vertical walls 808*a*, 808*b* of the completed curving component 800 are then formed by the punch 826 and the die 822. Note that the flanges 706*a*, 706*b* of the intermediate curving component 700 are free when the second vertical walls 808*a*, 808*b* of the completed curving component 800 are being formed by the punch 826 and the die 822. The free state of the flanges 706*a*, 706*b* of the intermediate curving component 700, refers to a state in which flanges 706*a*, 706*b* are no longer pressed and gripped by the die 822 and the punch 826 (or a holder or the like) when forming the second vertical walls 808*a*, 808*b*. As described later, the flanges 706*a*, 706*b* may be pressed and gripped by the punch 826 and the die 822 when forming of the intermediate curving component 700 has been completed.

Figure 29D:
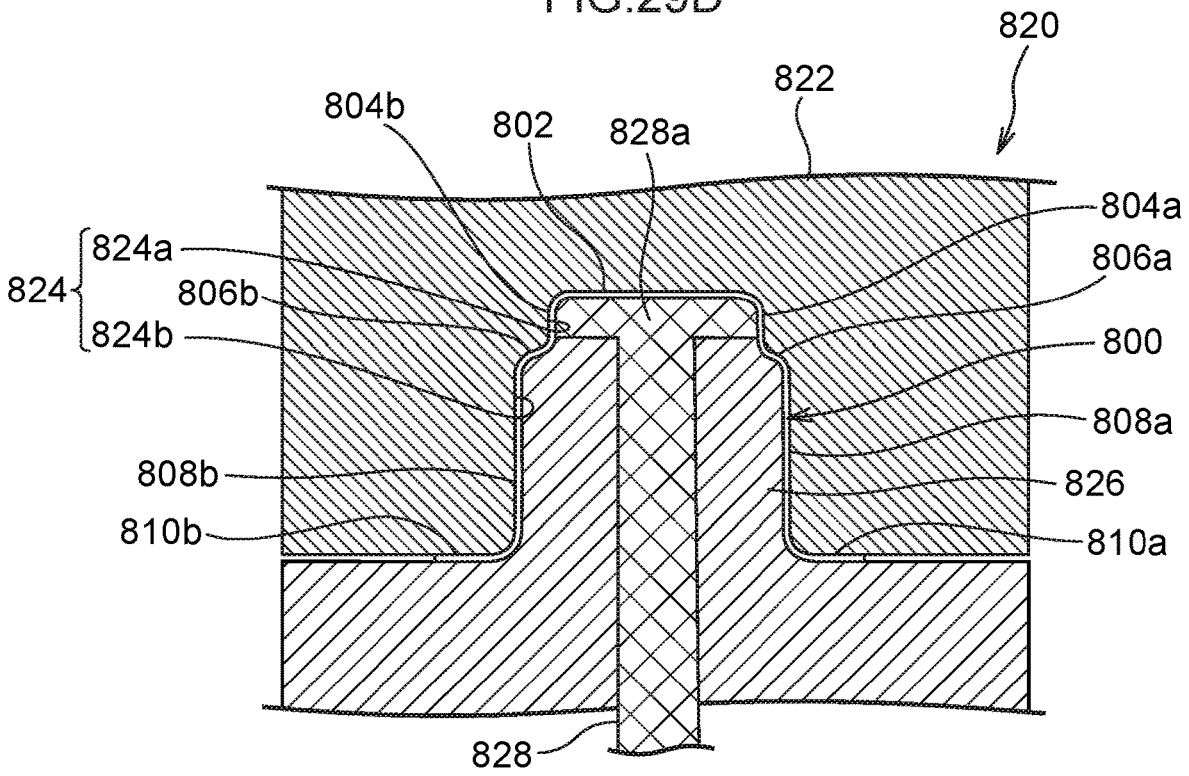
FIG. 29D is a cross-section illustrating a stage at which, from the stage illustrated in FIG. 29C, the punch has been pushed further into the second recess portion of the die, and the punch has been fully pushed in with respect to the die.

As illustrated in FIG. 29D, when the die 822 has reached a position at the end of its stroke, the horizontal walls 806*a*, 806*b* and the flanges 810*a*, 810*b* of the completed curving component 800 are formed by the punch 826 and the die 822 (forming process). The completed curving component 800 is thus formed such that the width dimension of the intermediate curving component 700 is widened toward the outside.

In the manufacturing apparatus 820 of the third process described above, the die 822 is moved relatively toward the side of the punch 826 and the support member 828 to restrike the intermediate curving component 700. However, the configuration of the manufacturing apparatus 820 is not limited thereto. For example, the punch 826 and the support member 828 may be moved relatively toward the side of the die 822 to restrike the intermediate curving component 700. In such cases, the punch 826 and the support member 828 and die 822 may be disposed with their positional relationships reversed in the apparatus up-down direction. Namely, the punch 826 and the support member 828 may be disposed at the apparatus upper side of the die 822.

The manufacturing apparatus 820 may also be configured as in the following modified examples.

Manufacturing Apparatus 820: Modified Example 1

Figure 30A:
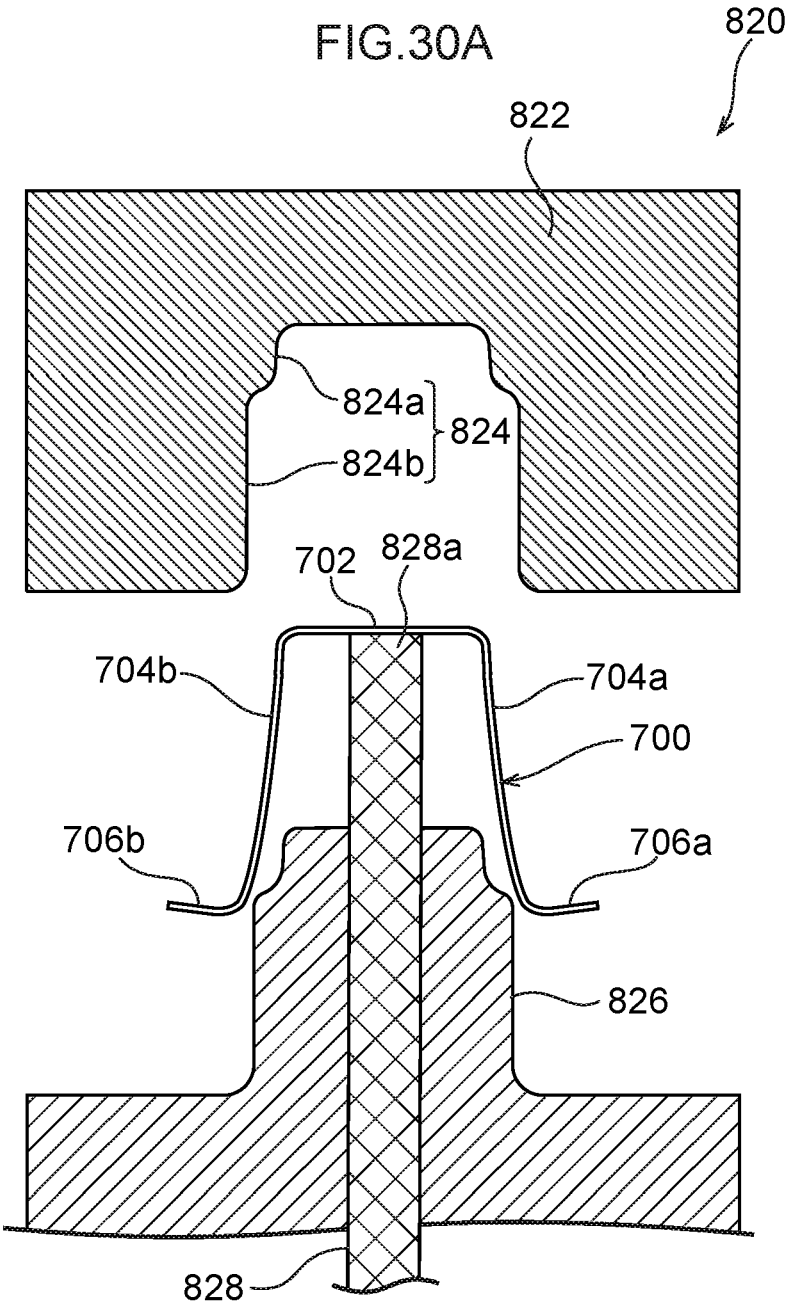
FIG. 30A is a cross-section illustrating a stage at which a top plate of an intermediate curving component is supported from an apparatus lower side by a support member in another manufacturing apparatus employed in a third process.
Figure 30B:
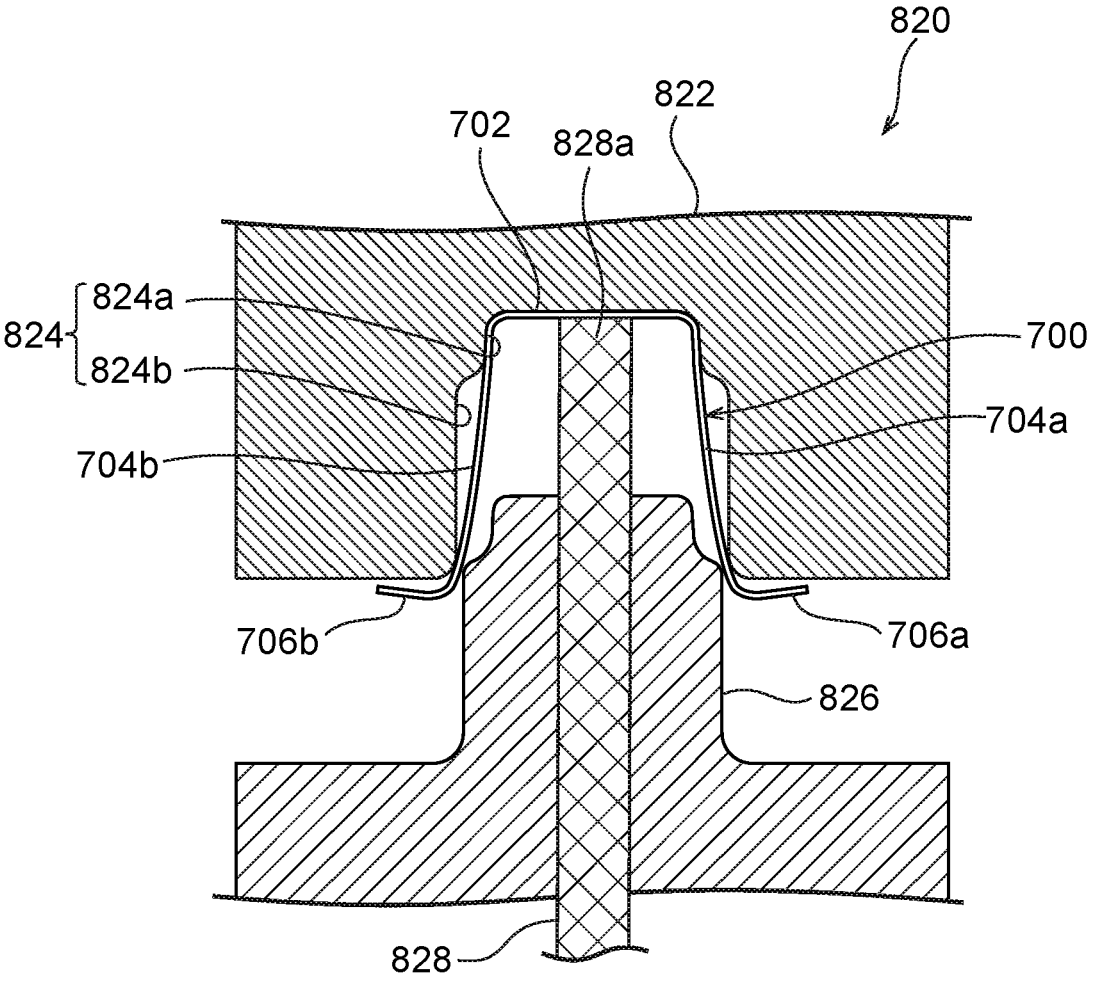
FIG. 30B is a cross-section illustrating a stage at which, from the stage illustrated in FIG. 30A, the top plate of the intermediate curving component has been fitted into a first recess portion of a die and is being gripped and restrained by the die and the support member.
Figure 30C:
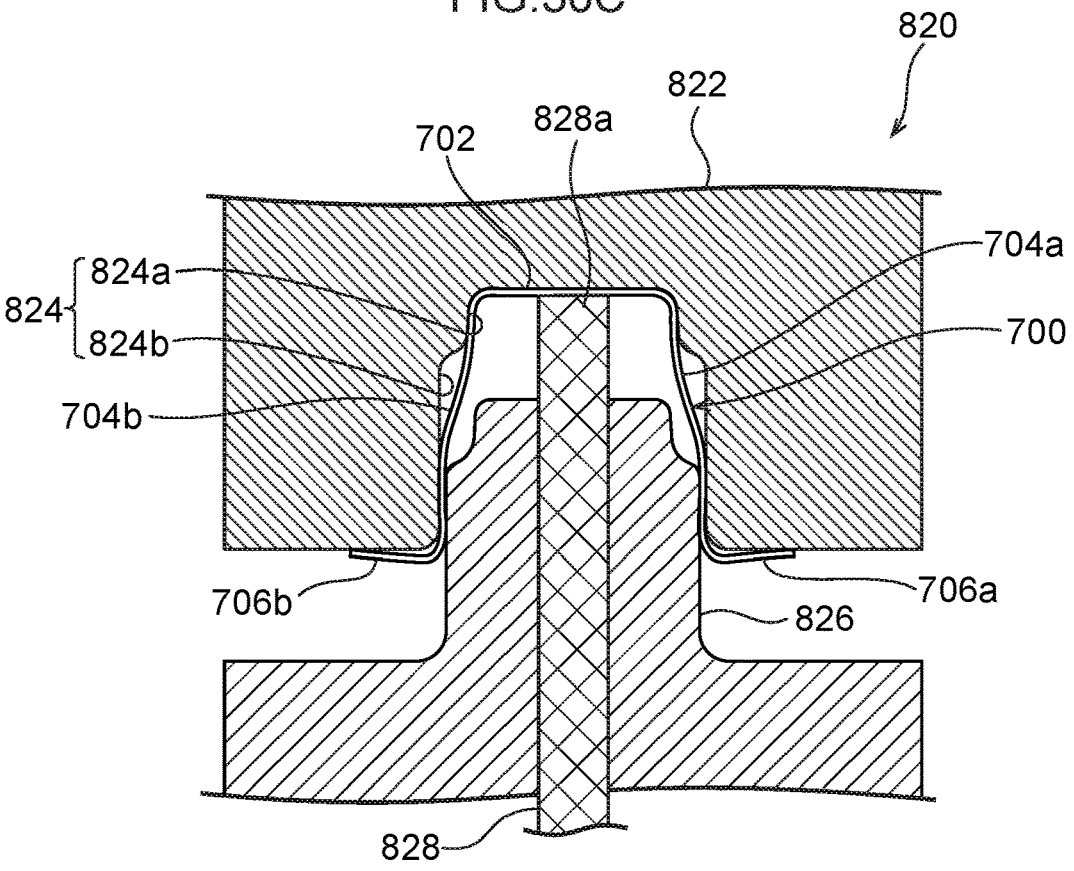
FIG. 30C is a cross-section illustrating a stage at which, from the stage illustrated in FIG. 30B, a punch has been pushed into a second recess portion of the die.
Figure 30D:
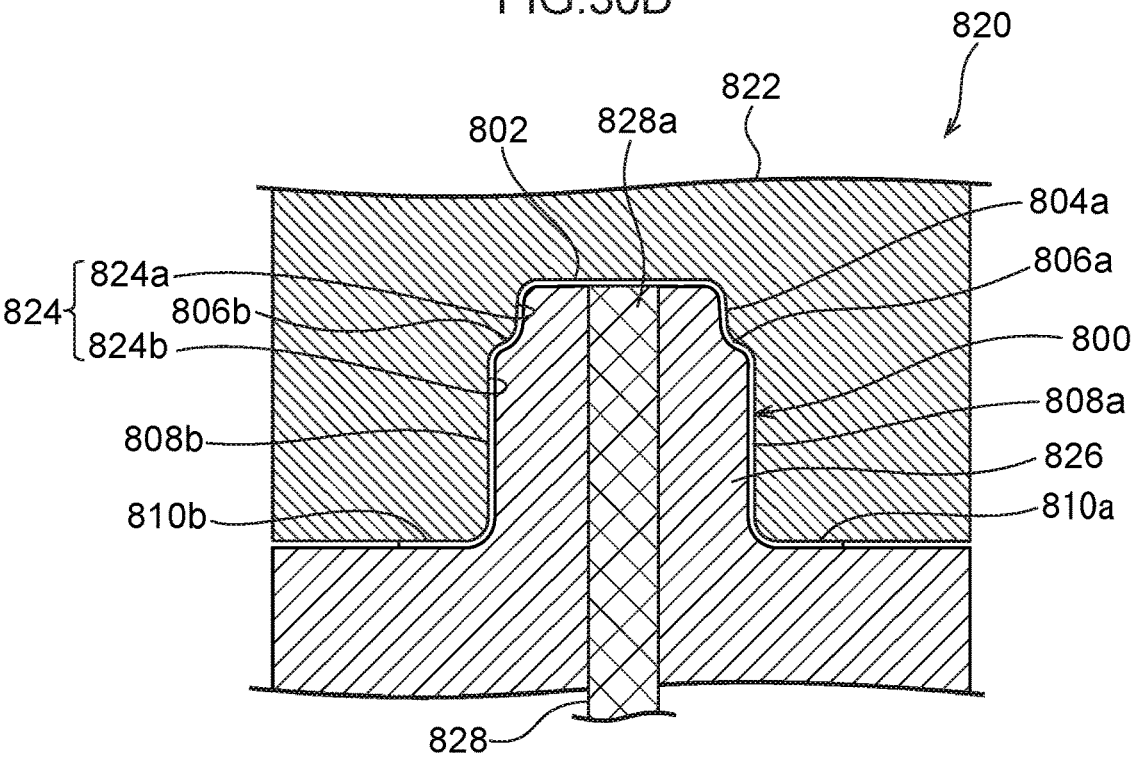
FIG. 30D is a cross-section illustrating a stage at which, from the stage illustrated in FIG. 30C, the punch has been pushed further into the second recess portion of the die, and the punch has been fully pushed in with respect to the die.

As illustrated in FIG. 30A to FIG. 30D, in Modified Example 1, the support member 828 of the manufacturing apparatus 820 extends in the apparatus up-down direction as viewed along the length direction of the punch 826, and the support portion 828*a* of the support member 828 does not jut out toward the width direction outside. Accordingly, as illustrated in FIG. 30A, when the top plate 702 of the intermediate curving component 700 is supported from the apparatus lower side by the support member 828, the support portion 828*a* supports a width direction central portion of the top plate 702. Moving the die 822 toward the punch 826 side fits the top plate 702 of the intermediate curving component 700 inside the first recess portion 824*a* of the die 822 (see FIG. 30B). Moving the die 822 further toward the punch 826 side restrikes the intermediate curving component 700 with the die 822 and the punch 826 (see FIG. 30C and FIG. 30D).

Manufacturing Apparatus 820: Modified Example 2

As illustrated in FIG. 31A to FIG. 31D, in Modified Example 2, a housing recess 830 opening toward the apparatus lower side is formed in the top face of the first recess portion 824*a* of the die 822. The die 822 is provided with a restriking pad 832 configuring part of the die 822, and the restriking pad 832 is coupled to a pad press unit (not illustrated in the drawings) configured similarly to the pad press unit 506 of the first process. In a non-actuated state of the pad press unit, the restriking pad 832 is housed in the housing recess 830. When the pad press unit is actuated, the restriking pad 832 extends from the die 822 toward the apparatus lower side, and presses the outer surface of the top plate 702 of the intermediate curving component 700.

Figure 31A:
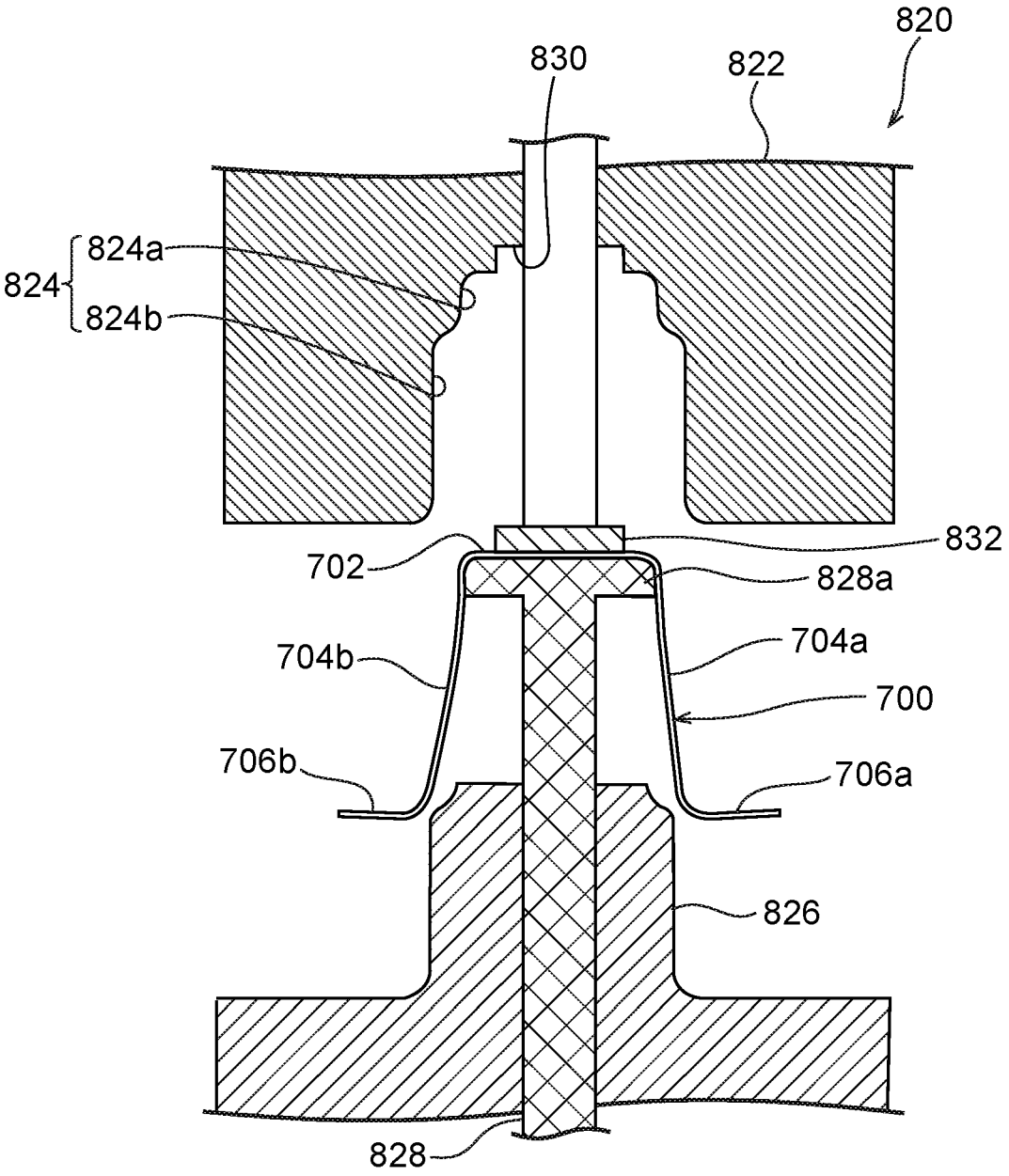
FIG. 31A is a cross-section illustrating a stage at which a top plate of an intermediate curving component is supported from an apparatus lower side by a support member in another manufacturing apparatus employed in a third process.
Figure 31B:
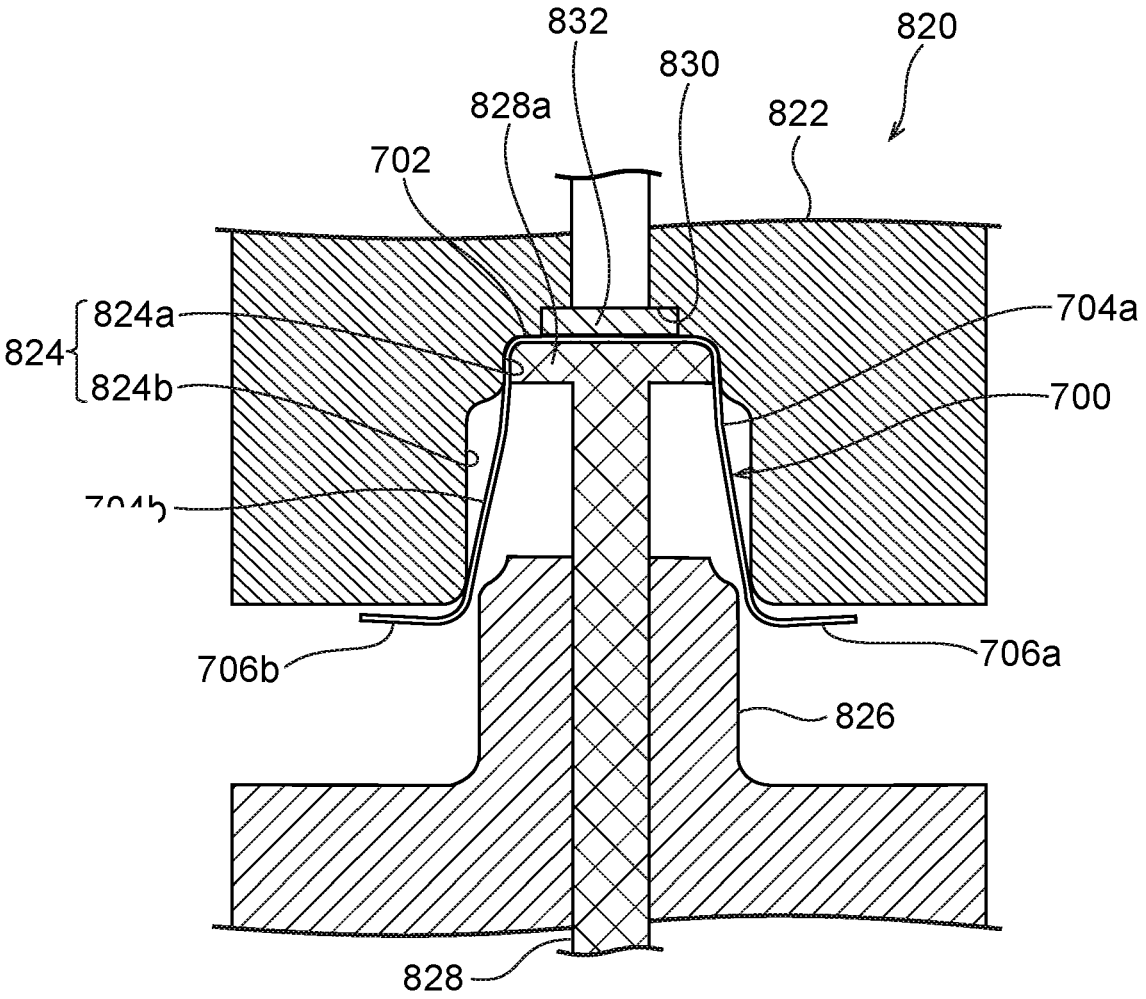
FIG. 31B is a cross-section illustrating a stage at which, from the stage illustrated in FIG. 31A, the top plate of the intermediate curving component has been fitted into a first recess portion of a die and is being gripped and restrained by the die and the support member.
Figure 31C:
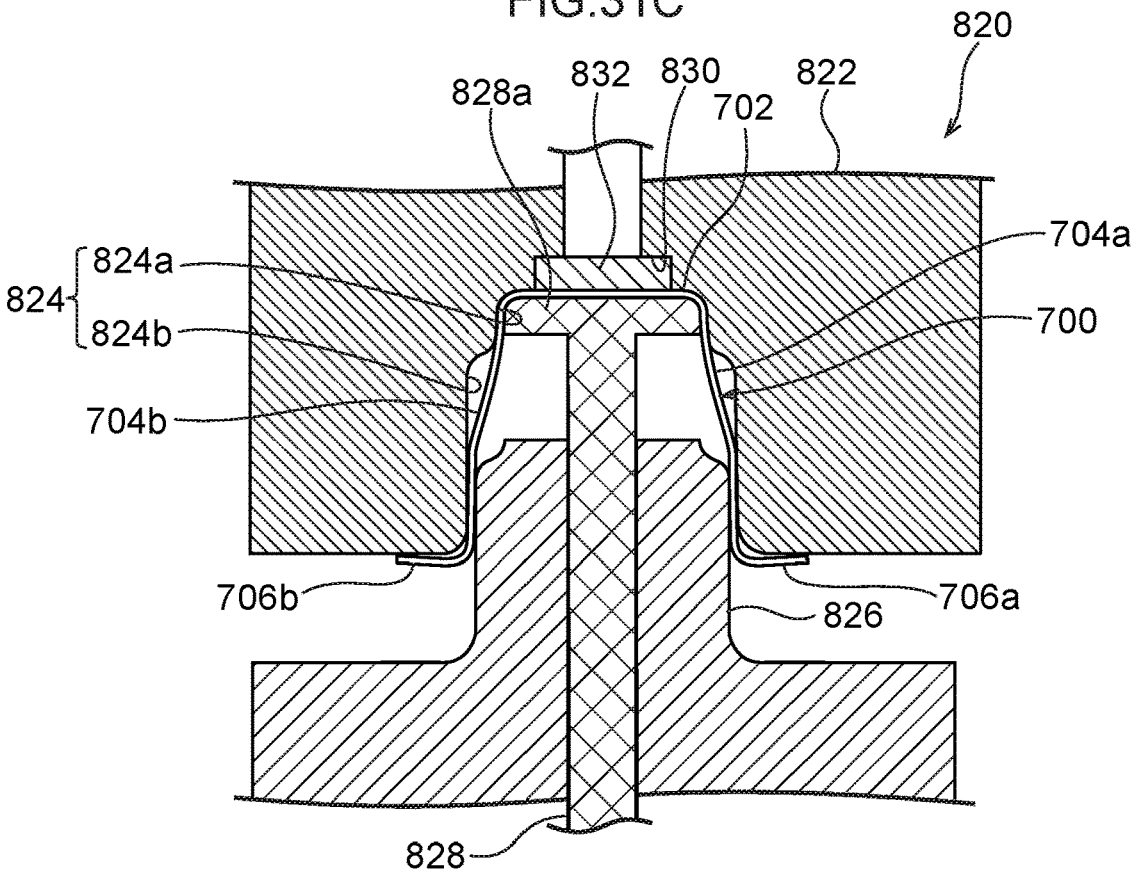
FIG. 31C is a cross-section illustrating a stage at which, from the stage illustrated in FIG. 31B, a punch has been pushed into a second recess portion of the die.
Figure 31D:
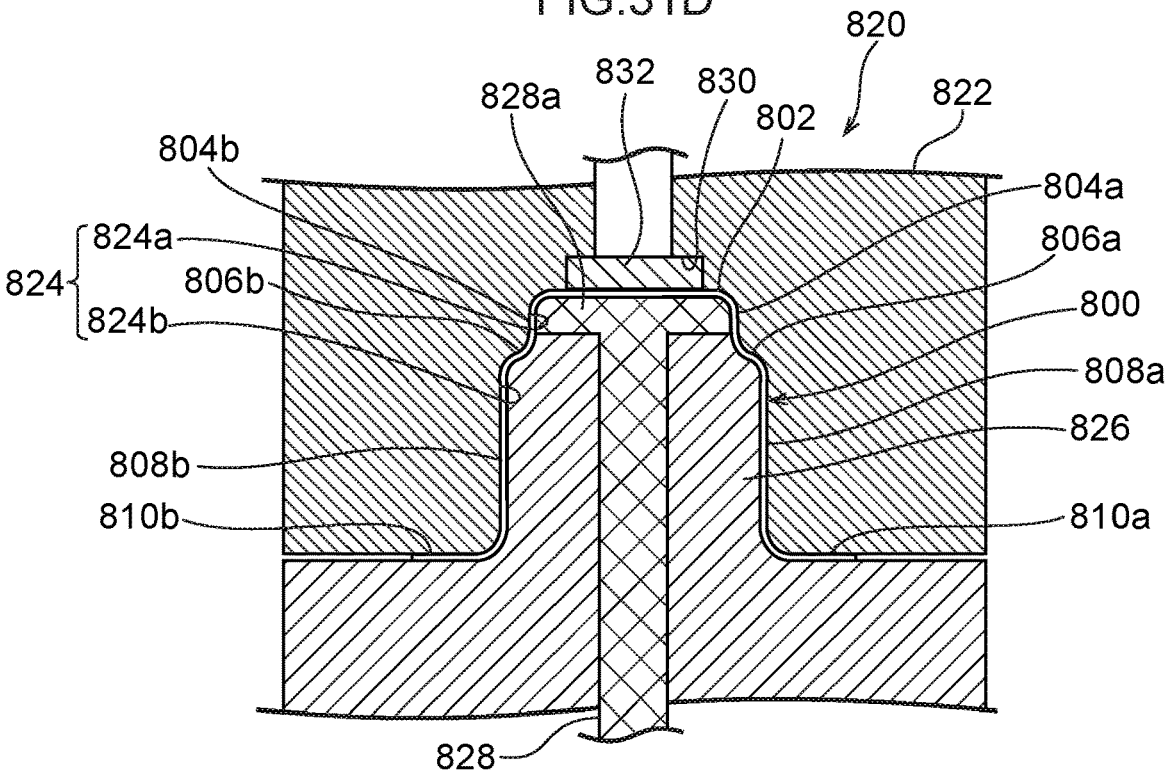
FIG. 31D is a cross-section illustrating a stage at which, from the stage illustrated in FIG. 31C, the punch has been pushed further into the second recess portion of the die, and the punch has been fully pushed in with respect to the die.
Figure 32A:
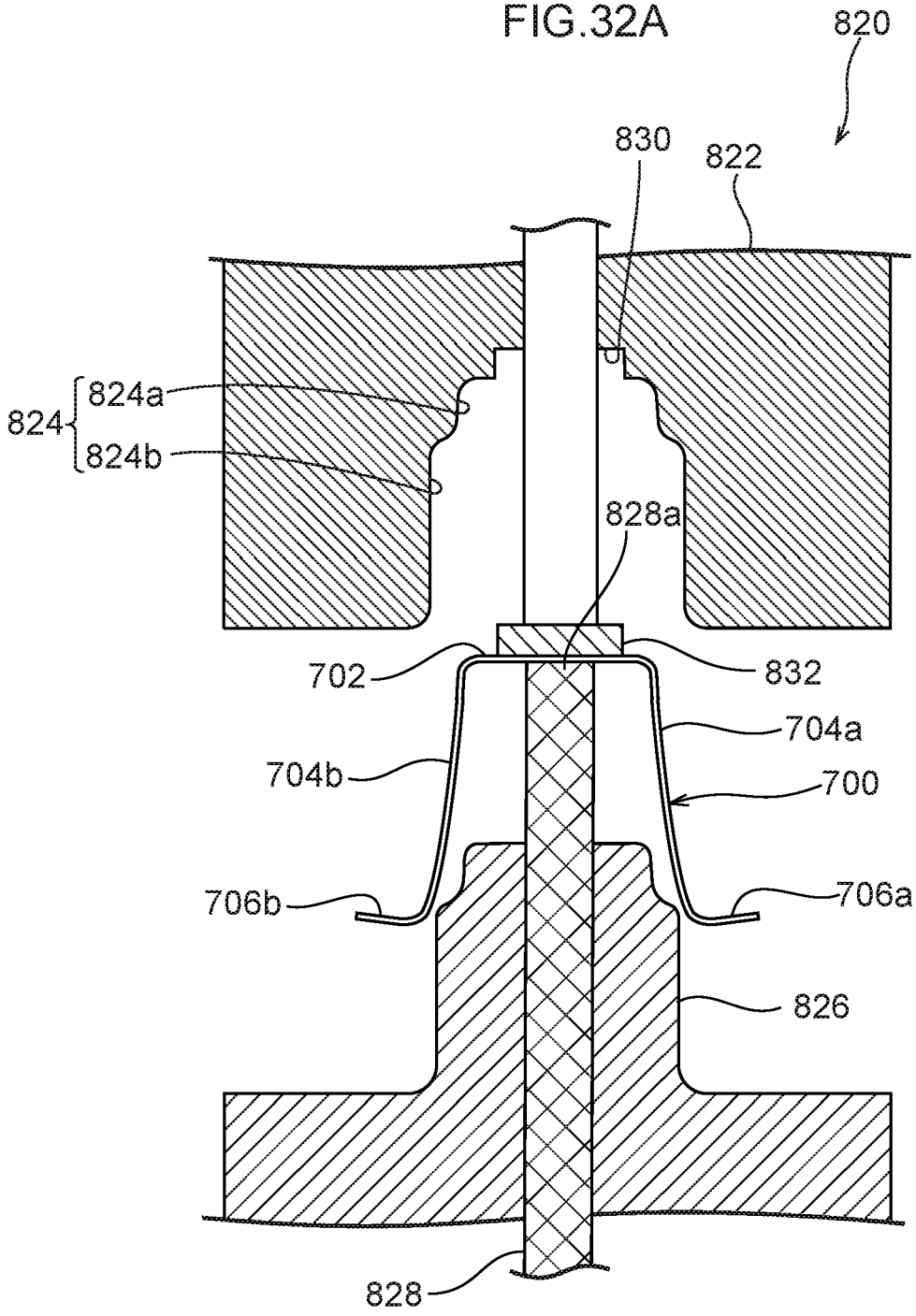
FIG. 32A is a cross-section corresponding to FIG. 31A, illustrating a stage at which a top plate of an intermediate curving component is supported from an apparatus lower side by a support member in another manufacturing apparatus employed in a third process.
Figure 32B:
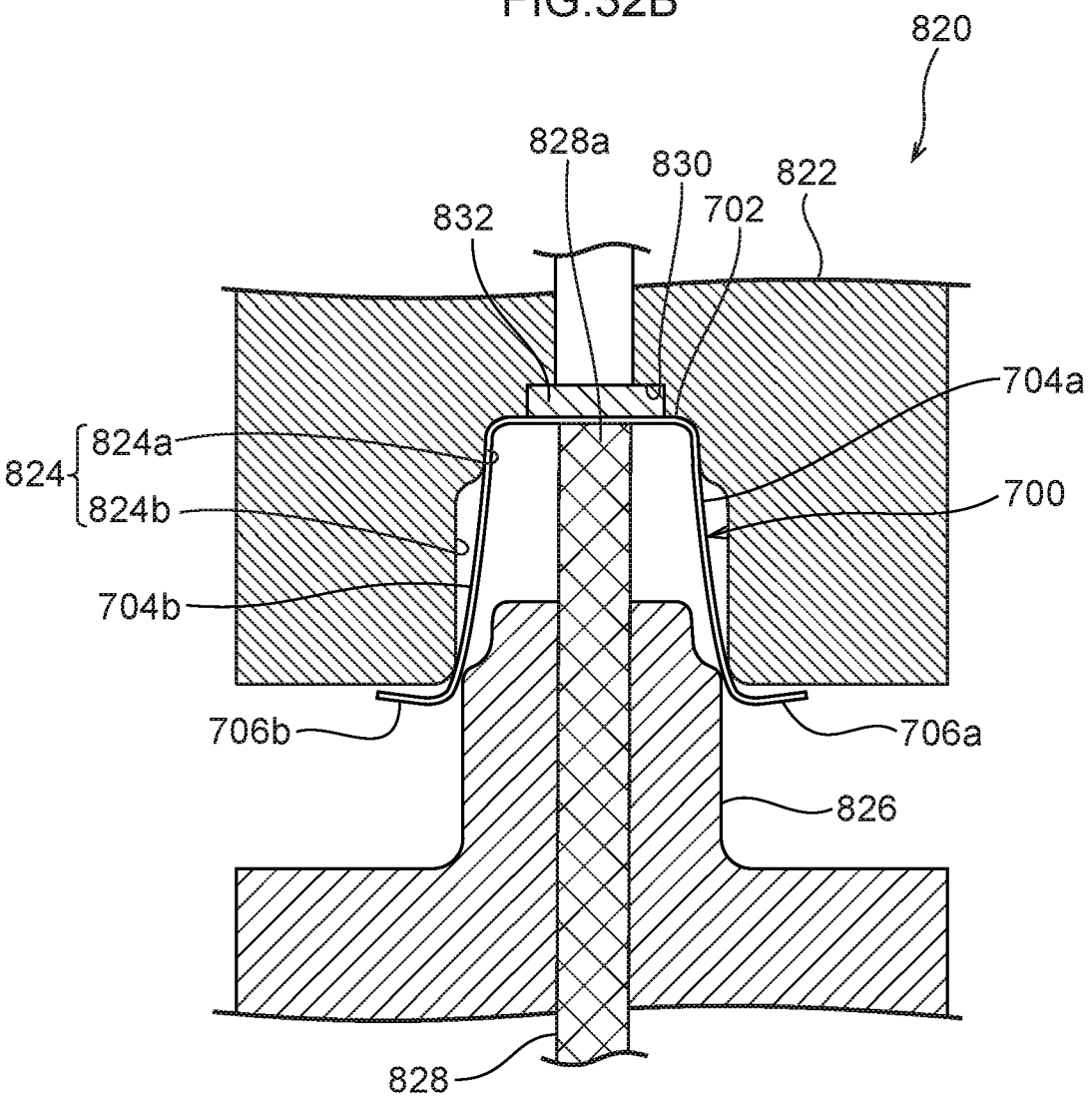
FIG. 32B is a cross-section corresponding to FIG. 31B, illustrating a stage at which, from the stage illustrated in FIG. 32A, the top plate of the intermediate curving component has been fitted into a first recess portion of a die and is being gripped and restrained by the die and the support member.
Figure 32C:
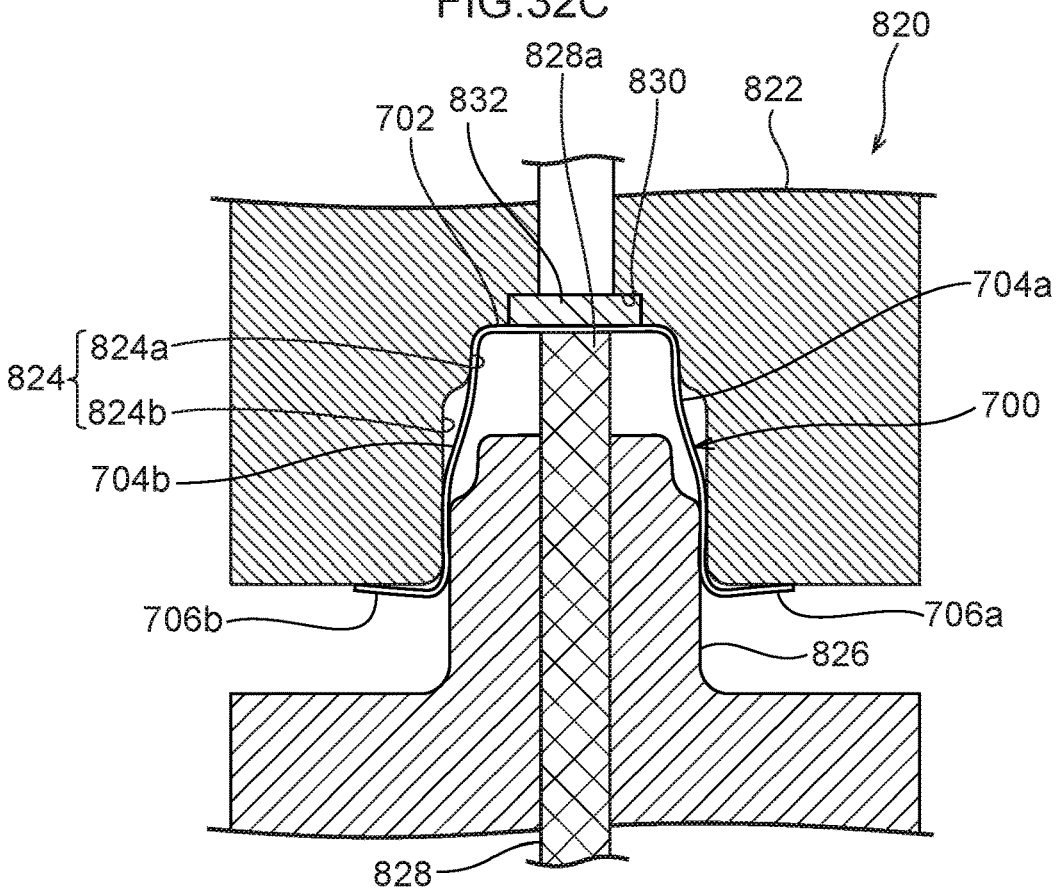
FIG. 32C is a cross-section corresponding to FIG. 31C, illustrating a stage at which, from the stage illustrated in FIG. 32B, a punch has been pushed into a second recess portion of the die.
Figure 32D:
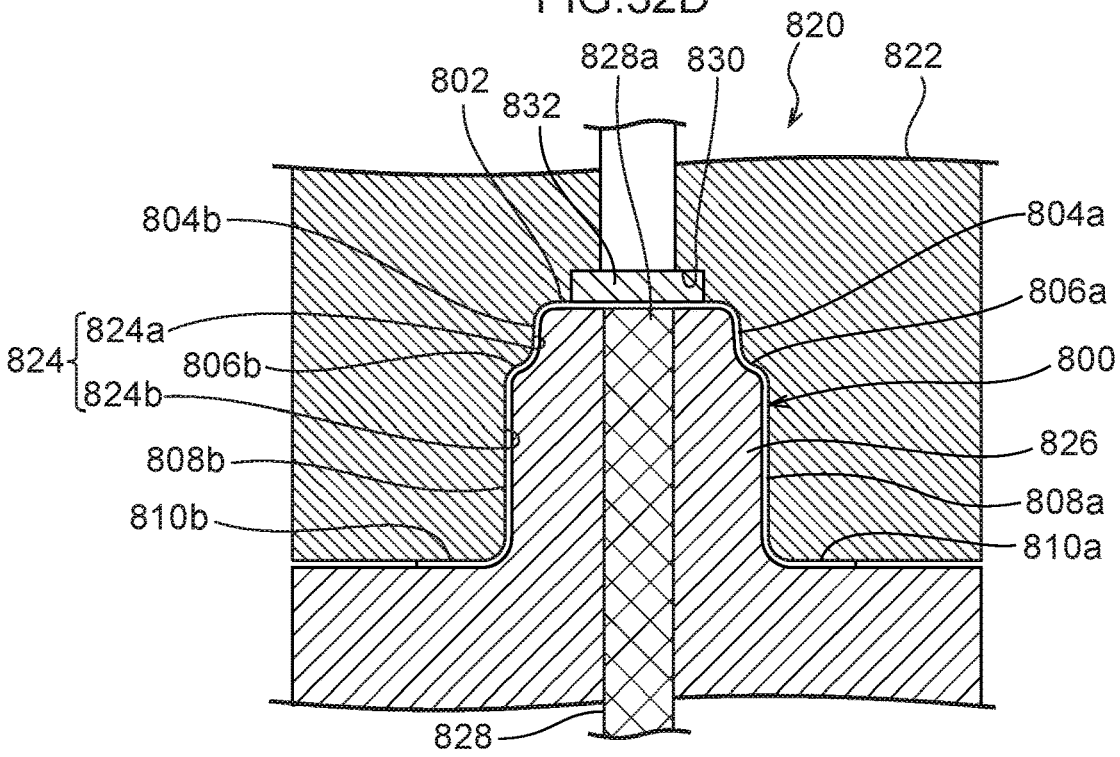
FIG. 32D is a cross-section corresponding to FIG. 31D, illustrating a stage at which, from the stage illustrated in FIG. 32C, the punch has been pushed further into the second recess portion of the die, and the punch has been fully pushed in with respect to the die.

Then, as illustrated in FIG. 31A, when the top plate 702 of the intermediate curving component 700 is supported by the support member 828, the top plate 702 is pressed and gripped between the restriking pad 832 and the support member 828. Relative movement of the intermediate curving component 700 toward the apparatus upper side with respect to the support member 828 is accordingly limited by the restriking pad 832. The die 822 is then moved toward the punch 826 side, such that the restriking pad 832 is housed in the housing recess 830, and the top plate 702 of the intermediate curving component 700 is fitted inside the first recess portion 824*a* of the die 822 while the top plate 702 of the intermediate curving component 700 is being gripped by the restriking pad 832 and the support member 828 (see FIG. 31B). Accordingly, in Modified Example 2, the intermediate curving component 700 is fitted inside the first recess portion 824*a* while maintaining a good supported state of the intermediate curving component 700 by the support member 828. The intermediate curving component 700 is then restruck by the die 822 and the punch 826 by moving the die 822 further toward the punch 826 side (see FIG. 31C and FIG. 31D).

In Modified Example 2, as described above, the upper portion of the intermediate curving component 700 is fitted inside the first recess portion 824*a* while the top plate 702 of the intermediate curving component 700 is gripped with the restriking pad 832 and the support member 828. In order to achieve this, the load of the restriking pad 832 toward the apparatus lower side is set lower than the load of the support member 828 toward the apparatus upper side, and the restriking pad 832 moves relatively so as to retract with respect to the die 822 accompanying the movement of the die 822 toward the apparatus lower side. Moreover, as illustrated in FIG. 32A to FIG. 32D, in the Modified Example 2, the shape of the support member 828 may be configured with a similar shape to the support member 828 in Modified Example 1. Namely, the top plate 702 of the intermediate curving component 700 may be gripped by the support member 828 and the restriking pad 832 while supporting a width direction central portion of the top plate 702 from the apparatus lower side using the support member 828.

Operation and Advantageous Effects of Present Exemplary Embodiment, Suitable Values for Various Parameters etc.

Next, explanation follows regarding operation and advantageous effects of the present exemplary embodiment, and suitable values for various parameters etc.

As described above, in the first process of the present exemplary embodiment, during formation of the vertical walls 501*a*, 501*b* of the preliminary curving component 501 by the manufacturing apparatus 500, the portion of the metal stock sheet 601 that will form the top plate 501*c* is pressed and gripped by the pad 503 and the punch 504. Thus, as long as the pressing force is sufficient, the portion of the metal stock sheet 601 that will form the top plate 501*c* cannot be deformed in its thickness direction during the forming process, enabling the occurrence of creases at this portion to be suppressed. Moreover, the portions of the metal stock sheet 601 that will form the flanges 501*d*, 501*e* are also pressed and gripped by the blank holders 505 and the die 502, such that as long as the pressing force is sufficient, the portions of the metal stock sheet 601 that will form the flanges 501*d*, 501*e* cannot be deformed in the thickness direction, enabling the occurrence of creases at these portions to be suppressed.

However, if the above pressing forces are insufficient, deformation of the metal stock sheet 601 in the thickness direction cannot be prevented, and creases will occur at the portion of the metal stock sheet 601 that will form the top plate 501*c* and at the portions of the metal stock sheet 601 that will form the flanges 501*d*, 501*e*. The sheet thickness employed in structural members configuring the automotive vehicle body framework (such as front side members) is generally from 0.8 mm to 3.2 mm. The above pressing forces are preferably 0.1 MPa or greater when forming a steel sheet with tensile strength of from 200 MPa to 1960 MPa using the hat-shaped cross-section component manufacturing apparatus 500 illustrated in FIG. 5 to FIG. 6D.

Figure 33A:
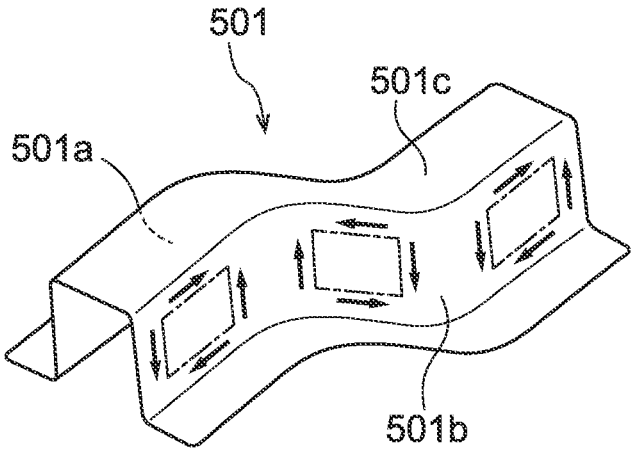
FIG. 33A is a perspective view of a preliminary curving component, schematically illustrating stress occurring in vertical walls.

FIG. 33A illustrates stress arising in the vertical walls 501*a*, 501*b* of the preliminary curving component 501. FIG.

Figure 33B:
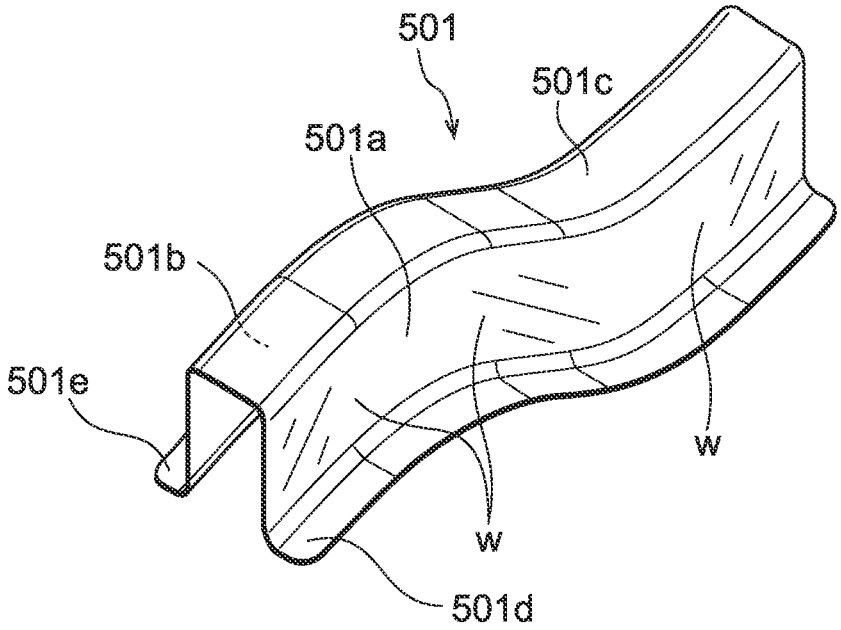
FIG. 33B is a perspective view of the preliminary curving component, illustrating shear creasing occurring in the vertical walls.
Figure 33C:
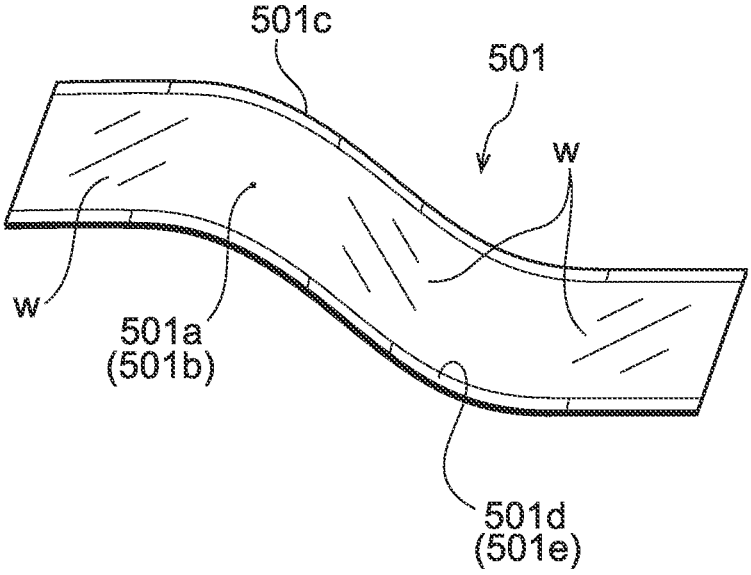
FIG. 33C is a side view of the preliminary curving component, illustrating shear creasing occurring in the vertical walls.
Figure 34A:
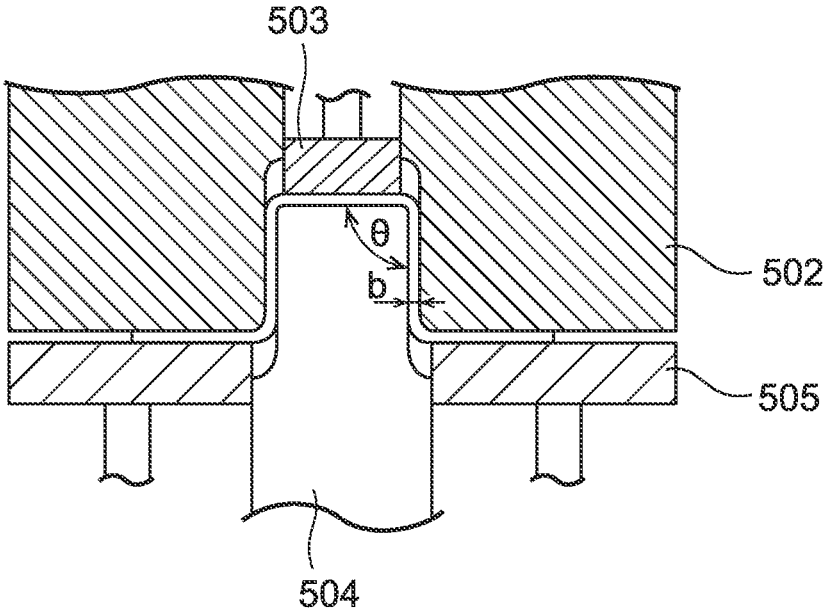
FIG. 34A is a cross-section of a manufacturing apparatus to explain the dimensions and the like of respective portions in order to prevent the occurrence of shear creasing.
Figure 34B:
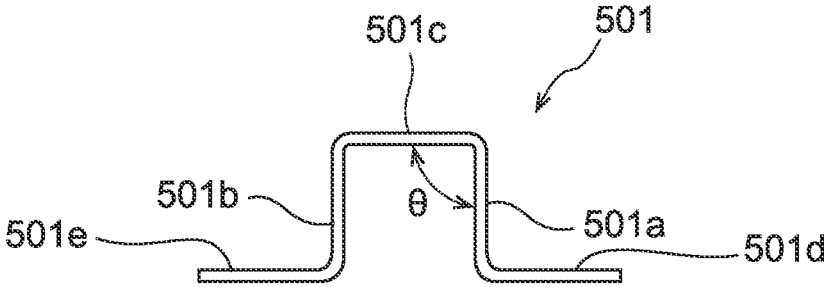
FIG. 34B is a cross-section of a preliminary curving component to explain the dimensions and the like of respective portions in order to prevent the occurrence of shear creasing.
Figure 34C:
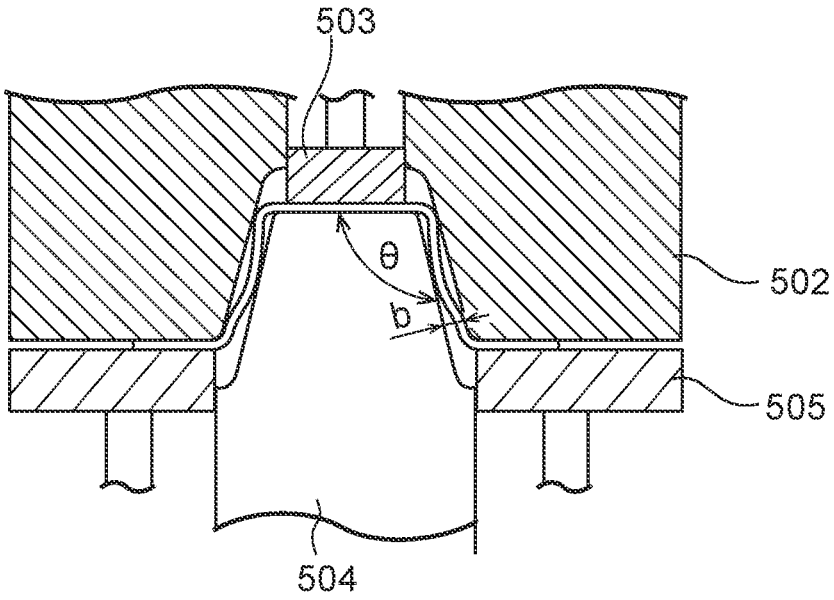
FIG. 34C is a cross-section of a manufacturing apparatus to explain the dimensions and the like of respective portions in order to prevent the occurrence of shear creasing.
Figure 34D:
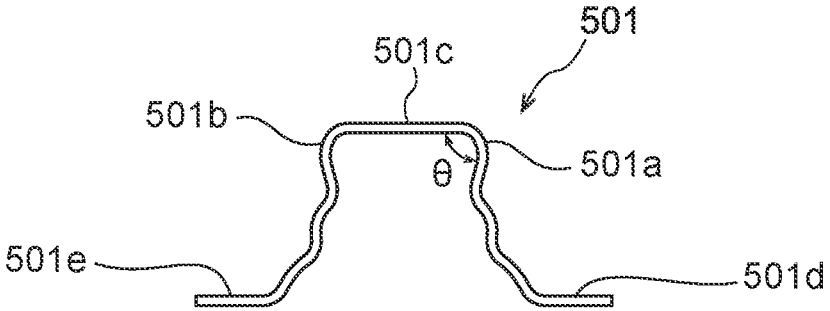
FIG. 34D is cross-section of a preliminary curving component to explain the dimensions and the like of respective portions in order to prevent the occurrence of shear creasing.

33B and FIG. 33C illustrate shear creasing W arising in the vertical walls 501*a*, 501*b* of the preliminary curving component 501.

In FIG. 33A, it can be seen that, when forming the vertical walls 501*a*, 501*b* of the preliminary curving component 501, deformation of the portions of the metal stock sheet 601 that will form the vertical walls 501*a*, 501*b* is mainly shear deformation. Forming the vertical walls 501*a*, 501*b* of the preliminary curving component 501 while deformation that is mainly shear deformation is occurring suppresses a reduction in the sheet thickness of the vertical walls 501*a*, 501*b* compared to the sheet thickness of the metal stock sheet 601. This thereby enables the occurrence of creasing and cracking in the vertical walls 501*a*, 501*b* to be suppressed.

During formation of the vertical walls 501*a*, 501*b*, the portions of the metal stock sheet 601 that will form the vertical walls 501*a*, 501*b* undergo compression deformation in the minimum principal strain direction of the shear deformation. Accordingly, as illustrated in FIG. 33B and FIG. 33C, shear creasing W would occur in the vertical walls 501*a*, 501*b* of the preliminary curving component 501 if the clearance between the die 602 and the punch 604 were to become large. In order to suppress such shear creasing W, it is effective to reduce the clearance between the die 602 and the punch 604 such that the clearance is brought close to the sheet thickness of the metal stock sheet 601 during formation of the vertical walls 501*a*, 501*b*.

As illustrated in FIG. 34A to FIG. 34D, as long as an internal angle θ formed between the respective vertical walls 501*a*, 501*b* and the top plate 501*c* is 90° or greater, there is no negative mold angle during forming. However, due to the clearance during initial forming increasing if the angle is too much more than 90°, it is advantageous to employ an angle of 90° or greater that is nevertheless close to 90°. When using a steel sheet with a sheet thickness of from 0.8 mm to 3.2 mm, and tensile strength of from 200 MPa to 1960 MPa, such as is generally employed in structural members configuring automotive vehicle body framework, to form a component in which the height of the vertical walls 501*a*, 501*b* is 200 mm or less, the internal angle formed between the top plate 501*c* and the vertical walls 501*a*, 501*b* is preferably from 90° to 92°. A clearance b in such cases between the die 502 and the punch 504 at the portions forming the vertical walls 501*a*, 501*b* when forming of the vertical walls 501*a*, 501*b* has been completed is preferably from 100% to 120% of the sheet thickness of the metal stock sheet 601.

Next, explanation follows, with reference to the table illustrated in FIG. 35, regarding results of investigation into the occurrence of creasing in the preliminary curving component 501, using parameters of (1) the angle formed between the vertical walls 501*a*, 501*b* and the top plate 501*c*, (2) mold clearance (varying the sheet thickness t with respect to the fixed clearance b), (3) the pressure applied to the pad 503 (pad pressure), (4) the pressure applied to the blank holders 505 (holder pressure), and (5) the tensile strength of the material.

Figure 36A:
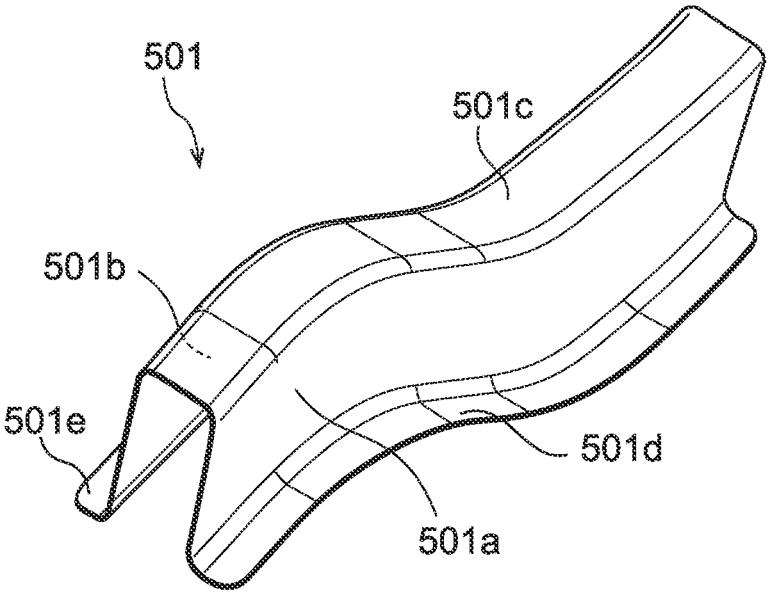
FIG. 36A is a perspective view illustrating a preliminary curving component manufactured using the manufacturing apparatus illustrated in FIG. 5.
Figure 36B:
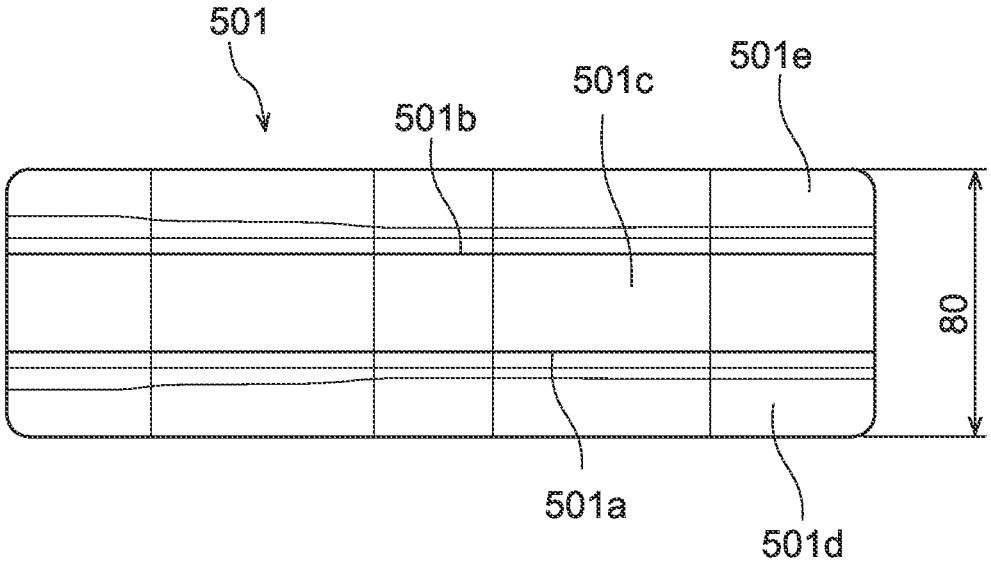
FIG. 36B is a plan view illustrating the preliminary curving component illustrated in FIG. 36A from above.
Figure 36C:
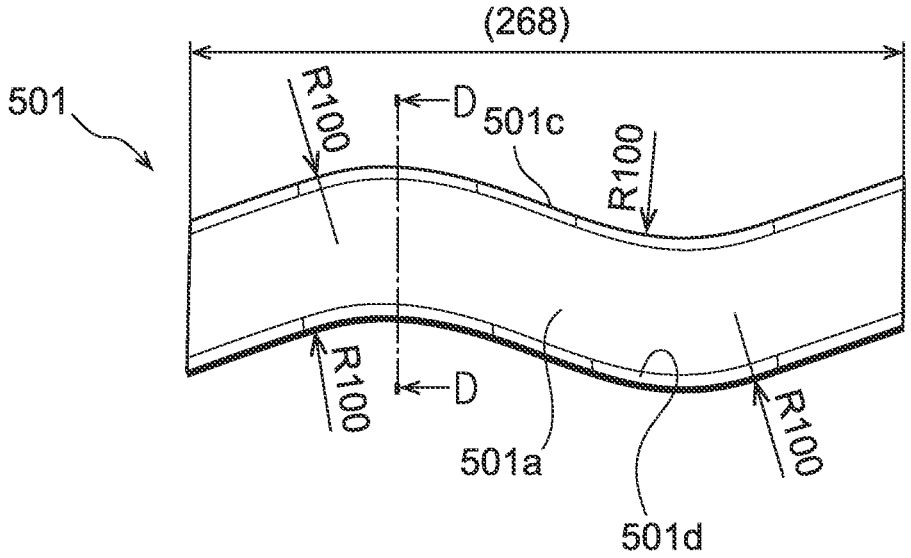
FIG. 36C is a side view illustrating the preliminary curving component illustrated in FIG. 36A from one width direction side.
Figure 36D:
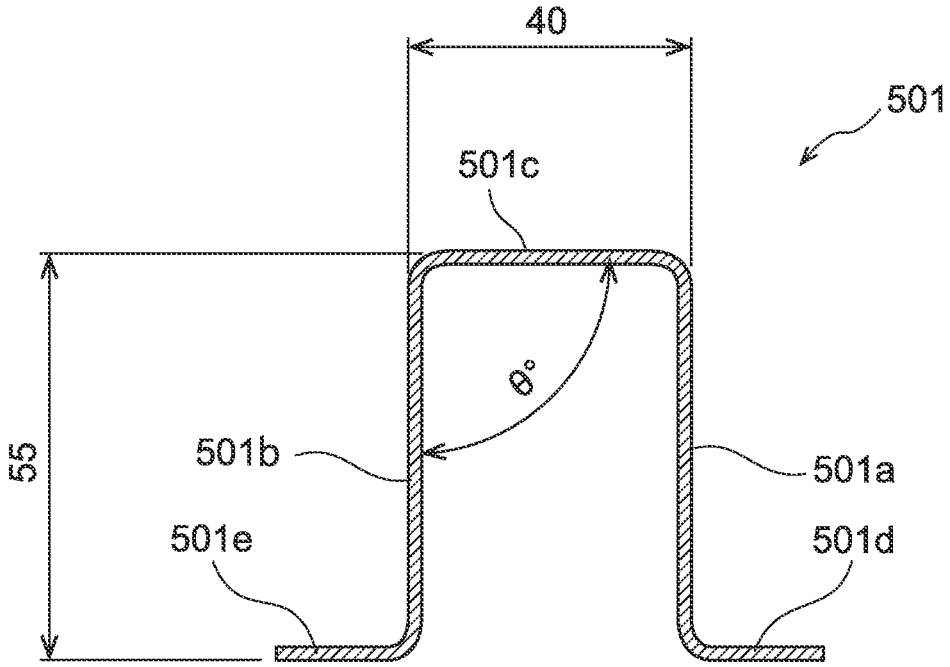
FIG. 36D is a front view illustrating the preliminary curving component illustrated in FIG. 36A from one length direction side.
Figure 37:
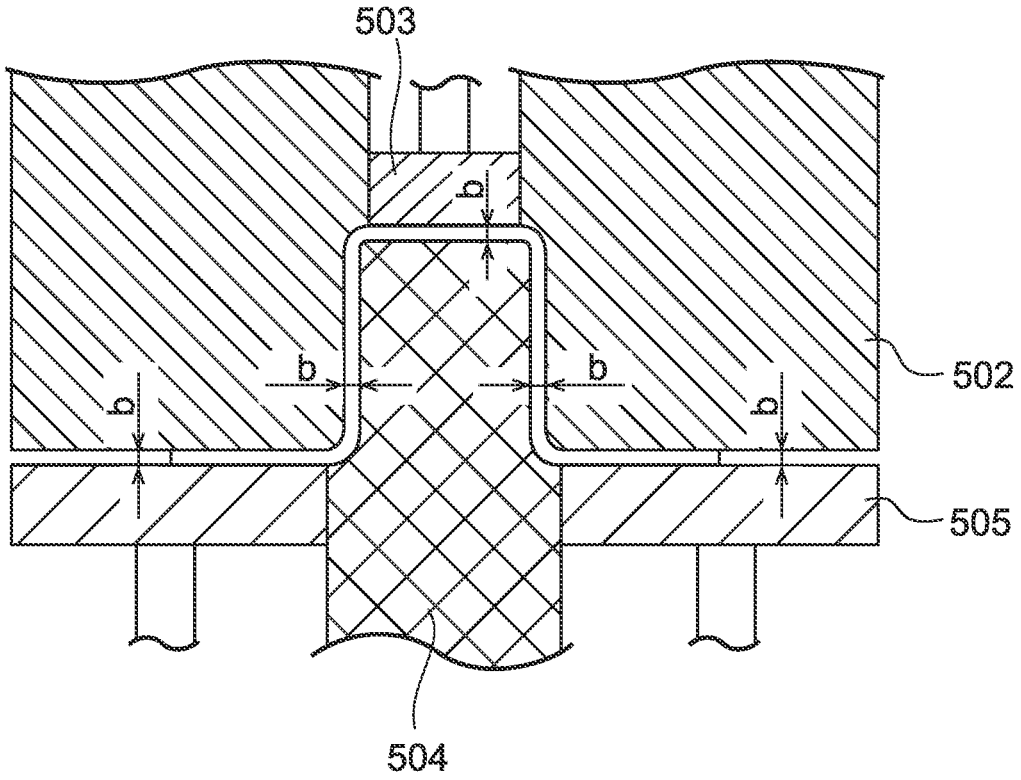
FIG. 37 is a cross-section of a mold, illustrating the clearance in the table in FIG. 35.

FIG. 36A is a perspective view illustrating the preliminary curving component 501. FIG. 36B is a plan view illustrating the preliminary curving component 501 in FIG. 36A, as viewed from above. FIG. 36C is a side view of the preliminary curving component 501 in FIG. 36A. FIG. 36D is a cross-section illustrating a cross-section of the preliminary curving component 501, taken along the line D-D in FIG. 36C. FIG. 37 is a cross-section of the mold.

The angle θ in the table illustrated in FIG. 35 is the internal angle θ formed between the vertical walls 501*a*, 501*b* and the top plate 501*c*, as illustrated in FIG. 36D. The clearance b in the table illustrated in 35 is the gap between the pad 503 and the punch 504, between the die 502 and punch 504, and between the die 502 and blank holders 505, as illustrated in FIG. 37.

Each of the Examples 1 to 19 in the table illustrated in FIG. 35 is an example formed by the first process of the present exemplary embodiment. In the table, "creasing present", indicated by a single circle, refers to an acceptable level of creasing being present. "Not present", indicated by double concentric circles, indicates that creasing was not present. (1) Nos. 1 to 5 are examples of cases in which the angle formed between the vertical walls 501*a*, 501*b* and the top plate 501*c* was varied. (2) Nos. 6 to 9 are examples of cases in which the mold clearance, more specifically the sheet thickness t with respect to a fixed clearance b, was varied. (3) Nos. 10 to 13 are examples of cases in which the pressure applied to the pad 503 (pad pressure) was varied. (4) Nos. 14 to 16 are examples of cases in which the pressure applied to the blank holders 505 (holder pressure) was varied. (5) Nos. 17 to 19 are examples of cases in which the tensile strength of the material was varied. The presence or absence of creasing occurrence was investigated in curving components manufactured for each Example.

It can be seen from the above table that unacceptable creasing of the components did not occur in the preliminary curving component 501 within the range of parameters investigated. The first process of the present exemplary embodiment enables good formation of the preliminary curving component 501 in the manner described above.

Moreover, in the second process, in the bending and stretching process, the die 711 is lowered, thereby bending and stretching the vertical walls 124*a*, 124*b* toward the apparatus lower side at one side in the length direction of the preliminary curving component 120 to form the vertical walls 704*a*-1, 704*b*-1 of the intermediate curving component 700. Then, in the bend back process after the bending and stretching process, the holder 714 is raised, thereby bending back the vertical walls 124*a*, 124*b* toward the apparatus upper side at another side in the length direction of the preliminary curving component 120 to form the vertical walls 704*a*-2, 704*b*-2 of the intermediate curving component 700. This thereby enables the height dimension of the vertical walls 124*a*, 124*b* of the preliminary curving component 120 to be changed while suppressing the occurrence of cracking, creasing, or the like in the vertical walls 704*a*, 704*b* of the intermediate curving component 700.

Explanation follows regarding this point, making comparisons with a comparative example in which a bending and stretching process and a bend back process are performed at the same time. In the manufacturing apparatus 710 of the comparative example, since the bending and stretching process and the bend back process are performed at the same time, the holder 714 rises at the same time as the die 711 is lowered. Accordingly, there is a possibility of cracking occurring at a length direction intermediate portion of the vertical wall 704*a* (704*b*) of the intermediate curving component 700, as illustrated in FIG. 20 (specifically, at locations enclosed by the double-dotted dashed line C in FIG. 20, this being at a boundary portion between the vertical wall 704*a*-1 and the vertical wall 704*a*-2). Namely, the length direction intermediate portion of the 704*a* (704*b*) is bent and stretched toward the apparatus lower side on the one length direction side, and is bent back toward the apparatus upper side on the other length direction side. Bending and stretching and bending back, respectively deforming the vertical wall 704*a* (704*b*) in opposite directions to each other, accordingly occur at the same time at the length direction intermediate portion of the vertical wall 704*a* (704*b*). There is accordingly a possibility of cracking occurring at the length direction intermediate portion of the vertical wall 704*a* (704*b*).

By contrast, in the second process of the present exemplary embodiment, the bend back process is performed after the bending and stretching process. Accordingly, the bending and stretching and the bending back, which deform the vertical walls 704*a* (704*b*) in opposite directions, are suppressed from being performed at the same time at a length direction intermediate portion of the vertical wall 704*a* (704*b*). This thereby enables the occurrence of cracking at the length direction intermediate portion of the vertical wall 704*a* (704*b*) to be suppressed. In particular, as described above, in the first process, in which portions of the metal stock sheet 601 corresponding to the vertical walls 124*a*, 124*b* of the preliminary curving component 120 are shear-deformed to form the preliminary curving component 120, the height dimensions of the vertical walls 124*a*, 124*b* are formed substantially uniform along the length direction of the preliminary curving component 120. Accordingly, even when, due to the various specifications of hat-shaped cross-section components, the height dimension of the hat-shaped cross-section component varies along the length direction, such differing specifications can be effectively accommodated by forming the intermediate curving component 700 by the second process.

In the second process, the intermediate curving component 700 is formed by performing the bend back process on the preliminary curving component 120, including the convex shaped curved portion 122*a* that is curved so as to be convex on the outer surface side of the top plate 122, after performing the bending and stretching process. This thereby enables the occurrence of cracking, creasing, or the like at the length direction intermediate portion of the intermediate curving component 700 to be suppressed in comparison to cases in which the bending and stretching process is performed after the bend back process. Namely, in cases in which the bend back process is performed first, a boundary portion between the flange 706*a*-1 and the flange 706*a*-2 is pulled toward the upper side as a result of the flange 706*a*-2 being moved toward the upper side from its position prior to forming. If the bending and stretching process were to be performed in this state, the boundary portion between the flange 706*a*-1 and the flange 706*a*-2 that has been pulled toward the upper side would be bent and stretched, giving rise to the possibility of cracking or the like occurring at the boundary portion between the flange 706*a*-1 and the flange 706*a*-2.

By contrast, when the bending and stretching process is performed earlier during forming of the intermediate curving component 700, the material of the flange 706*a*-2 acts so as to collect together at the side of the boundary between the flange 706*a*-1 and the flange 706*a*-2. Then, when the bend back process is performed in this state, the flange 706*a*-2 is moved toward the upper side from its position prior to forming, so as to pull in the material that has been collected toward the side of the boundary. This thereby enables the occurrence of cracking, creasing, or the like at the boundary portion between the flange 706*a*-1 and the flange 706*a*-2 to be suppressed as a result. In particular, in the intermediate curving component 700, since the flanges 706*a*, 706*b* corresponding to the convex shaped curved portion 702*a* are bent as viewed from the side, the height of the intermediate curving component 700 can be changed, while suppressing the occurrence of cracking and creasing around the bent portion where cracking and creasing are liable to occur.

Moreover, in the intermediate curving component 700 that has undergone the second process, the vertical wall 704*a*-1 that has been bent and stretched in the bending and stretching process, and the vertical wall 704*a*-2 that has been bent back in the bend back process, are adjacent to each other in the length direction of the intermediate curving component 700. Moreover, in the bending and stretching process, the bending and stretching amount of the vertical walls 124*a*, 124*b* is set so as to become larger on progression toward the one side in the length direction of the preliminary curving component 120, and in the bend back process, the bend back amount of the vertical walls 124*a*, 124*b* is set so as to become larger on progression toward the other side in the length direction toward the other side in the length direction of the preliminary curving component 120. Accordingly, the height dimension of the intermediate curving component 700 (vertical walls 704) can be changed continuously over the entire length direction of the intermediate curving component 700.

In the third process of the present exemplary embodiment, the intermediate curving component 700 is restruck by the manufacturing apparatus 820 to form the completed curving component 800. The manufacturing apparatus 820 is provided with the support member 828 extending from the punch 826 toward the apparatus upper side, and the support member 828 supports the inner surface of the top plate 702 of the intermediate curving component 700. Accordingly, when the intermediate curving component 700 in which spring-back has occurred is set in the manufacturing apparatus 820 (the support member 828), the intermediate curving component 700 is disposed at the apparatus upper side of the punch 826, thereby enabling the vertical walls 704*a*, 704*b* of the intermediate curving component 700 to be suppressed from contacting the punch 826. As a result, for example, the intermediate curving component 700 can be suppressed from being set in the manufacturing apparatus 820 in a state in which the vertical walls 704*a*, 704*b* of the intermediate curving component 700 are riding up over a shoulder portion of the punch 826. This thereby enables the intermediate curving component 700 to be disposed in the manufacturing apparatus 820 at the proper position (with the proper orientation) when restriking the intermediate curving component 700.

Moreover, the width dimension W4 of the first recess portion 824*a* of the die 822 is set substantially the same as the width dimension W3 of the intermediate curving component 700. Accordingly, in the third process, when the top plate 702 of the intermediate curving component 700 is being gripped by the die 822 and the support member 828, the upper portion of the intermediate curving component 700 is fitted inside the first recess portion 824*a* of the die 822. The intermediate curving component 700 is thereby positioned in the width direction by the pair of vertical walls 704*a*, 704*b* of the intermediate curving component 700 and the first recess portion 824*a*. Namely, the position of the intermediate curving component 700 with respect to the die 822 is determined by base end side (top plate 702 side) portions of the pair of vertical walls 704*a*, 704*b*, where the effects of spring-back are small, and the first recess portion 824*a*. This thereby enables the position of the intermediate curving component 700 with respect to the die 822 to be stabilized during restrike forming.

In the third process, the flanges 706*a*, 706*b* of the intermediate curving component 700 are free when the second vertical walls 808*a*, 808*b* of the completed curving component 800 are formed by the punch 826 and the die 822. There is accordingly no need to provide the manufacturing apparatus 820 with a holder to hold down the flanges 706*a*, 706*b* of the intermediate curving component 700. This thereby enables the manufacturing apparatus 820 to be configured with a simple structure.

In the manufacturing apparatus 820 of the third process, the width dimension of the support portion 828*a* of the support member 828 is set substantially the same as the width dimension of the inner surface side of the intermediate curving component 700. Accordingly, both width direction end portions of the support portion 828*a* abut the vertical walls 704*a*, 704*b* of the intermediate curving component 700 when the top plate 702 of the intermediate curving component 700 is being supported by the support portion 828*a*. This thereby enables the upper portion of the intermediate curving component 700 to be fitted into the first recess portion 824*a* of the die 822, while limiting movement of the intermediate curving component 700 in the width direction relative to the support member 828.

Note that in the present exemplary embodiment, in the second process, after bending and stretching the vertical walls 124*a*, 124*b* at one side in the length direction of the preliminary curving component 120, the vertical walls 124*a*, 124*b* are bent back on the other length direction side. Namely, in the second process, configuration is made such that the bend back process is performed after the bending and stretching process. Alternatively, depending on the configuration of the preliminary curving component, the sequence of the bending and stretching process and the bend back process in the second process may be reversed. Regarding this point, explanation follows of an example of a case in which the preliminary curving component 130 (see FIG. 15A to FIG. 15D), serving as a "preliminarily formed component", is formed into an intermediate curving component 720 in the second process.

Figure 38:
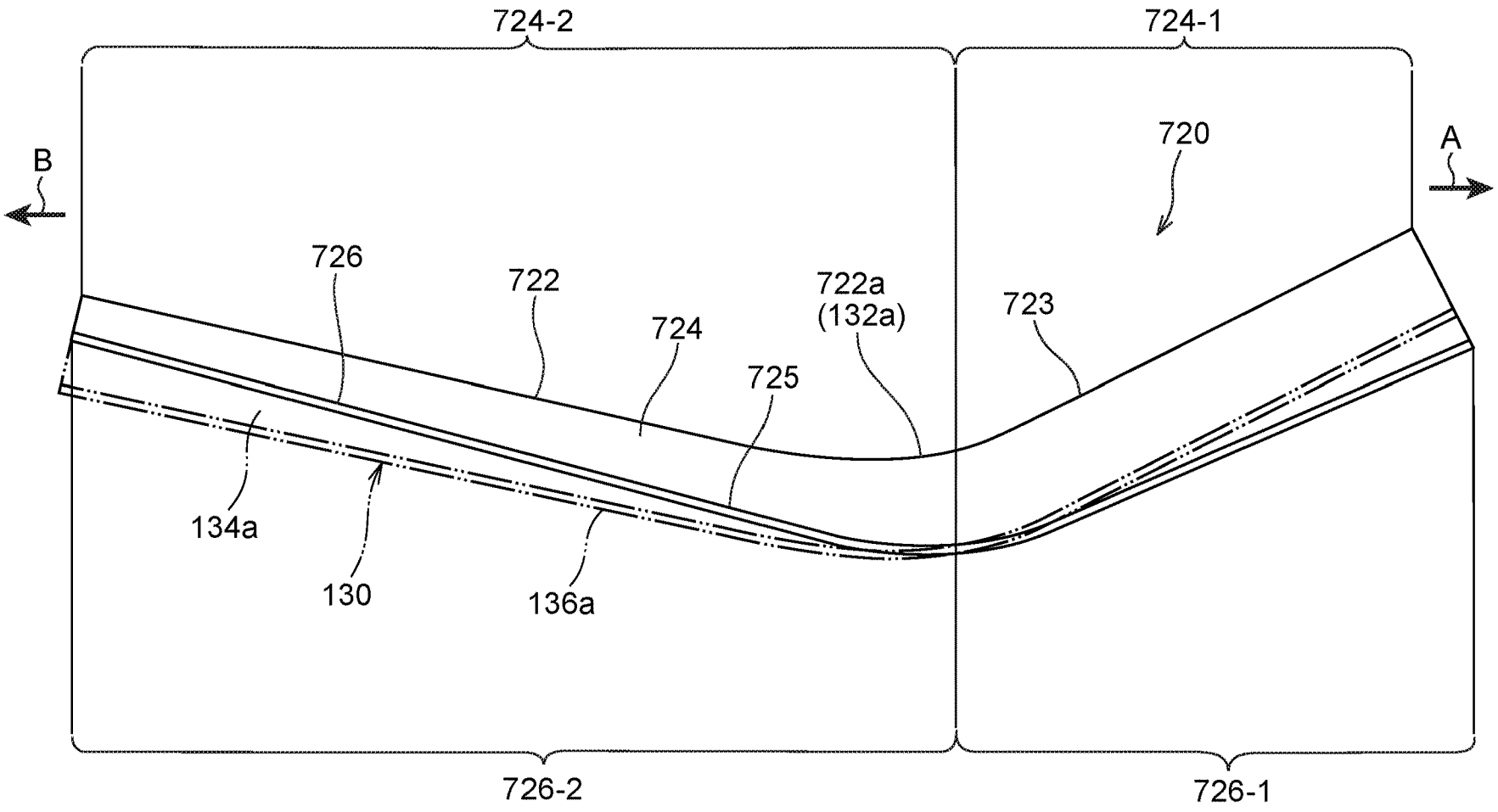
FIG. 38 is a side view to explain another example of an intermediate curving component processed by a second process in a hat-shaped cross-section component manufacturing method according to an exemplary embodiment.

First, explanation follows regarding configuration of the intermediate curving component 720. FIG. 38 illustrates the intermediate curving component 720 in side view. As illustrated in FIG. 38, the intermediate curving component 720 is formed with a hat-shaped cross-section profile configuring an elongated shape similar to that of the preliminary curving component 130. Namely, the intermediate curving component 720 is configured including a top plate 722 extending along the length direction, a pair of vertical walls 724 respectively extending from ridge lines 723 at both width direction ends of the top plate 722 toward the lower side (one sheet thickness direction side of the top plate 722), and a pair of flanges 726 extending from ridge lines 725 at lower ends of the respective vertical walls 724 toward the width direction outsides of the top plate 722. A length direction intermediate portion of the top plate 722 is formed with a concave shaped curved portion 722*a* that curves in an arc shape that is convex toward the inner surface side (one sheet thickness direction side) of the top plate 722.

Moreover, a height dimension (of the vertical walls 724) of the intermediate curving component 720 is set at a different dimension to the height dimension of the preliminary curving component 130 (vertical walls 134*a*, 134*b*). Specifically, the height dimension of a portion at one side in the length direction of the intermediate curving component 720 (more specifically a portion on the arrow A direction side of the concave shaped curved portion 722*a* in FIG. 38) is set so as to become larger on progression toward the one side in the length direction. More specifically, flanges 726-1 at one side in the length direction of the intermediate curving component 720 are inclined so as to move further toward the lower side (in a direction to move away from the top plate 722) on progression toward the one side in the length direction of the intermediate curving component 720 with respect to the flanges 136*a* (136*b*) of the preliminary curving component 130 (see the flange 136*a* indicated by double-dotted dashed lines in FIG. 38). Accordingly, the height of the vertical walls 724-1 connected to the flanges 726-1 is set higher than the height of the vertical walls 134*a* (134*b*) of the preliminary curving component 130.

On the other hand, a height dimension of a portion at another side in the length direction of the intermediate curving component 720 (more specifically a portion on the arrow B direction side of the concave shaped curved portion 722*a* in FIG. 38) is set so as to become smaller on progression toward the other side in the length direction. More specifically, flanges 726-2 at another side in the length direction of the intermediate curving component 720 are inclined so as to approach the upper side (in a direction of approach toward the top plate 722) on progression toward the other side in the length direction toward the other side in the length direction of the intermediate curving component 720 with respect to the flanges 136*a* (136*b*) of the preliminary curving component 130 (see the flange 136*a* indicated by double-dotted dashed lines in FIG. 38). Accordingly, the height of the vertical walls 724-2 connected to the flanges 726-2 is set lower than the height of the vertical walls 134*a* (134*b*) of the preliminary curving component 130.

Note that although not illustrated in the drawings, in the second process of forming the intermediate curving component 720, in the bend back process, the holder is raised such that the vertical walls 134*a* (134*b*) at another side in the length direction of the preliminary curving component 130 are bent back toward the apparatus upper side, and the vertical walls 724-2 of the intermediate curving component 720 are formed. Then, in the bending and stretching process following the bend back process, the die is lowered such that the vertical walls 134*a* (134*b*) at one side in the length direction of the preliminary curving component 130 are bent and stretched toward the apparatus lower side, and the vertical walls 724-1 of the intermediate curving component 720 are formed. Accordingly, the bending and stretching and the bending back, which deform the vertical walls 724 in opposite directions, are suppressed from being performed at the same time at the length direction intermediate portions of the vertical walls 724 (boundary portions between the vertical walls 724-1 and the vertical walls 724-2). This thereby enables the height dimension of the vertical walls 134*a*, 134*b* of the preliminary curving component 130 to be changed while suppressing the occurrence of cracking, creasing, or the like in the vertical walls 724 of the intermediate curving component 720.

Moreover, in the second process of forming the intermediate curving component 720, the bending and stretching process is performed after the bend back process, thereby enabling the occurrence of cracking, creasing, or the like at the length direction intermediate portion of the intermediate curving component 720 to be suppressed in comparison to cases in which the bend back process is performed after the bending and stretching process. Namely, were the bending and stretching process to be performed earlier in the second process of forming the intermediate curving component 720, the flanges 726-1 would be moved toward the lower side with respect to their position prior to forming, thereby pulling the boundary portions between the flanges 726-1 and the flanges 726-2 toward the lower side. Moreover, since the concave shaped curved portion 132*a* of the preliminary curving component 130 is curved so as to be convex toward the inner surface side of the top plate 132, portions of the flanges 136 corresponding to the concave shaped curved portion 132*a* would be pulled toward the length direction outside of the preliminary curving component 130. Accordingly, were the bending and stretching process to be performed first in the second process of forming the intermediate curving component 720, there would be a possibility of cracking or the like occurring at the boundary portion between the flanges 726-1 and the flanges 726-2 during the bending and stretching process.

However, in the second process of forming the intermediate curving component 720, the bend back process is performed first, thereby enabling slack to be generated while suppressing the occurrence of cracking at the boundary portions between the flanges 726-1 and the flanges 726-2. Namely, in the bend back process of the preliminary curving component 130, an action occurs such that material of the flanges 726-2 collects at the side of the boundaries between the flanges 726-1 and the flanges 726-2. Moreover, by performing the bending and stretching process after the bend back process, the above slack can be stretched out along the length direction of the intermediate curving component 720. This thereby enables the occurrence of cracking, creasing, or the like at the boundary portion between the flanges 726-1 and the flanges 726-2 to be suppressed as a result.

In this manner, in the second process of forming the intermediate curving component, the height of the preliminary curving component can be changed while suppressing cracking or the like of the intermediate curving component in preliminary curving components of various configurations by switching the sequence of the bending and stretching process and the bend back process as appropriate according to the configuration (the direction of curvature of the curved portion formed to the top plate) of the preliminary curving component.

Moreover, in the present exemplary embodiment, in the bend back process of the second process, the holder 714 is moved (raised) toward the apparatus upper side, thereby forming the vertical walls 704*a*-2, 704*b*-2 and the flanges 706*a*-2, 706*b*-2 at another side in the length direction of the intermediate curving component 700. Alternatively, as a configuration in which the holder 714 is not capable of moving, the die 711, the pad 712, and the punch 713 may be moved toward the apparatus lower side relative to the holder 714 to form the vertical walls 704*a*-2, 704*b*-2 and the flanges 706*a*-2, 706*b*-2 at another side in the length direction of the intermediate curving component 700. Explanation follows regarding such a case, with reference to FIG. 39 to FIG. 40.

Figure 39:
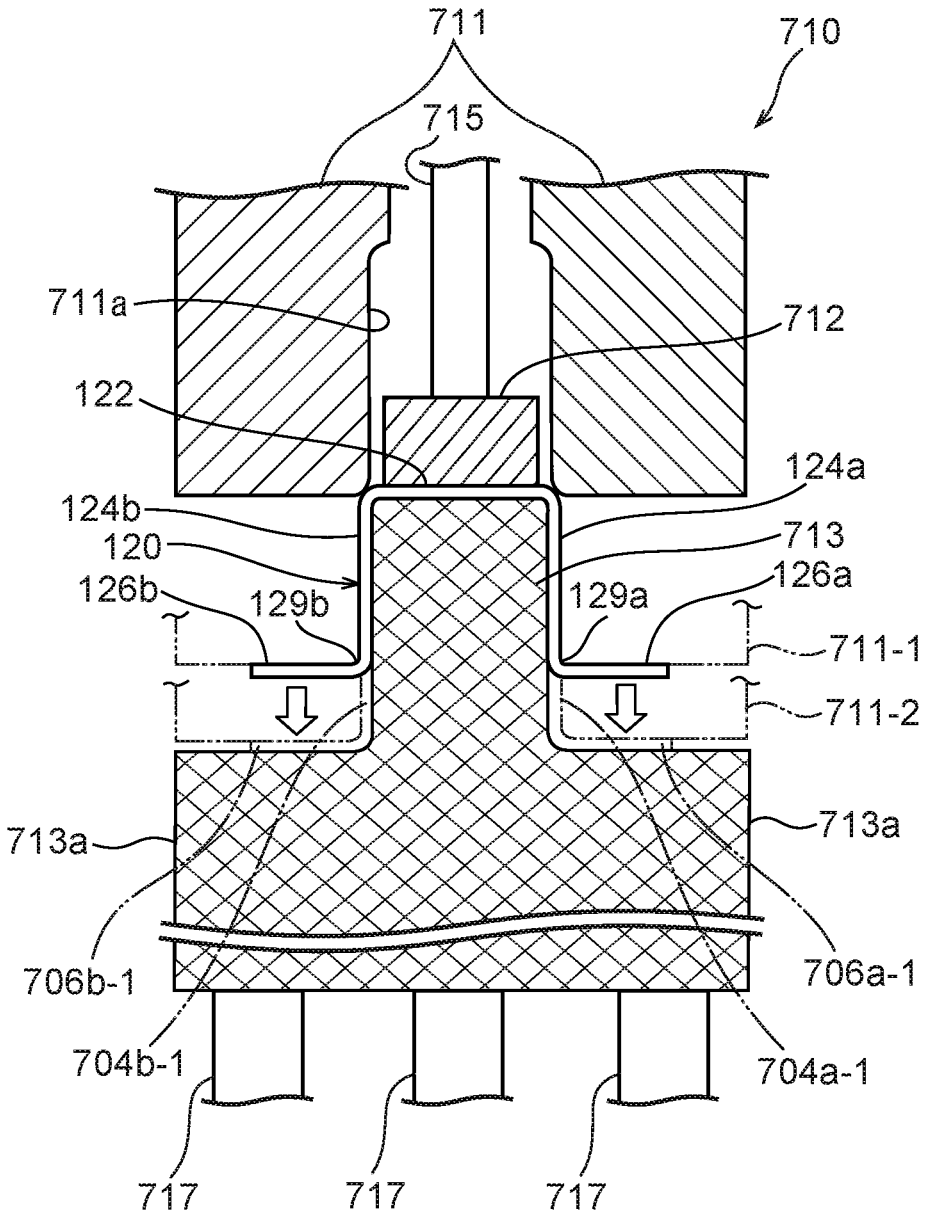
FIG. 39 is a cross-section corresponding to FIG. 23, illustrating a modified example of the manufacturing apparatus illustrated in FIG. 21, in a state in which a portion at one side in the length direction of a top plate of a preliminary curving component is gripped and restrained by a pad and a punch.

In such cases, as illustrated in FIG. 39, configuration is made in which the punch 713 is coupled to a mover device 717, and the punch 713 can be moved in the apparatus up-down direction by actuating the mover device 717. On the other hand, the holder 714 (see FIG. 40) is configured so as to be incapable of movement relative to a lower mold, not illustrated in the drawings.

Moreover, a pressing and gripping process and the bending and stretching process of the second process are performed similarly to in the present exemplary embodiment. Namely, as illustrated in FIG. 39, in the pressing and gripping process of the second process, the pad 712 is moved toward the apparatus lower side (punch 713 side), and the top plate 122 is pressed and gripped between the pad 712 and the punch 713. Then, as illustrated by the double-dotted dashed line in FIG. 39, in the bending and stretching process of the second process, accompanying lowering of the die 711, lower faces at one side in the length direction of the die 711 contact upper faces of the flanges 126*a*, 126*b* at one side in the length direction of the preliminary curving component 120 (see the die 711-1 illustrated by double-dotted dashed lines in FIG. 39), and the flanges 126*a*, 126*b* are pressed toward the apparatus lower side. Accordingly, the ridge lines 129*a*, 129*b* between the vertical walls 124*a*, 124*b* and the flanges 126*a*, 126*b* of the preliminary curving component 120 are gradually moved toward the apparatus lower side (the side in a direction away from the top plate 122), and the flanges 126*a*, 126*b* at one side in the length direction of the preliminary curving component 120 are moved toward the apparatus lower side while following the lower faces of the die 711. Then, the flanges 126*a*, 126*b* of the preliminary curving component 120 are pressed and gripped by the flange forming portions 713*a* of the punch 713 and the die 711 (see the die 711-2 illustrated by double-dotted dashed lines in FIG. 39), and the flanges 706*a*-1, 706*b*-1 of the intermediate curving component 700 (see the flanges 706*a*-1, 706*b*-1 illustrated by double-dotted dashed lines in FIG. 39) are formed.

Figure 40:
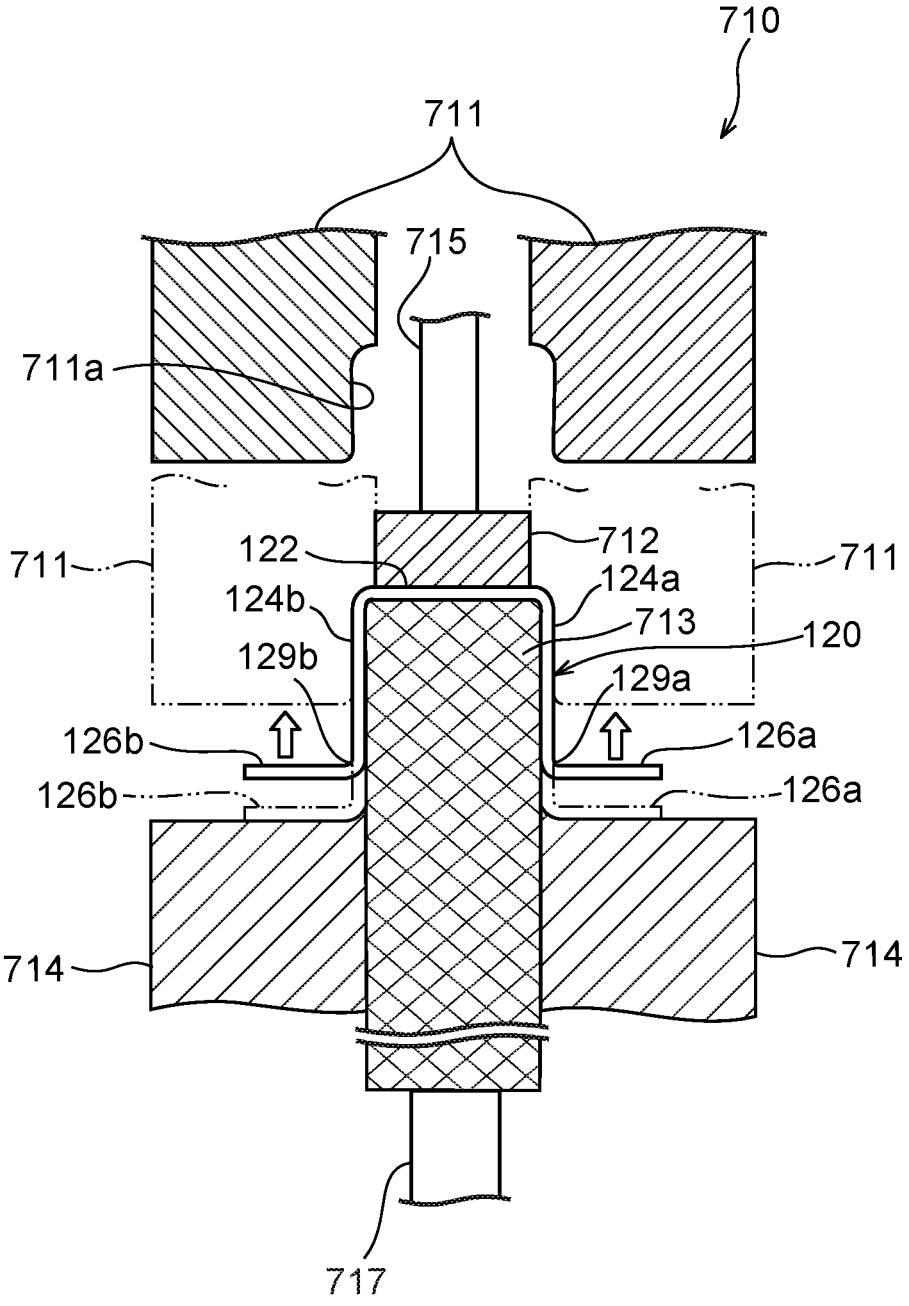
FIG. 40 is a cross-section corresponding to FIG. 24, illustrating a modified example of the manufacturing apparatus illustrated in FIG. 21, in a state in which a portion at another side in a length direction of a top plate of a preliminary curving component is gripped and restrained by a pad and a punch.

In the bending and stretching process, in a state in which the die 711 and the flange forming portions 713*a* of the punch 713 are pressing and gripping the flanges 126*a*, 126*b* of the preliminary curving component 120, the die 711 is disposed at a separation to the apparatus upper side of the flanges 126*a*, 126*b* at another side in the length direction of the preliminary curving component 120 (see the die 711 illustrated by double-dotted dashed lines in FIG. 40).

Then, in the bend back process of the second process, the die 711, the pad 712, and the punch 713 are moved toward the apparatus lower side relative to the holder 714, forming the vertical walls 704*a*-2, 704*b*-2 and the flanges 706*a*-2, 706*b*-2 at another side in the length direction of the intermediate curving component 700. Specifically, the pressed and gripped state of the top plate 122 of the preliminary curving component 120 by the pad 712 and the punch 713 is maintained while the die 711, the pad 712, and the punch 713 are moved toward the apparatus lower side (the holder 714 side). In other words, the holder 714 moves toward the die 711 (pad 712) side relative to the die 711, the pad 712, the punch 713, and the preliminary curving component 120. Accordingly, lower faces of the flanges 126*a*, 126*b* at another side in the length direction of the preliminary curving component 120 contact the upper face of the holder 714 (see the flanges 126*a*, 126*b* illustrated by double-dotted dashed lines in FIG. 40), and the flanges 126*a*, 126*b* are pressed toward the apparatus upper side by the holder 714. Accordingly, the ridge lines 129*a*, 129*b* between the vertical walls 124*a*, 124*b* and the flanges 126*a*, 126*b* at another side in the length direction of the preliminary curving component 120 are gradually moved toward the apparatus upper side (in a direction approaching the top plate 122 side), and the flanges 126*a*, 126*b* at another side in the length direction of the preliminary curving component 120 are moved toward the apparatus upper side while following the upper face of the holder 714.

Figure 41:
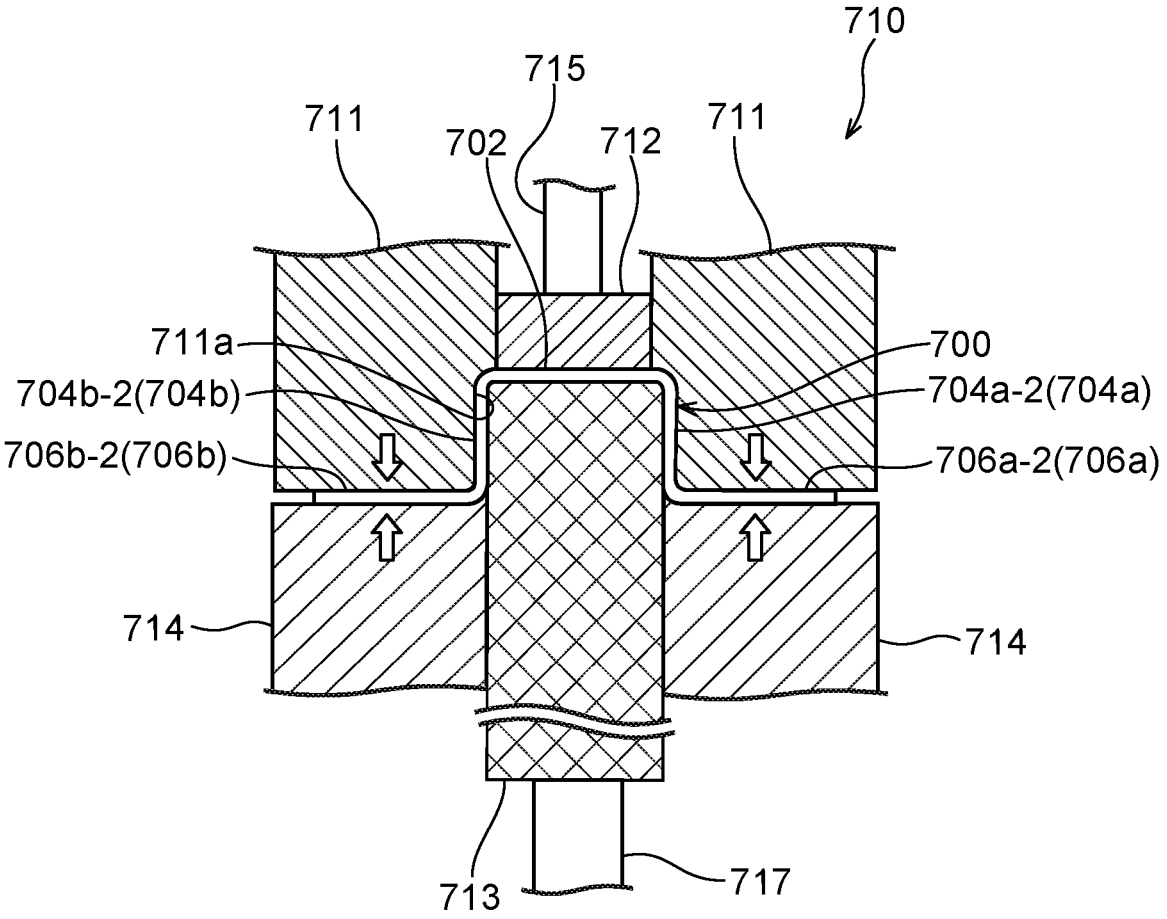
FIG. 41 is a cross-section corresponding to FIG. 25, illustrating a modified example of the manufacturing apparatus illustrated in FIG. 21, at a bend back process stage.

Then, as illustrated in FIG. 41, when the die 711, the pad 712, and the punch 713 have reached their stroke end positions, the flanges 126*a*, 126*b* of the preliminary curving component 120 are pressed and gripped by the holder 714 and the die 711, and the flanges 706*a*-2, 706*b*-2 of the intermediate curving component 700 are formed. Due to the above, when the holder 714 is configured so as to be incapable of movement, moving the die 711, the pad 712, and the punch 713 toward the apparatus lower side relative to the holder 714 enables the vertical walls 704*a*-2, 704*b*-2 and the flanges 706*a*-2,706*b*-2 at another side in the length direction of the intermediate curving component 700 to be formed.

Accordingly, in the bend back process of the present disclosure, "moving a holder provided on both width direction sides of the punch toward the pad side relative to the preliminarily formed component" encompasses moving the holder 714 toward the pad 712 side (die 711 side) relative to the preliminary curving component 120 by moving the pad 712 and the punch 713 toward the holder 714 side.

Moreover, in the present exemplary embodiment, in the intermediate curving component 700, the vertical wall 704*a*-1 that is bent and stretched in the bending and stretching process and the vertical wall 704*a*-2 that is bent back in the bend back process are adjacent to each other in the length direction of the intermediate curving component 700. Namely, in the second process, the height dimension of the intermediate curving component 700 (the vertical walls 704) is changed "continuously" over the entire length direction of the intermediate curving component 700. In other words, the height is changed across the entire intermediate curving component 700 (vertical walls 704). Alternatively, the vertical wall 704*a*-1 that is bent and stretched in the bending and stretching process and the vertical wall 704*a*-2 that is bent back in the bend back process may be separated from each other in the length direction of the intermediate curving component 700. Namely, the height dimension of the intermediate curving component 700 (vertical walls 704) may be changed "intermittently" over the entire length of the intermediate curving component 700. In other words, the height of the intermediate curving component 700 (vertical walls 704) may be changed locally. For example, as illustrated in FIG. 20, the vertical wall 704*a*-1 at one side in the length direction of the vertical wall 704, may be bent and stretched in the bending and stretching process except for at a length direction intermediate portion (a portion connected to the convex shaped curved portion 702*a*; the hatched portion in FIG. 20), and the vertical wall 704*a*-2 at another side in the length direction of the vertical wall 704 may be bent back in the bend back process except for at the length direction intermediate portion. Moreover, in such cases, in the second process, the bending and stretching process and the bend back process may be performed at the same time as each other.

Namely, in cases in which the height dimension of the intermediate curving component 700 (vertical walls 704) is changed "intermittently" over the entire length direction of the intermediate curving component 700, as described above, the bent and stretched vertical wall 704*a*-1 and the bent back vertical wall 704*a*-2 are separated from each other in the length direction about the length direction intermediate portion of the vertical wall 704. Accordingly, even if the bending and stretching process and the bend back process are performed at the same time as each other, any effect on the vertical wall 704*a*-1 from the bend back process is suppressed by the length direction intermediate portion of the vertical wall 704, and any effect on the vertical wall 704*a*-2 from the bending and stretching process is suppressed by the length direction intermediate portion of the vertical wall 704. Accordingly, even if the bending and stretching process and the bend back process are performed at the same time as each other, by separating the vertical wall 704*a*-1 that is bent and stretched and the vertical wall 704*a*-2 that is bent back from each other in the length direction of the intermediate curving component 700, cracking or the like can be suppressed from occurring at the length direction intermediate portion of the vertical wall 704.

Positioning pins may be provided to the punch and/or the support member in order to raise the positioning precision of the curving component with respect to the die and the punch of the second process and the third process of the present exemplary embodiment. For example, to explain using the third process, a positioning pin may be provided to the support portion 828*a* of the support member 828 so as to project out toward the apparatus upper side, and a positioning hole into which the positioning pin is inserted may be formed to the top plate 702 of the intermediate curving component 700. In such cases, for example, the positioning hole is formed in a process prior to the first process by preprocessing the metal stock sheet, and the die 822 is formed with a recess so as not to interfere with the positioning pin.

In order to raise the length direction positioning precision of the intermediate curving component 700 with respect to the die 822 and the punch 826, for example, the support member 828 may be provided with guide pins that contact both length direction ends of the top plate 702, or guide walls that contact both length direction ends of the vertical walls 704*a*, 704*b*.

In the manufacturing apparatus 820 employed in the third process of the present exemplary embodiment, the support member 828 extends along the length direction of the intermediate curving component 700 so as to support the top plate 702 of the intermediate curving component 700 continuously along the length direction. However, the support member 828 may be split up such that the top plate 702 of the intermediate curving component 700 is supported intermittently by the support member 828. For example, configuration may be made such that both length direction end portions and a length direction intermediate portion of the top plate 702 are supported by the support member 828.

In the manufacturing apparatus 820 employed in the third process of the present exemplary embodiment, the forming recess 824 formed to the die 822 is configured including the first recess portion 824*a* and the second recess portion 824*b*. Namely, the forming recess 824 is configured by two recess portions. Alternatively, the forming recess 824 may be configured by three or more recess portions. For example, a third recess portion with a larger width dimension than the second recess portion 824*b* may be formed on the opening side of the second recess portion 824*b*. In such cases, the external profile of the punch 826 is modified as appropriate to correspond to the forming recess 824.

Moreover, in the hat-shaped cross-section component manufacturing method of the present exemplary embodiment the completed curving component serving as a hat-shaped cross-section member is formed by going through the first process to the third process. However, in cases in which the dimensional precision of the intermediate curving component is comparatively high, the third process may be omitted from the hat-shaped cross-section component manufacturing method. In such cases, the intermediate curving component configures the completed component.

Moreover, in the above explanation, explanation has been given regarding an example in which sheet steel is employed as the metal stock sheet; however, the material of the metal stock sheet is not limited thereto. For example, an aluminum, titanium, stainless steel, or composite material, such as an amorphous material may be employed as the metal stock sheet.

Explanation has been given above regarding an exemplary embodiment of the present invention. However, the present invention is not limited to the above, and obviously various other modifications may be implemented within a range not departing from the spirit of the present invention.

The disclosure of Japanese Patent Application No. 2014-259102, filed on Dec. 22, 2014, is incorporated in the present specification in its entirety by reference herein.

Supplement

In a method for manufacturing a hat-shaped cross-section component according to a first aspect, the manufacturing method includes: a gripping process of disposing a pair of vertical walls of an elongated preliminarily formed component that has been formed into a hat shaped cross section profile at a width direction outside of a punch, and gripping a top plate of the preliminarily formed component using the punch and a pad; a bending and stretching process of, after the gripping process, moving a die provided on both width direction sides of the pad toward the punch side relative to the preliminarily formed component, and using the die to bend and stretch the vertical walls toward the opposite side to the top plate at one side in the length direction of the preliminarily formed component; and a bend back process of, after the gripping process, moving a holder provided on both width direction sides of the punch toward the pad side relative to the preliminarily formed component, and using the holder to bend back the vertical walls toward the top plate side at another side in the length direction of the preliminarily formed component.

Moreover, configuration is preferably made in which the preliminarily formed component is a curved member including a curved portion that is convex on an outer surface side of the top plate in side view; in the bending and stretching process, the vertical walls are bent and stretched at one side in the length direction of the curved portion; in the bend back process, the vertical walls are bent back at another side in the length direction of the curved portion; and the bend back process is performed after the bending and stretching process.

Moreover, configuration is preferably made in which the preliminarily formed component is a curved member including a curved portion that is convex on an inner surface side of the top plate in side view; in the bending and stretching process, the vertical walls are bent and stretched at one side in the length direction of the curved portion; in the bend back process, the vertical walls are bent back at another side in the length direction of the curved portion; and the bending and stretching process is performed after the bend back process.

Moreover, configuration is preferably made in which the vertical wall portion that is stretched in the bending and stretching process and the vertical wall portion that is bent back in the bend back process are adjacent to each other in the length direction of the hat-shaped cross-section component; in the bending and stretching process, a bending and stretching amount of the vertical walls is set so as to become larger on progression toward the one side in the length direction of the preliminarily formed component; and in the bend back process, a bend back amount of the vertical walls is set so as to become larger on progression toward the other side in the length direction toward the other side in the length direction of the preliminarily formed component.

Moreover, configuration is preferably made in which, in a preliminary forming process in which the preliminarily formed component is formed: a central portion of a metal sheet is gripped by a preliminary forming punch and a preliminary forming pad to configure an upward and downward curved metal sheet; both side portions of the metal sheet are gripped by a preliminary forming die and a preliminary forming holder provided on both width direction sides of the preliminary forming punch; and the preliminarily formed component is formed by moving the preliminary forming punch and the preliminary forming pad vertically relative to the preliminary forming holder and the preliminary forming die.

Moreover, configuration is preferably made in which the preliminarily formed component is configured from a steel sheet having a sheet thickness of from 0.8 mm to 3.2 mm and a tensile strength of from 200 MPa to 1960 MPa.

Moreover, configuration is preferably made further including a restriking process of restriking the hat-shaped cross-section component that has been through the bending and stretching process and the bend back process. The restriking process includes: disposing the hat-shaped cross-section component between a restriking punch and a restriking die disposed so as to face each other, and supporting a top plate of the hat-shaped cross-section component from the restriking punch side using a support member extending from the restriking punch toward the restriking die side; housing the top plate inside a first recess portion configuring a top face side of a forming recess that is formed to the restriking die and that is open toward the restriking punch side, gripping the top plate using the support member and the restriking die, and positioning the hat-shaped cross-section component in a width direction using the first recess portion and a pair of vertical walls of the hat-shaped cross-section component; and inserting the restriking punch inside a second recess portion configuring the opening side of the forming recess and having a larger width dimension than the first recess portion, and restriking the hat-shaped cross-section component using the restriking punch and the restriking die.

Moreover, configuration is preferably made in which in the restriking process, the hat-shaped cross-section component is restruck using the restriking punch and the restriking die in a state in which flanges configuring both width direction end portions of the hat-shaped cross-section component are in a free state.

Configuration is preferably made in which in the restriking process, a restriking pad configuring part of the restriking die is disposed so as to extend toward the restriking punch side, and the top plate of the hat-shaped cross-section component supported by the support member is housed inside the first recess portion while being gripped using the restriking pad and the support member.

Configuration is preferably made in which the support member employed is contacted by the pair of vertical walls of the hat-shaped cross-section component.

In a manufacturing method for a hat-shaped cross-section component according to a second aspect, the manufacturing method includes: a bending and stretching process of gripping a top plate of an elongated preliminarily formed component that has been formed into a hat shaped cross section profile using a punch and a pad, moving a die disposed facing the punch relatively toward the punch side and using the die to bend and stretch vertical walls toward the opposite side to the top plate at one side in the length direction of the preliminarily formed component; and a bend back process of, after bending and stretching the vertical walls, moving a holder provided on both width direction sides of the punch relatively toward the die side, and using the holder to bend back the vertical walls toward the top plate side at another side in the length direction of the preliminarily formed component.

Moreover, configuration is preferably made in which the preliminarily formed component is a curved member including a curved portion that is convex on an outer surface side or an inner surface side of the top plate in side view; in the bending and stretching process, the vertical walls are bent and stretched at one side in the length direction of the curved portion; and in the bend back process, the vertical walls are bent back at another side in the length direction of the curved portion.

The invention claimed is:

1. A method for manufacturing a hat-shaped cross-section component, the manufacturing method comprising:

a gripping process of disposing a pair of vertical walls of an elongated preliminarily formed component, formed by a preliminary forming process, and that has been formed into a hat-shaped cross-section profile at a width direction outer side of a punch, and gripping a top plate of the preliminarily formed component using the punch and a pad;

a bending and stretching process of, after the gripping process, moving a die provided on both width direction sides of the pad toward a punch side relative to the preliminarily formed component, and using the die to bend and stretch the vertical walls toward an opposite side to the top plate at one side in a length direction of the preliminarily formed component; and a bend back process of, after the gripping process, moving a holder provided on both width direction sides of the punch toward a pad side relative to the preliminarily formed component, and using the holder to bend back the vertical walls toward a top plate side at another side in the length direction of the preliminarily formed component thereby forming the hat-shaped cross-section component.

2. The hat-shaped cross-section component manufacturing method of claim 1, wherein:

the preliminarily formed component is a curved member including a curved portion that is convex on an outer surface side of the top plate in side view;

in the bending and stretching process, the vertical walls are bent and stretched at one side in the length direction of the curved portion;

in the bend back process, the vertical walls are bent back at another side in the length direction of the curved portion; and the bend back process is performed after the bending and stretching process.

3. The hat-shaped cross-section component manufacturing method of claim 1, wherein:

the preliminarily formed component is a curved member including a curved portion that is convex on an inner surface side of the top plate in side view;

in the bending and stretching process, the vertical walls are bent and stretched at one side in the length direction of the curved portion;

in the bend back process, the vertical walls are bent back at another side in the length direction of the curved portion; and the bending and stretching process is performed after the bend back process.

4. The hat-shaped cross-section component manufacturing method of claim 2, wherein each of the vertical walls include:

a vertical wall portion that is stretched in the bending and stretching process and a vertical wall portion that is bent back in the bend back process are adjacent to each other in a length direction of the hat-shaped cross-section component;

in the bending and stretching process, a bending and stretching amount of the vertical walls is set so as to become larger on progression toward the one side in the length direction of the preliminarily formed component; and in the bend back process, a bend back amount of the vertical walls is set so as to become larger on progression toward the other side in the length direction of the preliminarily formed component.

5. The hat-shaped cross-section component manufacturing method of claim 2, wherein, in the preliminary forming process in which the preliminarily formed component is formed:

a central portion of a metal sheet is gripped by a preliminary forming punch and a preliminary forming pad to form an upward and downward curved metal sheet;

both side portions of the metal sheet are gripped by a preliminary forming die and a preliminary forming holder that is provided on both width direction sides of the preliminary forming punch; and the preliminarily formed component is formed by moving the preliminary forming punch and the preliminary forming pad vertically relative to the preliminary forming holder and the preliminary forming die.

6. The hat-shaped cross-section component manufacturing method of claim 1, wherein the preliminarily formed component is configured from a steel sheet having a sheet thickness of from 0.8 mm to 3.2 mm and a tensile strength of from 200 MPa to 1960 MPa.

7. The hat-shaped cross-section component manufacturing method of claim 1, further comprising:

a restriking process of restriking the hat-shaped cross-section component that has been through the bending and stretching process and the bend back process, wherein the restriking process comprises:

disposing the hat-shaped cross-section component between a restriking punch and a restriking die, which are disposed so as to face each other, and supporting a top plate of the hat-shaped cross-section component from a restriking punch side using a support member extending from the restriking punch toward the restriking die side;

housing the top plate of the hat-shaped cross-section component inside a first recess portion configuring a top face side of a forming recess that is formed at the restriking die and that is open toward the restriking punch side, gripping the top plate using the support member and the restriking die, and positioning the hat-shaped cross-section component in a width direction using the first recess portion and a pair of vertical walls of the hat-shaped cross-section component; and inserting the restriking punch inside a second recess portion configuring the opening side of the forming recess and having a larger width dimension than the first recess portion, and restriking the hat-shaped cross-section component using the restriking punch and the restriking die.

8. The hat-shaped cross-section component manufacturing method of claim 7, wherein, in the restriking process, the hat-shaped cross-section component is restruck using the restriking punch and the restriking die in a state in which flanges configuring both width direction end portions of the hat-shaped cross-section component are in a free state.

9. The hat-shaped cross-section component manufacturing method of claim 7, wherein, in the restriking process, a restriking pad configuring part of the restriking die is disposed so as to extend toward the restriking punch side, and the top plate of the hat-shaped cross-section component supported by the support member is housed inside the first recess portion while being gripped using the restriking pad and the support member.

10. The hat-shaped cross-section component manufacturing method of claim 7, wherein the support member employed is contacted by the pair of vertical walls of the hat-shaped cross-section component.

11. The hat-shaped cross-section component manufacturing method of claim 3, wherein each of the vertical walls include:

a vertical wall portion that is stretched in the bending and stretching process and a vertical wall portion that is bent back in the bend back process are adjacent to each other in a length direction of the hat-shaped cross-section component;

in the bending and stretching process, a bending and stretching amount of the vertical walls is set so as to become larger on progression toward the one side in the length direction of the preliminarily formed component; and in the bend back process, a bend back amount of the vertical walls is set so as to become larger on progression toward the other side in the length direction of the preliminarily formed component.

12. The hat-shaped cross-section component manufacturing method of claim 3, wherein, in the preliminary forming process in which the preliminarily formed component is formed:

a central portion of a metal sheet is gripped by a preliminary forming punch and a preliminary forming pad to form an upward and downward curved metal sheet;

both side portions of the metal sheet are gripped by a preliminary forming die and a preliminary forming holder that is provided on both width direction sides of the preliminary forming punch; and the preliminarily formed component is formed by moving the preliminary forming punch and the preliminary forming pad vertically relative to the preliminary forming holder and the preliminary forming die.

13. The hat-shaped cross-section component manufacturing method of claim 8, wherein, in the restriking process, a restriking pad configuring part of the restriking die is disposed so as to extend toward the restriking punch side, and the top plate of the hat-shaped cross-section component supported by the support member is housed inside the first recess portion while being gripped using the restriking pad and the support member.

14. The hat-shaped cross-section component manufacturing method of claim 8, wherein the support member employed is contacted by the pair of vertical walls of the hat-shaped cross-section component.

15. The hat-shaped cross-section component manufacturing method of claim 9, wherein the support member employed is contacted by the pair of vertical walls of the hat-shaped cross-section component.

* * * * *